US005543282A

United States Patent [19]

Mihayashi et al.

[11] Patent Number: 5,543,282

[45] **Date of Patent: *Aug. 6, 1996**

[54] SILVER HALIDE COLOR PHOTOGRAPHIC PHOTOSENSITIVE MATERIALS COMPRISING HETEROCYCLIC CYAN COUPLERS

[75] Inventors: Keiji Mihayashi; Yasuhiro Shimada, both of Kanagawa, Japan

[73] Assignee: Fuji Photo Film Co., Ltd., Kanagawa, Japan

[ * ] Notice: The term of this patent shall not extend beyond the expiration date of Pat. No. 5,256,526.

[21] Appl. No.: 418,168

[22] Filed: Apr. 6, 1995

Related U.S. Application Data

[63] Continuation of Ser. No. 77,768, Jun. 18, 1993, abandoned.

[30] Foreign Application Priority Data

Jun. 19, 1992 [JP] Japan ..... 4-184717

[51] Int. Cl.[6] ..... G03C 7/32; G03C 1/035

[52] U.S. Cl. ..... 430/558; 430/567; 430/611; 430/614

[58] Field of Search ..... 430/558, 567, 430/611, 614

[56] References Cited

U.S. PATENT DOCUMENTS

| | | | |
|---|---|---|---|
| 4,439,520 | 3/1984 | Kofron et al. | 430/434 |
| 4,910,127 | 3/1990 | Sakaki et al. | 430/546 |
| 4,996,137 | 2/1991 | Inoue et al. | 430/567 |
| 5,068,173 | 11/1991 | Takehara et al. | 430/567 |
| 5,091,297 | 2/1992 | Fukunaga et al. | 430/558 |
| 5,256,526 | 10/1993 | Suzuki et al. | 430/558 |
| 5,270,153 | 12/1993 | Suzuki et al. | 430/558 |
| 5,298,383 | 3/1994 | Mihayashi et al. | 430/567 |
| 5,330,888 | 7/1994 | Morigaki et al. | 430/558 |
| 5,338,651 | 8/1994 | Naruse et al. | 430/558 |
| 5,340,706 | 8/1994 | Naruse et al. | 430/558 |
| 5,342,742 | 8/1994 | Naruse et al. | 430/558 |
| 5,342,747 | 8/1994 | Morigaki et al. | 430/558 |
| 5,348,847 | 9/1994 | Suzuki et al. | 430/558 |
| 5,352,571 | 10/1994 | Suzuki et al. | 430/558 |
| 5,352,573 | 10/1994 | Seto et al. | 430/558 |
| 5,366,856 | 11/1994 | Shimada et al. | 430/558 |

FOREIGN PATENT DOCUMENTS

| | | | |
|---|---|---|---|
| 0282896 | 9/1988 | European Pat. Off. . | |
| 0337370 | 10/1989 | European Pat. Off. . | |
| 0342637 | 11/1989 | European Pat. Off. . | |
| 0456226 | 11/1991 | European Pat. Off. | G03C 7/38 |
| 0484909 | 5/1992 | European Pat. Off. | G03C 7/38 |
| 0488248 | 6/1992 | European Pat. Off. . | |
| 491197 | 6/1992 | European Pat. Off. . | |

*Primary Examiner*—Janet C. Baxter
*Attorney, Agent, or Firm*—Sughrue, Mion, Zinn, Macpeak & Seas

[57] ABSTRACT

Disclosed is a silver halide photographic photosensitive material wherein a photosensitive silver halide emulsion layer contains a silver halide emulsion which is comprised of tabular grains. The grains have an aspect ratio at least 2 account for at least 50% of the total number of silver halide grains. The emulsion layer or the layer adjacent thereto also contains a cyan coupler represented by formula (Ia):

(Ia)

wherein the variables in the formula are defined in the specification.

11 Claims, No Drawings

SILVER HALIDE COLOR PHOTOGRAPHIC PHOTOSENSITIVE MATERIALS COMPRISING HETEROCYCLIC CYAN COUPLERS

This is a Continuation of application Ser. No. 08/077,768 filed Jun. 18, 1993, now abandoned.

FIELD OF THE INVENTION

This invention concerns silver halide color photographic photosensitive materials which provide improved photographic performance, colored image fastness and picture quality, which have good pressure resisting properties, and which are excellent in terms of stability during color development processing.

BACKGROUND OF THE INVENTION

Naphthol or phenol couplers are generally used for the formation of a cyan dye image. However, these couplers commonly have a major disadvantage in that color reproduction is very poor since they have undesirable absorptions in the short wavelength regions (in the region from green to blue). The resolution of this problem is desirable.

On the other hand, the couplers disclosed in JP-A-63-141057 are similar to the coupler of the present invention but they are magenta couplers. (The term "JP-A" as disclosed herein signifies an "unexamined published Japanese patent application".) Although, as magenta couplers, they certainly are improved in terms of color image fastness and color reproduction, there is the major problem of hue modification when they are used as cyan couplers. Moreover, a more active coupling reaction with the oxidized product of a primary aromatic amine color developing agent is also required.

Furthermore, pyrrolopyrazole type couplers have been disclosed in European Patent 456,226A with a view to improving the hue of the cyan dye image and improving color reproduction. Although the couplers disclosed in that specification have somewhat improved color forming properties (a high coupling reactivity with the oxidized product of a color developing agent and a high molecular extinction coefficient for the dye which is formed), improved colored image fastness and improved hue of the color forming dye, further improvement is desirable. Moreover, improvement is needed in terms of picture quality such as color reproduction and sharpness and in terms of processing stability during color development.

On the other hand, there is a need with color photosensitive materials, and especially with camera color sensitive materials, for good picture quality at high photographic speed and for stable color development processing.

The use of tabular silver halide grains for which the ratio of the diameter and the thickness (the aspect ratio) is at least 8:1 has been proposed, for example, in JP-A-58-113934 (corresponding to U.S. Pat. No. 4,439,520) as a means of providing color photosensitive materials which have such excellent picture quality at high photographic speeds. But this is still unsatisfactory in terms of increased photographic speeds, picture quality, sensitive material storage properties and color development processing stability, and still further improvement is required.

SUMMARY OF THE INVENTION

As has been described above, there is a great demand for improved picture quality such as increased photographic speed, sharpness and color reproduction, for increased levels of colored image fastness, and for stability in the color development processing of the sensitive materials in the case of camera color sensitive materials.

Hence, an object of the present invention is to provide silver halide color photographic photosensitive materials which have excellent color forming properties, which, depending on the form of the silver halide grains that are used, have increased photographic speed, which have excellent picture quality, with which the ageing storage properties and the color development processing characteristics are good, and with which the colored image fastness is improved, and which have excellent pressure resistance.

As a result of thorough investigation directed to the aforementioned object, the invention has been realized by the means which are described below.

(1) A silver halide color photographic photosensitive material, which comprises a support having thereon (1) at least one photosensitive silver halide emulsion layer comprising silver halide tabular grains in which silver halide grains of an aspect ratio at least 2 account for at least 50% of the total number of silver halide grains in the same layer, and (2) a cyan coupler represented by formula (Ia) incorporated into at least one of the silver halide emulsion layer and a hydrophilic colloidal non-photosensitive layer adjacent thereto:

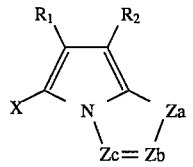

(Ia)

wherein Za represents —NH— or —CH($R_3$)—, and Zb and Zc each represents —C($R_4$)= or —N=. $R_1$, $R_2$ and $R_3$ each represents an electron withdrawing group of which the Hammett substituent group constant $\sigma_p$ value is 0.20 or above. Furthermore, the sum of the $\sigma_p$ values of $R_1$ and $R_2$ is 0.65 or above. $R_4$ represents a hydrogen atom or a substituent group. However, when there are two $R_4$ groups, they may be the same or different. X represents a hydrogen atom or a group which can be eliminated by a coupling reaction with the oxidized product of a primary aromatic amine color developing agent. Moreover, $R_1$, $R_2$, $R_3$, $R_4$ or X may be a divalent group and may form a bis compound, or may be joined to oligomer or polymer chains to form oligomers, homopolymers or copolymers.

(2) A silver halide color photographic photosensitive material as disclosed in (1) above wherein the silver halide emulsion is comprised of mono-disperse grains of which the variation coefficient of the grain diameters of the silver halide grains is not more than 0.25.

(3) A silver halide color photographic photosensitive material as disclosed in (1) or (2) above wherein the silver halide emulsion is one in which at least 50% of the total number of the silver halide grains in the same layer are comprised of hexagonal tabular grains which have two parallel planes as external surfaces and of which the ratio of the length of the longest side to the length of the shortest side is not more than 2.

(4) A silver halide color photographic photosensitive material as in any of (1) to (3) above wherein the silver halide emulsion is comprised of grains such that at least 50% of the total number of silver halide grains in the same layer contain ten or more dislocation lines per grain.

(5) A silver halide color photographic photosensitive material as in any of (1) to (4) above wherein the silver halide emulsion is comprised of silver halide grains of which the relative standard deviation of the silver iodide content of individual grains is not more than 30%.

(6) A silver halide color photographic photosensitive material as in any of (1) to (5) above which contains a compound represented by formula (A) indicated below:

$$Q—SM^1 \quad (A)$$

In this formula, Q represents a heterocyclic group which has at least one group selected from among $—SO_3M^2$, $—COOM^2$, —OH and $—NR^1R^2$ bonded to the heterocyclic directly or indirectly, $M^1$ and $M^2$ represent independently a hydrogen atom, an alkali metal, a quaternary ammonium group or a quaternary phosphonium group, and $R^1$ and $R^2$ represent independently a hydrogen atom or an alkyl group.

DETAILED DESCRIPTION OF THE INVENTION

The compounds represented by formula (Ia) are described in detail.

In formula (Ia), Za represents —NH— or $—CH(R_3)—$, and Zb and Zc each represents $—C(R_4)=$ or —N=.

Hence, the cyan couplers represented by formula (Ia) of the present invention can be represented by one of formulae (IIa) to (IXa) indicated below:

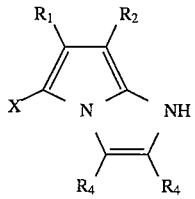
(IIa)

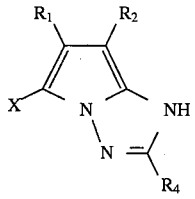
(IIIa)

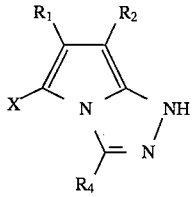
(IVa)

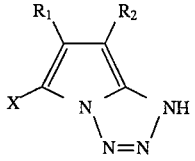
(Va)

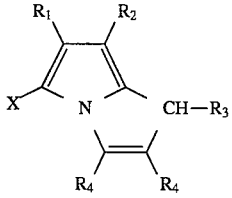
(VIa)

-continued

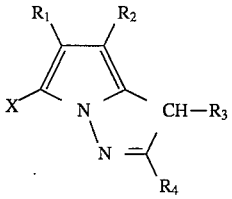
(VIIa)

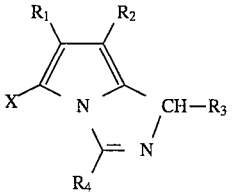
(VIIIa)

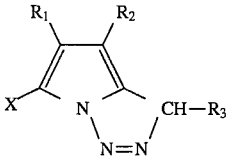
(IXa)

In these formulae, $R_1$, $R_2$, $R_3$, $R_4$ and X have the same meaning as in formula (Ia).

The spectral absorption maximum wavelength of the cyan dye formed by color development of the photographic material containing the coupler of the present invention is preferably from 580 to 700 nm.

The cyan couplers represented by formula (IIa), (IIIa) or (IVa) are preferred in the present invention, and the cyan couplers represented by formula (IIIa) are especially desirable.

The cyan couplers of the present invention are such that $R_1$, $R_2$ and $R_3$ are all electron withdrawing groups of which the $\sigma_p$ values are 0.20 or above, and the sum of the $\sigma_p$ values of $R_1$ and $R_2$ is 0.65 or above, preferably 0.70 or above with an upper limit of about 1.8.

$R_1$, $R_2$ and $R_3$ are each electron withdrawing groups of which the Hammett substituent group constant $\sigma_p$ is 0.20 or above. They are each preferably electron withdrawing groups of which the $\sigma_p$ value is 0.35 or above, and most desirably they are each electron withdrawing groups of which the $\sigma_p$ value is 0.45 or above. They are each electron withdrawing groups of which the upper limit for the $\sigma_p$ value is preferably not more than 1.0, more preferably not more than 0.75.

Hammett's rule is an empirical rule introduced by L. P. Hammett in 1935 in order to describe quantitatively the effects of substituent groups on the reactions and equilibria of benzene derivatives, and its appropriateness is now widely recognized. The substituent group constants recognized by Hammett's rule are the $\sigma_p$ value and the $\sigma_m$ value. These values have been disclosed in general text books, and they have been given in detail for example in *Lange's Handbook of Chemistry,* 12th Edition, 1979, edited by J. A. Dean (McGraw-Hill) and in *Kagaku no Ryoiki* (*Zokan*) No. 122, pages 96 to 103, 1979 (Nankodo). In the present invention, $R_1$, $R_2$ and $R_3$ are specified according to the Hammett substituent group constant $\sigma_p$, but this does not mean that they are limited to the substituent groups of which $\sigma_p$ values are disclosed in literatures. Substituent groups are of course included even if the value is unknown provided that the value, when it is measured in accordance with Hammett's rule, is within this range.

Examples of $R_1$, $R_2$ and $R_3$ which are electron withdrawing groups having the $\sigma_p$ value of 0.20 or above include acyl groups (in the present invention an acyl moiety includes an aliphatic, aromatic and heterocyclic acyl moiety), acyloxy groups, carbamoyl groups, alkoxycarbonyl groups, aryloxycarbonyl groups (in the present invention an aryl moiety is preferably a mono- or di-cyclic moiety), a cyano group, a nitro group, dialkylphosphono groups, diarylphosphono groups, diarylphosphinyl groups, alkylsulfinyl groups, arylsulfinyl groups, alkylsulfonyl groups, arylsulfonyl groups, sulfonyloxy groups such as alkyl- and aryl-sulfonyloxy groups, acylthio groups, sulfamoyl groups, thiocyanato group, thiocarbonyl groups such as alkyl- and aryl-thiocarbonyl, haloalkyl groups, haloalkoxy groups, haloaryloxy groups, haloalkylamino groups, haloalkylthio groups (examples of halogen in these groups containing halogen atom include Cl, F, Br and I), aryl groups which are substituted with other electron withdrawing groups of which $\sigma_p$ is 0.20 or above, heterocyclic groups, halogen atoms (e.g., Cl, F, Br and I), azo groups such as aryl azo groups and a selenocyanato group. The groups which can have further substituent groups among these substituent groups may be further substituted with the substituent groups cited for $R_4$ which is described hereinafter. The number of carbon atoms in $R_1$, $R_2$ and $R_3$ (including a substituent(s), if they have) is within the range of 1 to 36.

$R_1$, $R_2$ and $R_3$ are described in more detail below. Thus, acyl groups (for example, acetyl, 3-phenylpropanoyl, benzoyl, 4-dodecyloxybenzoyl), acyloxy groups (for example, acetoxy), carbamoyl groups (for example, carbamoyl, N-ethyl-carbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, N-{3-(2,4-di-tert-amylphenoxy)propyl}carbamoyl), alkoxycarbonyl groups (for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, 2-decylhexyloxycarbonylmethoxycarbonyl), aryloxycarbonyl groups (for example, phenoxycarbonyl, 2,5-di-tert-amylphenoxycarbonyl), a cyano group, a nitro group, dialkylphosphono groups (for example, dimethylphosphono), diarylphosphono groups (for example, diphenylphosphono), diarylphosphinyl groups (for example, diphenylphosphinyl), alkylsulfinyl groups (for example, 3-phenoxypropylsulfinyl), arylsulfinyl groups (for example, 3-pentadecylphenylsulfinyl), alkylsulfonyl groups (for example, methanesulfonyl, octanesulfonyl), arylsulfonyl groups (for example, benzenesulfonyl, toluenesulfonyl), sulfonyloxy groups (for example, methanesulfonyloxy, toluenesulfonyloxy), acylthio groups (for example, acetylthio, benzoylthio), sulfamoyl groups (for example, N-ethylsulfamoyl, N,N-dipropylsulfamoyl, N-(2-dodecyloxyethyl)-sulfamoyl, N-ethyl-N-dodecylsulfamoyl, N,N-diethylsulfamoyl), a thiocyanato group, thiocarbonyl groups (for example, methylthiocarbonyl, phenylthiocarbonyl), haloalkyl groups (for example, trifluoromethyl, heptafluoropropyl), haloalkoxy groups (for example, trifluoromethyloxy), haloaryloxy groups (for example, pentafluorophenyloxy), haloalkylamino groups (for example, N,N-di-(trifluoromethyl)amino), haloalkylthio groups (for example, difluoromethylthio, 1,1,2,2-tetrafluoroethylthio), aryl groups which are substituted with other electron withdrawing groups of which the $\sigma_p$ value is 0.20 or above (for example, 2,4-dinitrophenyl, 2,4,6-trichlorophenyl, pentachlorophenyl), heterocyclic groups (in the present invention a heterocyclic moiety is preferably a 5- or 6-membered heterocyclic moiety containing at least one of N, O and S atoms as a hetero atom) (for example, 2-benzoxazolyl, 2-benzothiazolyl, 1-phenyl-2-benzimidazolyl, 5-chloro-1-tetrazolyl, 1-pyrrolyl), halogen atoms (for example, chlorine, bromine), azo groups such as arylazo groups (for example, phenylazo) or a selenocyanato group are representative of the electron withdrawing groups of which the $\sigma_p$ value is 0.20 or above.

The $\sigma_p$ values of typical electron withdrawing groups are: cyano group (0.66), nitro group (0.78), trifluoromethyl group (0.54), acetyl group (0.50), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), pyrazolyl group (0.37), methanesulfonyloxy group (0.36), dimethoxyphosphoryl group (0.60), and sulfamoyl group (0.57).

Examples of preferred groups represented by $R_1$, $R_2$ and $R_3$ include acyl groups, acyloxy groups, carbamoyl groups, alkoxycarbonyl groups, aryloxycarbonyl groups, a cyano group, a nitro group, alkylsulfinyl groups, arylsulfinyl groups, alkylsulfonyl groups, arylsulfonyl groups, sulfamoyl groups, haloalkyl groups, haloalkyloxy groups, haloalkylthio groups haloaryloxy groups, haloaryl groups, aryl groups which are substituted with two or more nitro groups, and heterocyclic groups. Acyl groups, alkoxycarbonyl groups, aryloxycarbonyl groups, a nitro group, a cyano group, arylsulfonyl groups, carbamoyl groups and haloalkyl groups are more desirable. The cyano group, alkoxycarbonyl groups and aryloxycarbonyl groups and haloalkyl groups are even more desirable.

An alkoxycarbonyl group substituted with a cyano group, a fluorine atom, an alkoxycarbonyl group or a carbamoyl group, or a linear chain, branched chain or ether bond containing alkoxycarbonyl group, or an unsubstituted or alkyl or alkoxy group substituted aryloxycarbonyl group is especially desirable.

In a preferred combination of $R_1$ and $R_2$, $R_1$ is a cyano group and $R_2$ is (1) an alkoxycarbonyl group substituted with a fluorine atom, an alkoxycarbonyl group or a carbamoyl group, (2) a linear chain, branched chain or ether bond containing alkoxycarbonyl group, or (3) an unsubstituted or alkyl or alkoxy group-substituted aryloxycarbonyl group.

$R_4$ represents a hydrogen atom or a substituent such as halogen atoms, aliphatic or alicyclic hydrocarbon groups, aryl groups, heterocyclic groups, alkoxy groups, aryloxy groups, heterocyclic oxy groups, alkyl-, aryl- or heterocyclic thio groups, acyloxy groups, carbamoyloxy groups, silyloxy groups, sulfonyloxy groups such as alkyl-, aryl- and heterocyclic-sulfonyloxy groups, acylamino groups, alkylamino groups, arylamino group, ureido groups, sulfamoylamino groups, alkenyloxy groups, formyl groups, aliphatic, aromatic or heterocyclic-acyl groups, alkyl-, aryl- or heterocyclic-sulfonyl groups, alkyl-, aryl- or heterocyclic-sulfinyl groups, alkyl-, aryl- or heterocyclic-oxycarbonyl groups, alkyl-, aryl- or heterocyclic-oxycarbonylamino groups, sulfonamido groups such as alkyl-, aryl- and heterocyclic-sulfonamido groups, carbamoyl groups, sulfamoyl groups, phosphonyl groups, sulfamoylamino groups, imido groups, a hydroxy group, a cyano group, —COOM and —$SO_3M$ (M represents a hydrogen atom, an alkali metal atom such as Li, Na and K, or $NH_4$), a nitro group, and an unsubstituted amino group, for example, can be cited as such substituent groups. The alkyl groups, aryl groups or heterocyclic groups included among these groups may be further substituted with substituent groups as indicated for $R_4$.

More precisely, $R_4$ represents, for example, a hydrogen atom, a halogen atom (for example, chlorine, bromine), an aliphatic or alicyclic group (for example, a linear chain or branched chain alkyl, aralkyl, alkenyl, alkynyl, cycloalkyl or cycloalkenyl group having a carbon number of 1 to 36, such as methyl, ethyl, propyl, isopropyl, tert-butyl, dodecyl, 2-methanesulfonylethyl, 3-(3-pentadecylphenoxy)propyl, 3-{4-{2-[4-(4-hydroxyphenylsulfonyl)phenoxy] dodecanamido}phenyl}propyl, 2-ethoxytridecyl, trifluoromethyl, cyclopentyl, 3-(2,4-di-tert-amylphenoxy)propyl), an aryl group (preferably of a carbon number of 6 to 36, for example, phenyl, naphthyl, 4-hexadecoxyphenyl, 4-tert-butylphenyl, 2,4-di-tert-amylphenyl, 4-tetradecanamido phenyl, 3-(2,4-di-tert-amylphenoxyacetamido)phenyl), a heterocyclic group (for example, 3-pyridyl, 2-furyl, 2-thienyl, 2-pyridyl, 2-pyrimidinyl, an azolyl group such as imidazolyl, pyrazolyl, 3-chloropyrazol-1-yl, triazolyl, 2-benzothiazolyl), an alkoxy group (for example, methoxy, ethoxy, 2-methoxyethoxy, 2-dodecyloxyethoxy, 2-methanesulfonylethoxy), an aryloxy group (for example, phenoxy, 2-methylphenoxy, 4-tert-butylphenoxy, 2,4-di-tert-amylphenoxy, 2-chlorophenoxy, 4-cyanophenoxy, 3-nitrophenoxy, 3-tert-butyloxycarbamoylphenoxy, 3-methoxycarbamoylphenoxy), a heterocyclic oxy group (for example, 2-benzimidazolyloxy, 1-phenyltetrazol-5-oxy, 2-tetrahydropyranyloxy), an alkyl-, aryl- or heterocyclic-thio group (for example, methylthio, ethylthio, octylthio, tetradodecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophenylthio, 2-benzothiazolylthio, 2,4-diphenoxy-1,3,4-triazole-6-thio, 2-pyridylthio), an acyloxy group (acetoxy, hexadecanoyloxy), a carbamoyloxy group (for example, N-ethylcarbamoyloxy, N-phenylcarbamoyloxy), a silyloxy group preferably having a carbon number of 3 to 9 (for example, trimethylsilyloxy, dibutylmethylsilyloxy), a sulfonyloxy group (for example, dodecylsulfonyloxy), an acylamino group (for example, acetamido, benzamido, tetradecanamido, 2,4-di-tert-amylphenoxyacetamido, 2-[4-(4-hydroxyphenylsulfonyl)phenoxy]decanamido), isopentadecanamido, 2-(2,4-di-tert-amylphenoxy)butanamido, 4-(3-tert-butyl-4-hydroxyphenoxy)butanamido), an alkylamino group (for example, methylamino, butylamino, dodecylamino, dimethylamino, diethylamino, methylbutylamino), an arylamino group (for example, phenylamino, 2-chloroanilino, 2-chloro-5-tetradecanamidoanilino, N-acetylanilino, 2-chloro-5-[α-2-tert-butyl- 4-hydroxyphenoxy)dodecanamido]anilino, 2-chloro-5 -dodecyloxycarbonylanilino), a ureido group (for example, methylureido, phenylureido, N,N-dibutylureido, dimethylureido), a sulfamoylamino group (for example, N, N-dipropylsulfamoylamino, N-methyl-N-decylsulfamoylamino), an alkenyloxy group (for example, 2-propenyloxy), a formyl group, an aliphatic, aromatic or heterocyclic acyl group (for example, acetyl, benzoyl, 2,4-di-tert-amylphenylacetyl, 3-phenylpropanoyl, 4-dodecyloxybenzoyl), an alkyl-, aryl- or heterocyclic-sulfonyl group (for example, methanesulfonyl, octanesulfonyl, benzenesulfonyl, toluenesulfonyl), a sulfinyl group (for example, octanesulfinyl, dodecylsulfinyl, dodecanesulfinyl, phenyl-sulfinyl, 3-pentadecylphenylsulfinyl, 3-phenoxypropylsulfinyl), an alkyl-, aryl- or heterocyclic-oxycarbonyl group (for example, methoxycarbonyl, butoxycarbonyl, dodecyloxycarbonyl, octadecyloxycarbonyl, phenyloxycarbonyl, 2-pentadecyloxycarbonyl), an alkyl-, aryl- or heterocyclic-oxycarbonylamino group (for example, methoxycarbonylamino, tetradecyloxycarbonylamino, phenoxycarbonylamino, 2,4-di-tert-butylphenoxycarbonylamino), a sulfonamido group (for example, methanesulfonamido, hexadecanesulfonamido, benzenesulfonamido, p-toluenesulfonamido, octadecanesulfonamido, 2-methyloxy-5-tert-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy)propyl] carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a phosphonyl group (for example, phenoxyphosphonyl, octyloxyphosphonyl, phenylphosphonyl), a sulfamoylamino group preferably having a carbon number of 0 to 36 (for example, dipropylsulfamoylamino), an imido group (for example, N-succinimido, hydantoinyl, N-phthalimido, 3-octadecenylsuccinimido), a hydroxy group, a cyano group, a carboxy group, a nitro group, a sulfo group, or an unsubstituted amino group. The organic groups represented by $R_4$ and of which the carbon number is not shown have a carbon number within the range of 1 to 36.

Examples of preferred groups represented by $R_4$ include alkyl groups, aryl groups, heterocyclic groups, a cyano group, a nitro group, acylamino groups, arylamino groups, ureido groups, sulfamoylamino groups, alkylthio groups, arylthio groups, alkoxycarbonylamino groups, sulfonamido groups, carbamoyl groups, sulfamoyl groups, sulfonyl groups, alkoxycarbonyl groups, aryloxycarbonyl groups, heterocyclic oxy groups, acyloxy groups, carbamoyloxy groups, aryloxycarbonylamino groups, imido groups, heterocyclic thio groups, sulfinyl groups, phosphonyl groups, and acyl groups.

Alkyl groups and aryl groups are more desirable, and alkyl groups or aryl groups which have at least one alkoxy group, sulfonyl group, sulfamoyl group, carbamoyl group, acylamido group or sulfonamido group as a substituent group are even more desirable. Alkyl groups and aryl groups which have at least one acylamido group or sulfonamido group as a substituent group are especially desirable.

X in formula (Ia) represents a hydrogen atom or a group (referred to hereinafter as a leaving group) which is eliminated when the coupler undergoes a reaction with the oxidized product of a primary aromatic amine color developing agent. When X represents a leaving group, the leaving group is a halogen atom, an aromatic azo group, an imido group, a nitrogen containing heterocyclic group (bonded to the coupling position via the nitrogen atom; the heterocyclic group is preferably a 5- or 6-membered ring which may further contain at least one of N, O, and S atoms), or a group comprising a linking group and an alkyl group, an aryl group or a heterocyclic group (preferably a 5- or 6-membered heterocyclic group containing at least one of N, O and S atoms as a hetero atom). The linking group is bonded to the coupling position via an oxygen, nitrogen, sulfur or carbon atom.

Examples of the linking group include the followings.

—O—, —NH—, —S—, —$SO_2$—, —SO—, —CO—, $$-\overset{\overset{\displaystyle O}{\|}}{O}PO-$$

and a combinating of at least two of these linking groups, such as —CONH—, —CONHCO—, $$-\underset{\underset{\displaystyle O}{\|}}{C}O-,$$

—$SO_2O$—, —OCOO—, —SONH— and —NHCONH—.

Examples of the group represented by X include an alkyl- or aryl-sulfonyl group, an arylsulfinyl group, an alkyl-, aryl- or heterocyclic-carbonyl group or a heterocyclic group which is bonded to the coupling position through a nitrogen atom, a halogen atom, an alkoxy group, an aryloxy group, an acyloxy group, an alkyl- or aryl-sulfonyloxy group, an acylamino group, an alkyl- or aryl-sulfonamido group, an alkoxycarbonyloxy group, an aryloxycarbonyloxy group, an alkyl-, aryl- or heterocyclic-thio group, a carbamoylamino group, an arylsulfinyl group, an arylsulfonyl group, a five or six membered nitrogen containing heterocyclic group, an imido group or an arylazo group, and the alkyl, aryl or heterocyclic groups which are included in these leaving groups may be further substituted with the substituent groups for $R_4$. When there are two or more of these substituent groups they may be the same or different, and these substituent groups may, moreover, have the substituent groups which have been cited in connection with $R_4$.

More precisely, the leaving group is, for example, a halogen atom (for example, fluorine, chlorine, bromine), an alkoxy group (for example, ethoxy, dodecyloxy, methoxyethylcarbamoylmethoxy, carboxypropyloxy, methylsulfonylethoxy, ethoxycarbonylmethoxy), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (for example, acetoxy, tetradecanoyloxy, benzoyloxy), an alkyl- or aryl-sulfonyloxy group (for example methanesulfonyloxy, toluenesulfonyloxy), an acylamino group (for example dichloroacetylamino, pentafluorobutyrylamino), an alkyl- or aryl-sulfonamido group (for example methanesulfonamino, trifluoromethanesulfonamino, p-toluenesulfonylamino), an alkoxycarbonyloxy group (for example, ethoxycarbonyloxy, benzyloxycarbonyloxy), an aryloxycarbonyloxy group (for example, phenoxycarbonyloxy), an alkyl-, aryl- or heterocyclic-thio group (for example, ethylthio, 2-carboxyethylthio, dodecylthio, 1-carboxydodecylthio, phenylthio, 2-butoxy-5-tert-octylphenylthio, tetrazolylthio), an arylsulfonyl group (for example, 2-butoxy-5-tert-octylphenylsulfonyl), an arylsulfinyl group (for example 2-butoxy-5-tert-octylphenylsulfinyl), a carbamoylamino group (for example N-methylcarbamoylamino, N-phenylcarbamoylamino), a five or six membered nitrogen containing heterocyclic group (for example imidazolyl, pyrazolyl, triazolyl, tetrazolyl, 1,2-dihydro-2-oxo-1-pyridyl), an imido group (for example succinimido, hydantoinyl) or an arylazo group (for example phenylazo, 4-methoxyphenylazo). Of course, these groups may be further substituted with groups cited as the substituent groups $R_4$. Furthermore, there are bis-type couplers which are obtained by condensing four-equivalent couplers with aldehydes or ketones in which the leaving group is bonded via a carbon atom. The leaving groups of the present invention may contain photographically useful groups such as development inhibitors and development accelerators for example.

X is preferably a halogen atom, an alkoxy group, an aryloxy group, an alkyl- or aryl-thio group, an arylsulfonyl group, an arylsulfinyl group, or a five or six membered nitrogen containing heterocyclic group which is bonded to the coupling position by a nitrogen atom. An arylthio group is most desirable.

The cyan couplers represented by formula (Ia) may form dimers or larger oligomers with the group $R_1$, $R_2$, $R_3$, $R_4$ or X containing a cyan coupler moiety of formula (Ia). Or they may form a homopolymer or copolymer with the group $R_1$, $R_2$, $R_3$, $R_4$ or X containing a polymer chain. A homopolymer or copolymer which contains a polymer chain is typically a homopolymer or copolymer of an addition polymerizable ethylenic type unsaturated compound which has a cyan coupler moiety of formula (Ia). In this case, one or more cyan color forming repeating units which have a cyan coupler moiety of formula (Ia) may be included in the polymer, or it may be a copolymer which includes one or more types of non-color forming ethylenic type monomer which does not couple with the oxidized product of a primary aromatic amine developing agent, such as an acrylic acid ester, methacrylic acid ester or maleic acid ester, for example, as a copolymer component.

Examples of couplers of the present invention are indicated below, but the invention is not limited by these examples:

(1)
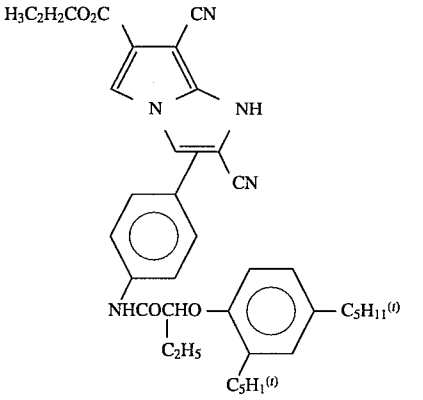
(2)
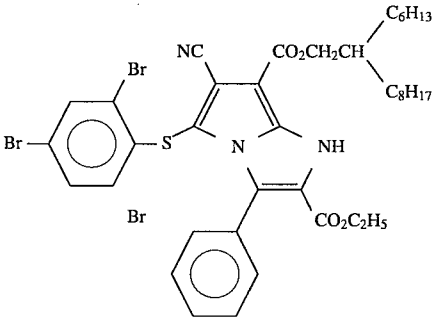

-continued
(3)
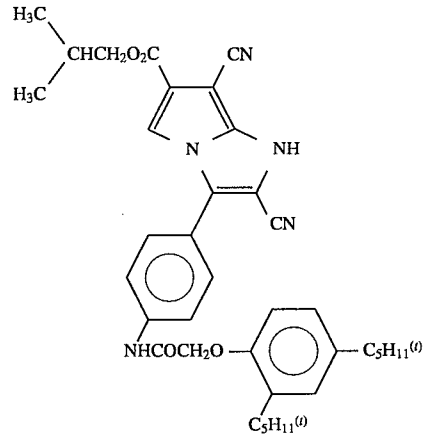
(4)
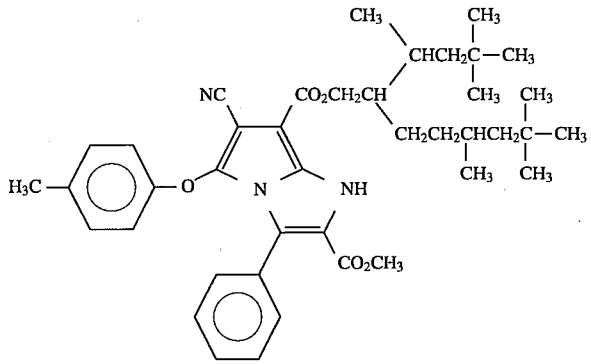

-continued
(5)
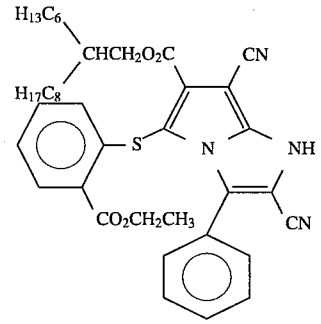
(6)
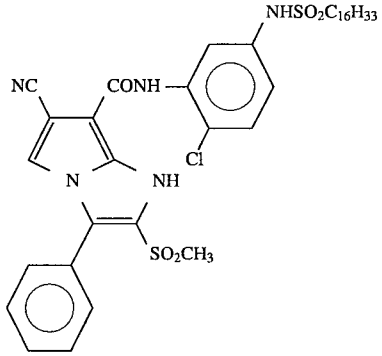
(7)
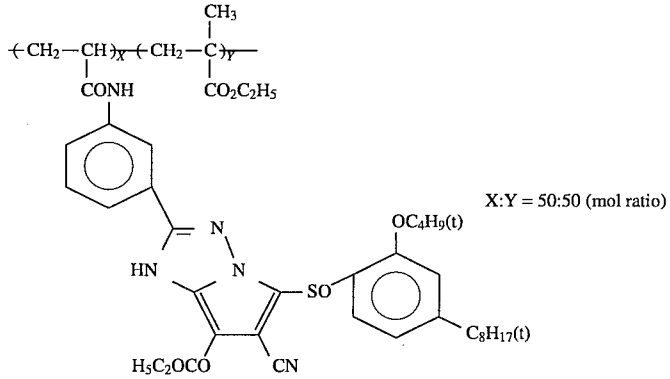

-continued
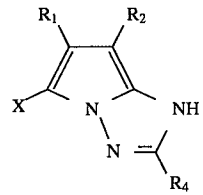
| No. | $R_1$ | $R_2$ | $R_4$ | X |
|---|---|---|---|---|
| 8 | $CO_2CH_3$ | CN | 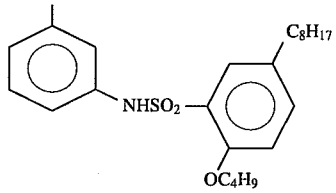 | H |
| 9 | CN | 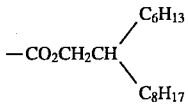 | 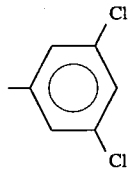 | H |
| 10 | CN | 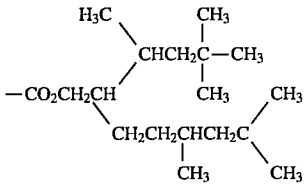 | 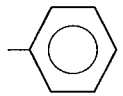 | H |
| 11 | CN | 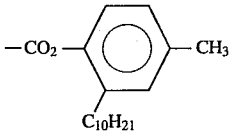 | 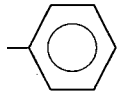 | H |
| 12 | CN | 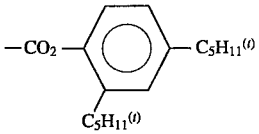 | 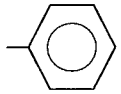 | H |

-continued
| | | | | |
|---|---|---|---|---|
| 13 | CN | $-CO_2CH_2CO_2CH_2CH(C_6H_{13})(C_8H_{17})$ | 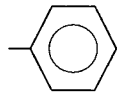 | H |
| 14 | CN | $-CO_2CH_2CH_2(CF_2)_6F$ | 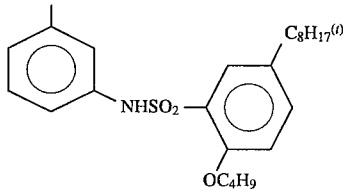 | H |
| 15 | CN | $-CO_2CH_2CON(C_2H_5)_2$ | 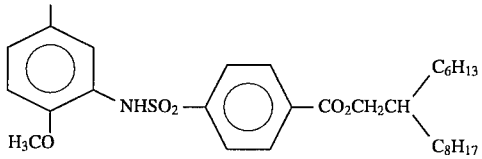 | 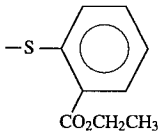 |
| 16 | CN | $-CO_2CH_2CH_2(CF_2)_6F$ | 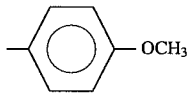 | 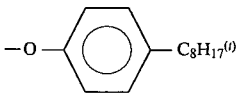 |
| 17 | CN | $-CO_2CH_2CH(C_2H_5)(C_4H_9)$ | 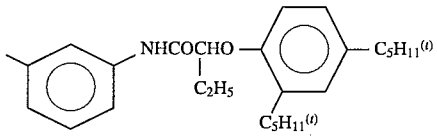 | 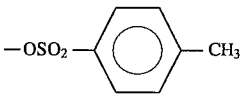 |
| 18 | CN | 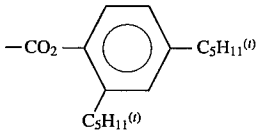 | 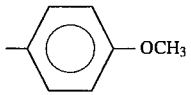 | 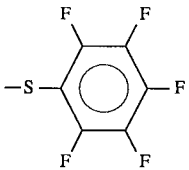 |
| 19 | CN | $-CO_2CH_2CH(CH_3)_2$ | 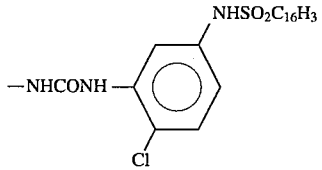 | 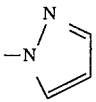 |

-continued
| | | | | |
|---|---|---|---|---|
| 20 | CN | $-CO_2CH_2(CF_2)_4H$ | 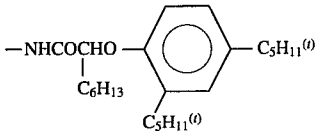 | 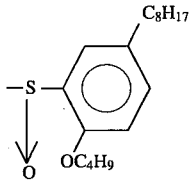 |
| 21 | CN | 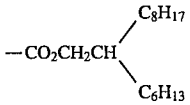 | 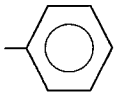 | H |
| 22 | 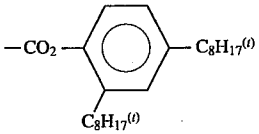 | CN | 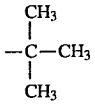 | 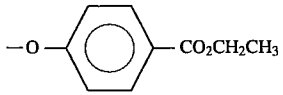 |
| 23 | $-CO_2CH_2C_6F_{13}$ | CN | 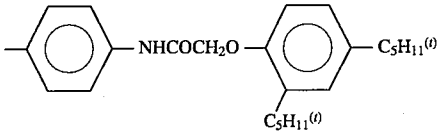 | Cl |
| 24 | 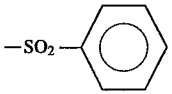 | 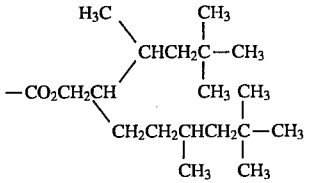 | $CH_3$ | $-OCOCH_3$ |
| 25 | CN | $-CO_2CH_2CO_2CH_4$ | 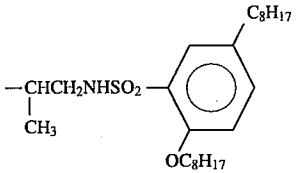 | 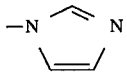 |

-continued
| | | | | |
|---|---|---|---|---|
| 26 | CN | 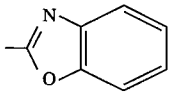 | 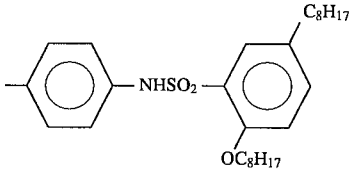 | 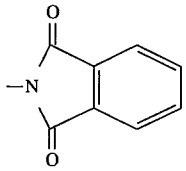 |
| 27 | CN | $CF_3$ | 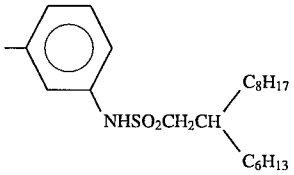 | Cl |
| 28 | 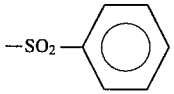 | $CF_3$ | 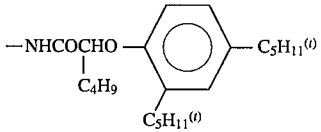 | F |
| 29 | CN | 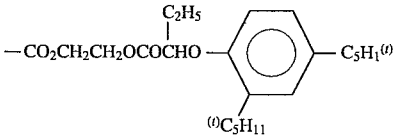 | 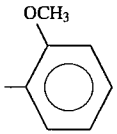 | 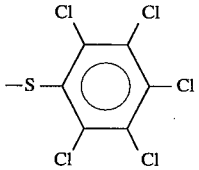 |
| 30 | CN | 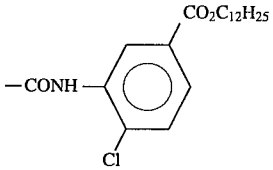 | 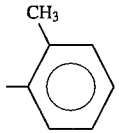 | 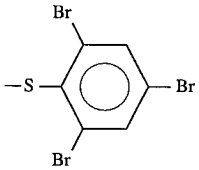 |
| 31 | CN | 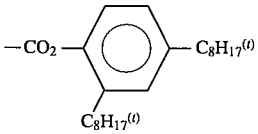 | 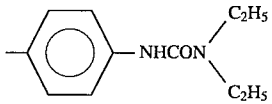 | 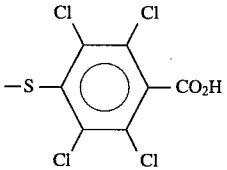 |

-continued
| | | | | |
|---|---|---|---|---|
| 32 | CN | $-CO_2CH(CH_3)_2$ | $-C_6H_4-OCH_2CH(C_6H_{13})C_8H_{17}$ | $-S-C_6H_2Cl_4-CO_2C_8H_{17}$ |
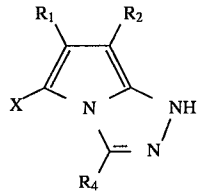
| No. | $R_1$ | $R_2$ | $R_4$ | X |
|---|---|---|---|---|
| 33 | CN | $-C_6H_4F_5$ | $-C_6H_4-NHCOCH(C_2H_5)-C_6H_3(C_5H_{11}(t))-C_5H_{11}(t)$ | $-N(N)-C_6H_3-COCH_3$ |
| 34 | $-C_6H_3(CF_3)-F_3C$ | $-SO_2Ph$ | $-CON(C_8H_{17})C_8H_{17}$ | $-OP(=O)OC_2H_5$ |
| 35 | CN | $-CON(C_6H_5)C_6H_5$ | $-NHSO_2-C_6H_4-CO_2CH_2CH(C_6H_{13})C_8H_{17}$ | $-N(N)-C_3H_2N$ |
| 36 | CN | $-CO_2CH_2-C_6H_5$ | $-C_6H_4-NHCOCH(C_6H_{13})-C_6H_3(C_5H_{11}(t))-C_5H_{11}(t)$ | H |

-continued
| | | | | |
|---|---|---|---|---|
| 37 | CN | 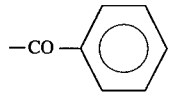 | 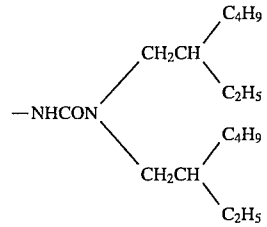 | $-OSO_2CH_3$ |
| 38 | $-CO_2C_2H_5$ | CN | 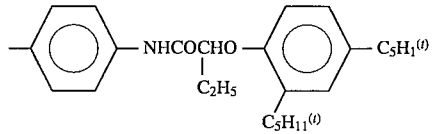 | Cl |
| 39 | CN | 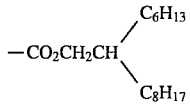 | 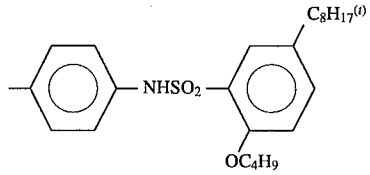 | H |
| 40 | CN | $-CO_2CH_2CH_2(CF_2)_6F$ | 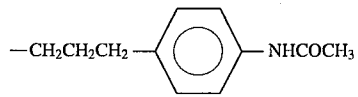 | 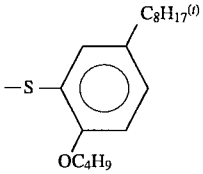 |
| 41 | CN | 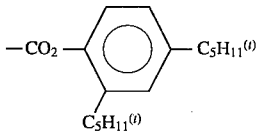 | 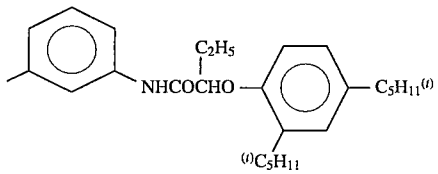 | 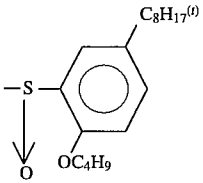 |

-continued
| | | | | |
|---|---|---|---|---|
| 42 | CN | 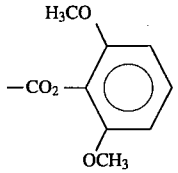 | 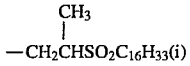 | 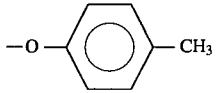 |
| 43 | CN | 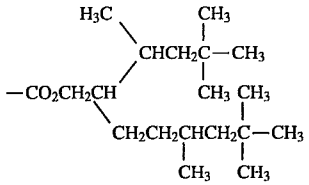 | 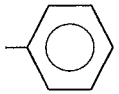 | H |
| 44 | CN | 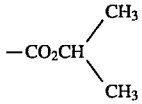 | 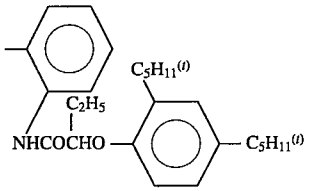 | Cl |
| 45 | CN | 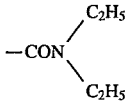 | 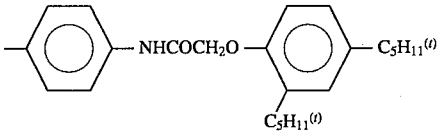 | $-OSO_2CH_3$ |
(46)
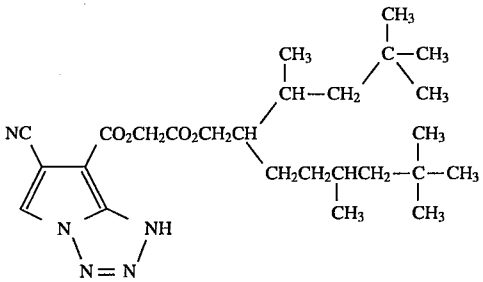

-continued
(47)
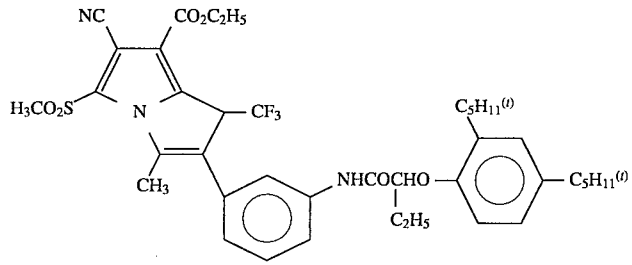
(48)
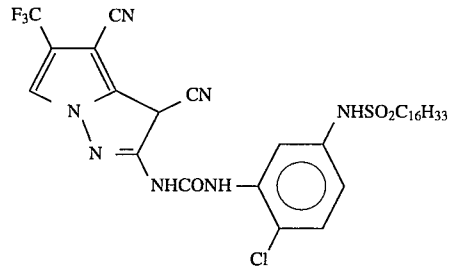
(49)
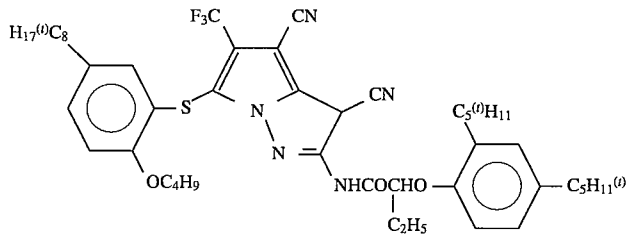
(50)
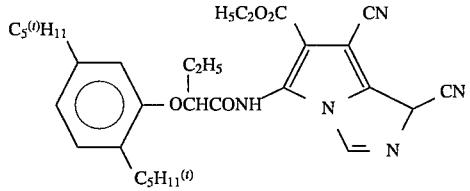

-continued
(51)
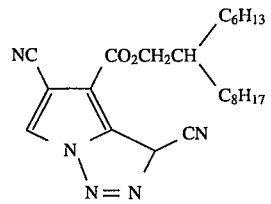
(52)
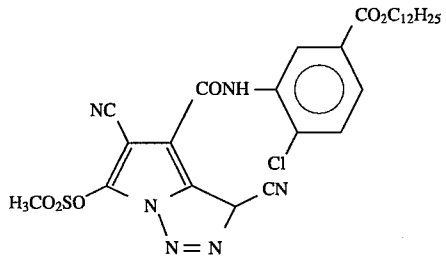

The preparation of the compounds of the present invention and intermediates can be achieved using known methods of synthesis. For example, they can be prepared using the methods disclosed in *J. Am. Chem. Soc.*, 80, 5332 (1958), *J. Am. Chem. Soc.*, No. 81, 2452, (1959), *J. Am. Chem. Soc.*, 112, 2465 (1990), *Org. Synth.*, I, 270 (1941), (1959), *J. Chem. Soc.*, 5149 (1962), *Heterocyclic.*, No.27, 2301 (1988) and *Rec. Trav. Chim.*, 80, 1075 (1961) and in the literature references cited in these papers, and using methods similar thereto.

An example of synthesis is described below.

Example of Synthesis 1

The Preparation of Illustrative Compound (9)

Illustrative Compound (9) was prepared using the route outlined below:

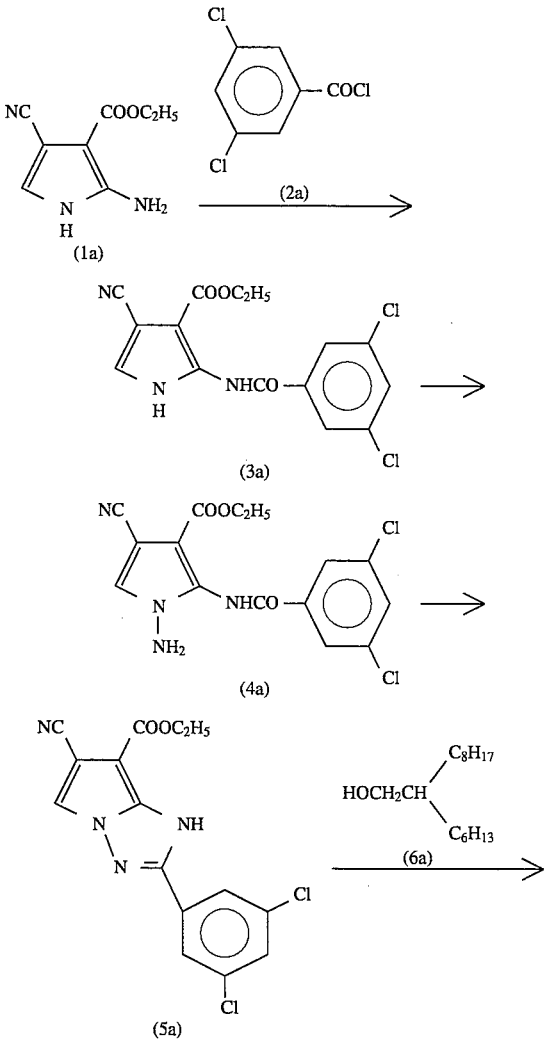

-continued

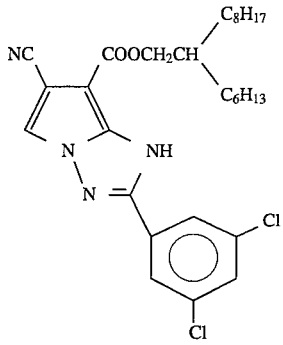

Illustrative Compound (9)

3,5-Dichlorobenzoyl chloride (2a) (83.2 grams, 0.4 mol) was added at room temperature to a dimethylacetamide (300 ml) solution of 2-amino-4-cyano-3-ethoxycarbonylpyrrole (1a) (66.0 grams, 0.4 mol) and the mixture was stirred for 30 minutes. Water was added and the mixture was extracted twice with ethyl acetate. The organic layer was collected and washed with water and saturated sodium chloride solution and then dried over anhydrous sodium sulfate. The solvent was distilled off under reduced pressure and, on recrystallization from acetonitrile (300 ml), compound (3a) (113 grams, 84%) was obtained.

Potassium hydroxide powder (252 grams, 4.5 mol) was added at room temperature to a dimethylformamide (200 ml) solution of compound (3a) (101.1 grams, 0.3 mol) and the mixture was stirred thoroughly. Hydroxylamine-O-sulfonic acid (237 grams, 2.1 mol) was added slowly with water cooling, taking care that the temperature did not rise suddenly, and the mixture was stirred for 30 minutes after the addition. The mixture was then neutralized by titration with 0.1N aqueous hydrochloric acid solution using pH test papers. The mixture was extracted three times with ethyl acetate, the organic layer was washed with water and saturated sodium chloride solution and then it was dried with anhydrous sodium sulfate. The solvent was distilled off under reduced pressure. On refinement using column chromatography (developing solvent: Hexane:Ethyl acetate=2:1), the compound (4a) (9.50 grams, 9%) was obtained.

Carbon tetrachloride (9 ml) was added at room temperature to an acetonitrile (30 ml) solution of compound (4a) (7.04 grams, 20 mmol) and then triphenylphosphine (5.76 grams, 22 mmol) was added and the mixture was heated under reflux for 8 hours. After cooling, water was added and the mixture was extracted three times with ethyl acetate. The organic layer was washed with water and saturated salt water and then dried over anhydrous sodium sulfate. The solvent was distilled off under reduced pressure and, on refinement using silica gel column chromatography (developing solvent: Hexane:Ethyl acetate=4:1), compound (5a) (1.13 grams, 17%) was obtained.

The compound (5a) (1.8 grams) so obtained and 12.4 grams of compound (6a) were dissolved in 2.0 ml of sulforane and then 1.5 grams of titanium isoperoxide were added thereto. The reaction temperature was maintained at 110° C. and, after reacting for 1.5 hours, ethyl acetate was added and the mixture was washed with water. The ethyl acetate layer was dried and then distilled, and 1.6 grams of the intended illustrative compound (9) was obtained by refining the residue using column chromatography.

The melting point was 97° to 98° C.

The compounds represented by formula (Ia) of the present invention preferably used in amounts in the range 2.0 to $1.0\times10^{-3}$ mol, more preferably 1.0 to $2.0\times10^{-2}$ mol, and most desirably $5.0\times10^{-1}$ to $5.0\times10^{-2}$ mol, per mole of silver halide in the same silver halide emulsion layer when the compound is incorporated into a silver halide emulsion layer or in the silver halide emulsion layer containing larger amount of the coupler than that in the other adjacent emulsion layer when the compound is incorporated into a non-photosensitive layer present between two silver halide emulsion layer.

In the present invention, when the compounds represented by formula (Ia) are used as the principal couplers, they are preferably added to a red sensitive silver halide emulsion layer or a non-photosensitive layer (such as an antihalation layer and an interlayer) adjacent thereto. Furthermore, when they are couplers which release a photographically useful group, they are added to a silver halide photosensitive layer or a hydrophilic colloidal non-photosensitive layer according to the intended purpose.

In the present invention, two or more of the compounds represented by formula (Ia) can be used conjointly. The compound can also be used conjointly with other known couplers. Although the mixing ratio of the other couplers may be determined according on the required characteristics for the photographic material, the amount of the compound of the present invention is preferably at least 30 mol %, more preferably at least 50 mol % based on the total amount of the couplers in the same layer.

In the present invention, the compounds represented by formula (Ia) can be introduced into the color photosensitive material using a variety of known methods of dispersion.

In the present invention, the compounds represented by formula (Ia) are preferably dispersed using the oil in a water dispersion method where they are dispersed using a high boiling point organic solvent. A solvent which has boiling point at normal pressure of at least 175° C. is preferred for the high boiling point organic solvent, and the amount used is not more than 5.0 grams, preferably $1\times10^{-3}$ to 2.0 grams, and most desirably $1\times10^{-2}$ to 1.0 gram, per gram of the compound of formula (Ia).

The tabular silver halide emulsions which are used in the invention are described in detail below.

The emulsions of the present invention contain tabular silver halide grains having an aspect ratio of at least 2 in an amount of 50% based on the total number of silver halide grains and contain grains having a grain diameter (defined hereinbelow) of at least 0.1 μm in an amount of 50% based on the total number of silver halide grains. The emulsion preferably does not contain grains having a grain diameter of less than 0.1 μm. The grain diameter is preferably is not more than 20 μm. Here, a tabular grain is a general term for a grain which has a twinned crystal plane or two or more parallel twinned crystal planes. The (111) plane is a twinned crystal plane when the ions at all the lattice points on both sides of the (111) plane have a mirror image relationship. When a tabular grain is viewed from above, it may have a triangular shape, a hexagonal shape or a circular shape obtained by rounding off these shapes. Those which have a triangular shape have opposed parallel outer surfaces of triangular shape. Those which have a hexagonal shape have opposed parallel outer surfaces of hexagonal shape. And those which have a circular shape have opposed parallel outer surfaces of circular shape.

The aspect ratio of the tabular grains in the present invention is the value obtained by dividing the grain diameter by the thickness for each tabular grain which has a grain diameter of at least 0.1 μm. Measurement of grain thickness is achieved by vapor depositing metal from an oblique angle onto the grains and a reference latex and then measuring the shadow length on electron microscope photographs. The grain thickness can then be obtained easily by calculation with reference to the length of the shadows of the latex.

The grain diameter (grain size) in the present invention is the diameter of the circle which has the same area as the projected area of the parallel outer surfaces of the grain.

The projected area of a grain is obtained by measuring the area on an electron microscope photograph and correcting for the magnification.

The average aspect ratio is obtained as the arithmetic average of the aspect ratio of each of at least one hundred silver halide grains. Furthermore, it can also be obtained as the ratio of the average diameter with respect to the average thickness of the grains.

The tabular silver halide grains which are used in the silver halide emulsions of the present invention have a grain diameter of at least twice the grain thickness, but the grain diameter is preferably from 3 to 20 times, more desirably from 4 to 15 times, and most desirably from 5 to 10 times, the grain thickness. Furthermore, the proportion of the projected area of all the silver halide grains accounted for by tabular silver halide grains is at least 50%, but it is preferably at least 70%, and most desirably at least 85%.

It is possible to obtain silver halide photographic photosensitive materials which have excellent sharpness using emulsions of this type. Excellent sharpness is achieved because the light scattering by an emulsion layer in which such an emulsion has been used is very small when compared with that observed with a conventional emulsion layer. This fact can be confirmed easily using experimental methods well known to those in this field. The reason that the extent of light scattering in an emulsion layer in which a tabular silver halide emulsion has been used should be so low is unclear. But it is thought that it may be due to the principal planes in the tabular silver halide emulsion being oriented in a direction parallel with the surface of the support.

Furthermore, the diameter of the tabular silver halide grains is preferably from 0.1 to 20 μm, more preferably from 0.3 to 10.0 μm, and most desirably from 0.4 to 5.0 μm. The thickness of the grains is preferably not more than 0.7 μm, more preferably not more than 0.5 μm, most preferably not more than 0.3 μm, and preferably not less than 0.02 μm.

In the present invention, the preferred tabular silver halide grains have a grain diameter of at least 0.3 μm and not more than 10.0 μm, and a grain thickness of not more than 0.3 μm, and, moreover, the average (diameter/thickness) value is at least 5 but not more than 10. If the value is more than 10, the anomalies arise in photographic performance when the photosensitive material is folded, wound up tightly or touched with a sharp object, and this is undesirable. Silver halide photographic emulsions in which grains of a diameter at least 0.4 μm but not more than 5.0 μm and of an average (diameter/thickness) value at least 5 account for at least 85% of the total projected area of all the silver halide grains are most desirable.

The tabular silver halide grains which are used in the present invention may be comprised of silver chloride, silver bromide, silver chlorobromide, silver iodobromide or silver chloroiodobromide, but silver bromide, silver iodobromide which contains 0.2 to 30 mol % silver iodide, or chloroiodobromide or silver chlorobromide, which contain not more than 50 mol % silver chloride and not more than 2 mol % silver iodide, are preferred. The composition distribution in the mixed silver halides may be uniform or localized.

The tabular silver halide emulsions which are used in the present invention have been disclosed in a report by Cugnac and Chateau, on pages 66 to 72 of *Photographic Emulsion Chemistry* edited by Duffin (Focal Press, New York, 1966) and by A. P. H. Trivelli and W. F. Smith in *Phot. Journal,* 80 (1940), page 285. They can be prepared easily by the methods disclosed in JP-A-58 -113927, JP-A-58-113928 and JP-A-58-127921.

For example, they can be obtained by forming seed crystals among which tabular grains are present in an amount of at least 50% under conditions of pBr not more than 1.3 at comparatively high pAg values and growing the seed crystals while adding silver and halogen solutions simultaneously while maintaining a similar pBr value. It is desirable that the silver and halogen solutions be added in such a way that no new crystal nuclei are formed in the grain growth process.

In the present invention the tabular silver halide grains are preferably contained in an amount of 50%, more preferably 70%, and most preferably 85% based on the total number of silver halide grains in the emulsion.

The size of the tabular silver halide grains can be controlled by controlling the temperature, selecting the type and nature of the solvents, and controlling the rate of addition of the silver salt and the halide which are used during grain growth.

The grain size, the form of the grains (diameter/thickness ratio for example), the grain size distribution and the growth rate of the grains can be controlled by using silver halide solvents, as required, during the manufacture of the tabular silver halide grains of the present invention. The amount of the solvent used is preferably within the range from $10^{-3}$ to 1.0 percent by weight, and most desirably within the range from $10^{-2}$ to $10^{-1}$ percent by weight, of the reaction solution. In the present invention the grain size distribution tends to become mono-disperse as the amount of solvent used is increased, and the growth rate can be increased. On the other hand the thickness of the grains tends to increase as the amount of solvent used is increased.

The known silver halide solvents can be used in the present invention. Frequently used silver halide solvents include, for example, ammonia, thioether, thioureas, thiocyanate and thiazolinethiones. Reference can be made to U.S. Pat. Nos. 3,271,157, 3,574,628 and 3,790,387 for example in connection with thioether. Furthermore, reference can be made to JP-A-53-82408 and JP-A-55-77737 in connection with thioureas, to U.S. Pat. Nos. 2,222,264, 2,448,534 and 3,320,069 in connection with thiocyanate, and to JP-A-53-144319 in connection with thiazolinethiones.

Cadmium salts, zinc salts, thallium salts, iridium salts and complex salts thereof, rhodium salts and complex salts thereof, and iron salts and complex salts thereof, for example, may be present during the processes of formation or physical ripening of the silver halide grains.

The methods in which the rates of addition of the silver salt solution (for example, aqueous $AgNO_3$ solution) and the halide solution (for example, aqueous KBr solution) which are added in order to speed up grain growth, the amounts thereof and the addition concentrations thereof are increased are preferably used when manufacturing the tabular silver halide grains used in the present invention. Reference can be made, for example, to U.S. Pat. Nos. 1,335,925, 3,650,757, 3,672,900 and 4,242,445, JP-A-55-142329 and JP-A-55-158124 in connection with these methods.

The tabular silver halide grains of the present invention can be chemically sensitized as required. The methods described on pages 675 to 735 of *Die Grundlagen der Photographischen Prozesse mit Silberhalogeniden,* by H. Frieser, (published by Akademische Verlagsgesellschaft, 1968) can be used, for example, for chemical sensitization.

Specifically, sulfur sensitization methods in which active gelatin or compounds which contain sulfur which can react with silver (for example, thiosulfate, thioureas, mercapto compounds, rhodanines) are used, reduction sensitization methods in which reducing substances (for example, stannous salts, amines, hydrazine derivatives, formamidinesulfinic acid, silane compounds) are used, and noble metal sensitization methods in which noble metal compounds (for example, gold complex salts and complex salts of metals of group VIII of the Periodic Table such as Pt, Ir, Pd etc.) are used, for example, can be used either individually or in combination for this purpose.

Examples of the sulfur sensitization method are disclosed, for example, in U.S. Pat. Nos. 1,574,944, 2,278,947, 2,410,689, 2,728,668 and 3,656,955; examples of reduction sensitization methods are disclosed, for example, in U.S. Pat. Nos. 2,419,974, 2,983,609 and 4,054,458; and examples of noble metal sensitization are disclosed, for example, in U.S. Pat. Nos. 2,399,083 and 2,448,060, and in British Patent 618,061.

From the viewpoint of silver economy, the tabular silver halide grains of the present invention are preferably subjected to gold sensitization, sulfur sensitization or both gold sensitization and sulfur sensitization.

The tabular silver halide grains of the present invention can be spectrally sensitized using methine dyes or by other means, as required. Furthermore, the tabular silver halide grains of the present invention are characterized by having a high spectral speed, as well as having the improved sharpness mentioned earlier. The dyes which can be used include cyanine dyes, merocyanine dyes, complex cyanine dyes, complex merocyanine dyes, holopolar cyanine dyes, hemi-cyanine dyes, styryl dyes and hemi-oxonol dyes. Dyes classified as cyanine dyes, merocyanine dyes and complex merocyanine dyes are especially useful dyes.

Useful sensitizing dyes are disclosed, for example, in West German Patent 929,080, U.S. Pat. Nos. 2,493,748, 2,503,776, 2,519,001, 2,912,329, 3,656,959, 3,672,897 and 4,025,349, British Patent 1,242,588 and JP-B-44-14030. (The term "JP-B" as used herein signifies an "examined Japanese patent publication".)

These sensitizing dyes may be used individually, or they may be used in combinations. Such combinations of sensitizing dyes are often used with a view to achieving supersensitization. Typical examples are disclosed in U.S. Pat. Nos. 2,688,545, 2,977,229, 3,397,060, 3,522,052, 3,527,641, 3,617,293, 3,628,964, 3,666,480, 3,672,898, 3,679,728, 3,814,609 and 4,026,707, British Patent 1,344,281, JP-B-43-4936, JP-B-53-12375, JP-A-52-109925 and JP-A-52-110618.

Various compounds can be included in the photographic emulsions which are used in the present invention to prevent fogging during the manufacture, storage or photographic processing of the sensitive material or to stabilize photographic performance. That is to say, one can add many compounds which are known as anti-foggants and stabilizers, for example azoles such as benzothiazolium salts, nitroimidazoles, triazoles, benzotriazoles and benzimidazoles (especially nitro or halogen substituted benzimidazoles); heterocyclic mercapto compounds such as mercaptothiazoles, mercaptobenzothiazoles, mercaptobenzimidazoles, mercaptothiadiazoles, mercaptotetrazoles (especially 1-phenyl-5 -mercaptotetrazole) and mercaptopyrimidines; heterocyclic mercapto compounds as indicated above which have water solubilizing groups, for example, carboxyl groups or sulfo groups; thioketo compounds such as oxazolinethione for example; azaindenes, for example, triazaindenes and tetra-azaindenes (especially 4-hydroxy substituted (1,3,3a,7)-tetra-azaindenes); benzenethiosulfonic acids and benzenesulfinic acid. Reference can be made, for example, to U.S. Pat. Nos. 3,954,474, 3,982,947 and 4,021,248 or JP-B-52-28660 for more details of examples and methods of using these materials.

The aforementioned emulsions of the present invention are preferably mono-disperse emulsions.

A mono-disperse emulsion in the context of the present invention is an emulsion which has a grain size distribution such that the variation coefficient relating to the grain size of the silver halide grains is preferably not more than 0.25. Here, the variation coefficient is the value obtained by dividing the standard deviation of the grain size by the average diameter. That is to say, if the size of each individual grain is $r_i$ and the number of silver halide grains is $n_i$, the average grain size is defined by the following equation:

$$\bar{r} = \frac{\Sigma ni \cdot ri}{\Sigma ni}$$

Moreover, the standard deviation is defined by the following equation:

$$S = \sqrt{\frac{\Sigma(\bar{r} - ri)^2 \cdot ni}{\Sigma ni}}$$

The size of an individual grain in the present invention is the projected area corresponding diameter which corresponds to the projected area when the silver halide emulsion is subjected to micro-photography (usually electron microscope photography) using the methods well known in this field and described by T. H. James in *The Theory of the Photographic Process,* third edition, pages 36 to 43, (1966). Here, the projected corresponding diameter of a silver halide grain is defined as the diameter of a circle of which the area is equal to the projected area of the silver halide grain as indicated in the abovementioned textbook. Hence, the average grain size r and its standard deviation S as mentioned above can be obtained in cases where the form of the silver halide grains is other than spherical (for example, when the grains are cubic, octahedral, tetradecahedral, tabular or potato shaped).

The variation coefficient of the grain size of the silver halide grains is preferably not more than 0.25, but it is more preferably not more than 0.20, and most desirably it is not more than 0.15.

The mono-disperse hexagonal tabular silver halide emulsions disclosed in JP-A-63-151618 (corresponding to U.S. Pat. No. 4,797,354) are especially desirable as the tabular silver halide emulsions of the present invention.

Here, a hexagonal tabular silver halide grain is one in which the shape of its {1,1,1} plane is hexagonal, and it is characterized by the fact that the ratio of adjacent sides is not more than 2. Here, the ratio of adjacent sides is the ratio of the length of the longest side with respect to the length of the smallest side forming the hexagonal shape. With the hexagonal tabular silver halide grains of the present invention, the corners may be rounded in some degree provided that the ratio of adjacent sides is less than 2. The edge length in cases where the corners are rounded is represented by the distance between the points of intersection of the lines extending from the straight line parts of the adjoining sides with the extension of the straight line part of the side under consideration. Each side of the hexagonal shape of a hexagonal tabular grain of the present invention is preferably such that at least ½ of its length is an essentially straight line, and most desirably such that at least ⅘th of its length is an essentially straight line. A ratio of adjacent sides of from 1 to 1.5 is desirable in the present invention.

Hexagonal tabular silver halide emulsions of the present invention are comprised of a dispersion medium and silver halide grains. Preferably at least 50%, more preferably at least 70%, and most desirably at least 90% based on the total number of the grains, of the total projected area of the silver halide grains is accounted for by the abovementioned hexagonal tabular silver halide grains.

In the present invention, it is particularly preferred that at least 50% of the total number of the silver halide grains in the emulsion layer is comprised of hexagonal tabular grains which have two parallel planes as external surfaces and of which the ratio of the length of the longest side to the length of the shortest side is not more than 2.

In the present invention the halogen composition of the hexagonal tabular silver halide grains may be that of silver bromide, silver iodobromide, silver chlorobromide or silver chloroiodobromide, but it is preferably that of silver bromide or silver iodobromide. In the case of silver iodobromide, the silver iodide content is preferably from 0.2 to 30 mol %, more preferably from 2 to 15 mol %, and most desirably from 4 to 12 mol %. The distribution of silver iodide within the grains may be uniform throughout the whole grain, or the silver iodide content in the interior part and the surface layer of the grain may be different. Furthermore, the grain may have a so-called multilayer structure in which there are layers which have different silver iodide contents within the grain. But so-called internal iodine type grains in which the silver iodide content at the grain surface is less than that within the grain are preferred.

Reference can be made to U.S. Pat. No. 4,797,354 in connection with methods for the manufacture of hexagonal tabular silver halide emulsions.

The preparation of mono-disperse hexagonal tabular silver halide emulsions is divided into the processes of nuclei formation, Ostwald ripening and grain growth. During nuclei formation, the pBr value is maintained at 1.0 to 2.5, and nuclei formation is carried out under supersaturated conditions (temperature, gelatin concentration, addition rates of the aqueous silver salt solution and the aqueous alkali metal halide solution, the pBr value, the iodine ion content, the stirring rate, the pH, the silver halide solvent content and the salt concentration etc.) such that as many nuclei which have parallel twinned crystal planes (tabular gain nuclei) as possible are formed. During Ostwald ripening, the temperature, the pBr value, the pH value, the gelatin concentration and the amount of silver halide solvent, etc., are adjusted so that grains other than the tabular grains which have been formed during nuclei formation disappear, only the tabular nuclei grow, and nuclei which have good mono-dispersivity are obtained. Hexagonal tabular silver halide grains which have the prescribed aspect ratio and grain size can then be obtained by controlling the pBr value and the amounts of silver ion and halogen ion which are added during grain growth. The rate of addition of silver ion and halogen ion during grain growth is preferably set to from 30% to 100% of the crystal growth critical rate.

The emulsion of the present invention is preferably such that 50% of the number of silver halide grains contain at least 10 dislocation lines per grain.

The dislocations of the tabular grain can be observed with the direct method using a transmission type electron microscope at low temperature as described, for example, by J. F. Hamilton, *Phot. Sci. Eng.*, 11, 57 (1967) and by T. Shiozawa, *J. Soc. Phot. Sci.* Japan, 35, 213 (1972). That is to say, a silver halide grain which has been removed carefully from the emulsion in such a way that no pressure which would cause dislocations to arise in the grain is placed on the mesh for electron microscope observation purposes, and observations are made using the transmission method in a state where the sample has been cooled in such a way that damage (print-out etc.) due to the electron beam is prevented. When this is done, the transmission of the electron beam becomes more difficult as the grain thickness increases, and so more distinct observation is possible using a high voltage type electron microscope (200 kV for a grain of thickness 0.25 μm). The position and number of dislocation lines in each grain when viewed from a direction perpendicular to the principal plane obtained from photographs of grains which have been obtained by means of such a method can be used.

The position at which the dislocations in a tabular grain of the present invention are produced is from a distance x % of the distance from the center in the long-axis direction of the tabular grain to the edge. The value of x is preferably $10 \leqq x < 100$, preferably $30 \leqq x < 98$, and most desirably $50 \leqq x < 95$. When the shape which is formed on joining up the positions at which the dislocations start is approximately the same as the shape of the grain, but it is not exactly the same shape and is distorted. The direction of the dislocation lines is roughly from the center towards the edge, but they are frequently serpentine.

The number of dislocations in a tabular grain of the present invention is preferably such that grains which have at least 10 dislocation lines account for at least 50% of the number of grains. The number of grains which contain at least 10 dislocation lines is more preferably at least 80% of the grains, and it is especially desirable that at least 80% of the grains contain at least 20 dislocation lines. It is preferred that the number is as large as possible.

Moreover, with the silver halide grains of which at least 50% by number contain at least 10 dislocation lines per grain which are preferably used for the tabular silver halide grains of the present invention, the relative standard deviation of the silver iodide content of the individual silver halide grains is preferably not more than 30%, and most desirably not more than 20%.

The silver iodide contents of the individual emulsion grains can be measured by analyzing the composition grain by grain using an X-ray micro-analyzer for example. Here, the relative standard deviation of the silver iodide contents of the individual grains is the value obtained on measuring the silver iodide content of at least 100 emulsion grains using an X-ray micro-analyzer, for example, and then dividing the standard deviation of the silver iodide content by the average silver iodide content and multiplying the value so obtained by 100. Methods of measuring the silver iodide contents of individual grains in an emulsion are described, for example, in European Patent 147,868A.

If the relative standard deviation of the silver iodide content of the individual grains is large, the optimum point for chemical sensitization differs from grain to grain and it is impossible to realize the performance of all the grains. Furthermore, the relative standard deviation of the number of dislocation lines between the grains also tends to increase.

There are cases where there is a correlation between the silver iodide content Yi (mol %) of the individual grains and the diameter of the corresponding sphere Xi (microns) of each grain, and cases where there is no such correlation. The absence of such a correlation is desirable.

The structure in terms of the halogen composition of the tabular grains can be verified, for example, by X-ray diffraction, the EPMA methods (a method in which the silver halide grains are scanned with an electron beam and the halogen composition is detected, also known as the XMA method) or the ESCA method (a method conducting to form the spectrum of photoelectrons released from the grain surface on irradiation with X-rays, also known as the XPS method).

The term "grain surface" in the present invention relates to the region to a depth on the order of 50 angstroms from the surface. The halogen composition of such a region can usually be measured using the ESCA method. The "interior of the grain" is the region of the grain other than the surface region indicated above.

An emulsion consisting of tabular grains which have the dislocation lines aforementioned can be prepared by the methods disclosed in JP-A-63-220238 (corresponding to U.S. Pat. No. 4,806,461) and JP-A-4-181939 (corresponding to EP 485,946A). Furthermore, a silver halide emulsion of the present invention preferably has a narrow grain size distribution, and the method disclosed in JP-A-63-151618 (corresponding to U.S. Pat. No. 4,797,354) in which it is prepared via the steps of nuclei formation, Ostwald ripening and grain growth can be used desirably.

However, the silver iodide content of the individual grains in the emulsion is likely to become uneven unless rigorous control is applied.

In order to make the silver iodide contents of the individual grains in an emulsion uniform, it is necessary to make the size and shape of the grains after Ostwald ripening as uniform as possible. Moreover, at the growth stage it is desirable that the aqueous silver nitrate solution and the aqueous alkali halide solution be added using a double jet method while holding the pAg value constant in the range from 6.0 to 10.0. A higher degree of supersaturation of the solution during the addition is especially desirable for achieving a uniform covering. For example, in a method such as that disclosed in U.S. Pat. No. 4,242,445, the addition is made at a comparatively high degree of supersaturation in such a way that the growth rate of the crystals is 30 to 100% of the critical crystal growth rate, which is desirable.

The dislocations of the tabular grains of the present invention can be controlled by establishing a special internal high iodine phase in the grains. In practical terms, this is obtained by preparing substrate grains, then establishing a high iodine phase, and then covering the outside with a phase which has a lower iodine content than the high iodine phase. Here, it is important that the conditions for the formation of the abovementioned high iodine phase are selected appropriately in order to make the silver iodide contents of the individual grains uniform.

The "internal high iodine phase" is a silver halide solid solution which contains iodine. Silver iodide, silver iodobromide or silver chloroiodobromide is preferred for the silver halide in this case, but silver iodide or silver iodobromide (iodine content 10 to 40 mol %) is more desirable, and silver iodide is the most desirable.

It is important that the internal high iodine phase not be precipitated uniformly on the planes of the tabular grains of the substrate but should be present locally. Such a localization may occur on any portion of the tablets, such as principal planes, the side surfaces, the edges or the corners. Moreover, the high iodine phase may be coordinated selectively and epitaxially at such sites.

The epitaxial joining methods such as those disclosed, for example, in JP-A-59-133540 (corresponding to U.S. Pat. Nos. 4,463,087 and 4,471,050), JP-A-58-108526 (corresponding to U.S. Pat. Nos. 4,395,478 and 4,435,501) and JP-A-59-162540 (corresponding to U.S. Pat. No. 4,463,087 and 4,471,050), and a so-called conversion method, in which iodide is added independently, can be used as methods for this purpose. The selection of conditions such as those indicated below at this time is effective for making the silver iodide content of the individual grains uniform. That is to say, a pAg value at the time the iodide is added in the range 8.5 to 10.5 is desirable, and a value within the range 9.0 to 10.5 is especially desirable. The temperature is preferably maintained in the range of 50° C. to 30° C. The addition of the iodide is preferably carried out with the addition of at least 1 mol % with respect to the total amount of silver over a period of from 30 seconds to 5 minutes under conditions of adequate agitation.

The iodine content of the tabular grains which form the substrate is lower than that of the high iodine phase, and it is preferably 0 to 12 mol %, and most desirably 0 to 10 mol %.

The outer phase which-covers the high iodine phase has a lower iodine content than that of the high iodine phase. It is preferably 0 to 12 mol %, more desirably 0 to 10 mol %, and most desirably 0 to 3 mol %.

The internal high iodine phase is preferably present within a spherical region centered at the grain center which accounts for 5 mol % to 80 mol % in terms of the amount of silver in the whole grain from the grain center in terms of the long axis direction of the tabular grain. It is most desirably present in a spherical region which accounts for 10 mol % to 70 mol %, and most desirably 20 mol % to 60 mol %, in terms of the amount of silver in the whole grain from the grain center in terms of the long axis direction of the tabular grain.

Here, the long axis direction of the grain is the diameter direction of the grain, and the short axis direction is the direction of the thickness of the tabular grain.

The iodine content of the internal high iodide phase is higher than the average iodine content in the silver iodide, silver iodobromide or silver chloroiodobromide which is present at the grain surface. It is preferably at least 5 times, and most desirably at least 20 times, higher.

Moreover, the amount of silver halide which forms the internal high iodine phase is preferably not more than 50 mol %, more preferably not more than 10 mol %, and most desirably not more than 5 mol %, of the amount of the silver in the whole of the grain in terms of the amount of silver.

The nature of the silver halide grains can be controlled by the presence of various compounds during the silver halide precipitation formation process. Compounds of this type are copper, iridium, lead, bismuth, cadmium, zinc, chalcogen compounds (for example, sulfur, selenium, tellurium), gold and compounds of group VII noble metals, as disclosed in U.S. Pat. Nos. 2,448,060, 2,628,167, 3,737,313 and 3,772,031, and in *Research Disclosure,* volume 134, June 1975, number 13452. Such a compound may be present in the reactor initially or in accordance with conventional methods, at least one of these salts may be added to the reactor during the silver halide precipitation and formation process. The interior of the grains can be subjected to reduction sensitization during the precipitation formation process of silver halide emulsions as disclosed in JP-B-58-1410 and by Moisar et al. in *Journal of Photographic Science,* Volume 25, 1977, pages 19 to 27.

Silver halides of different compositions may be joined together by means of an epitaxial junction in the tabular grains which are used in the invention, or they can be joined with compounds other than silver halides such as silver thiocyanate or lead oxide for example. Such emulsified grains have been disclosed, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

The tabular silver halide emulsions of the present invention are generally subjected to chemical sensitization.

Chemical sensitization can be carried out after silver halide emulsion formation as described above, and the aforementioned emulsion may be washed with water after the formation of the silver halide emulsion and before chemical sensitization.

Chemical sensitization has been described in *Research Disclosure* No. 17643 (December 1978, page 23) and in *Research Disclosure* No. 18716 (November 1979, page 648, right hand column). It can be carried out at a pAg value of from 5 to 10, a pH value of from 5 to 8 and a temperature of from 30° C. to 80° C. using sulfur, selenium, tellurium, gold, platinum, palladium, iridium or a combination of these sensitizing agents.

Furthermore, the tabular silver halide emulsions of the present invention are preferably chemically sensitized in the presence of spectrally sensitizing dyes. Methods of chemical sensitization in the presence of spectrally sensitizing dyes have been disclosed, for example, in U.S. Pat. Nos. 4,425,426 and 4,442,201, JP-A-59-9658, JP-A-61-103149 and JP-A-61-133941. Any of the spectrally sensitizing dyes generally used in silver halide photographic photosensitive materials can be used for this purpose. These spectrally sensitizing dyes are described on pages 23 to 24 of *Research Disclosure* No. 17643 and from the right hand column on page 648 to the right hand column on page 649 of *Research Disclosure* No. 18716. A single type of spectrally sensitizing dye may be used, or a mixture of such dyes may be used.

The time of the addition of the spectrally sensitizing dyes may be at any time before the commencement of chemical sensitization (during grain formation, after the completion of grain formation or after washing with water), during chemical sensitization, or after the completion of chemical sensitization. But addition after the completion of grain formation and before the commencement of chemical sensitization or after the completion of chemical sensitization is preferred.

The amount of spectrally sensitizing dye added is optional, but from 30% to 100% of the amount on saturation absorption is preferred, and from 50% to 90% of the amount on saturation absorption is most desirable.

The tabular silver halide emulsions of the present invention are normally subjected to spectral sensitization. The spectrally sensitizing dyes described in the two *Research Disclosures* identified above are examples of spectrally sensitizing dyes which can be used. Emulsions in which spectrally sensitizing dyes are present at the time of chemical sensitization, as described above, may or may not have more of the same dye or a different type of dye added subsequently for spectral sensitization.

Emulsions of the present invention may be used individually in a photosensitive emulsion layer, or two or more emulsions which have different average grain sizes may be used conjointly. In a case where two or more types of emulsion are used, they may be used in different layers, but their use as a mixture in the same photosensitive layer is preferred. In a case where two or more types of emulsion are used, emulsions in which the average aspect ratio is not as specified in the present invention may be used.

In the emulsion layer which does not contain the compound represented by formula (Ia), the mixture ratio of an emulsion containing tabular silver halide grains having an aspect ratio of at least 2 and an emulsion which does not satisfy such a definition may be optionally determined according on the requirements on performances (such as sensitivity, gradation, and graininess of the photographic material). In such an emulsion the proportion of the tabular grains having an aspect ratio of at least 2 is preferably at least 10%, more preferably at least 30%, and most preferably at least 50% (the higher the better) based on the total number of silver halide grains in the same emulsion layer. The use of mixed emulsions, as indicated above, is preferred from the viewpoints of gradation control, control of graininess over the whole range from low exposure regions to high exposure regions, and control of color development dependence (dependence on time and the composition of the developer such as sodium sulfite salts and the color developing agent for example, and dependence on pH).

Furthermore, most desirably, the emulsions of the present invention are such that the relative standard deviation of the silver iodide content between grains is not more than 20%. Methods for preparation of such an emulsion are disclosed in JP-A-60-143332 and JP-A-60-254032 (corresponding to U.S. Pat. No. 4,728,602).

The use of compounds represented by formula (A) in the silver halide photosensitive material of the present invention is desirable from the viewpoint of improving photographic speed, and graininess:

$$Q—SM^1 \qquad (A)$$

In this formula, Q represents a heterocyclic group which has at least one group selected from among $—SO_3M^2$, $—COOM^2$, —OH and $—NR^1R^2$ bonded to heterocyclic group directly or indirectly, $M^1$ and $M^2$ each independently represents a hydrogen atom, an alkali metal atom, a quaternary ammonium or a quaternary phosphonium, and $R^1$ and $R^2$ independently represent hydrogen atoms or substituted or unsubstituted alkyl groups.

Examples of the heterocyclic group represented by Q in formula (A) include a 5- or 6-membered heterocyclic group containing at least one of N, O, S, and Se atoms as a hetero atom, such as an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring and a thiadiazine ring, and rings which are bonded with other carbocyclic or heterocyclic rings (for example, a benzothiazole ring, a benzotriazole ring, a benzimidazole ring, a benzoxazole ring, a benzoselenazole ring, a naphthoxazole ring, a triazaindolidine ring, a diazaindolidine ring and a tetra-azaindolidine ring).

Examples of an alkali metal atom include Li, Na and K. Examples of a quaternary ammonium and a quaternary phosphonium are represented by formulae (A-1) and (A-2), respectively.

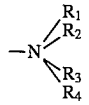
(A-1)

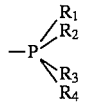
(A-2)

wherein $R_1$ to $R_4$ each represents a hydrogen atom, an alkyl group preferably having 1 to 20 carbon atoms, or an aryl group preferably having 6 to 20 carbon atoms.

The alkyl represented by $R^1$ or $R^2$ preferably has 1 to 20 carbon atoms.

Examples of substituents for the heterocyclic group represented by Q and the alkyl group represented by $R^1$ and $R^2$ include $—SO_3M^2$, $—COOM^2$, —OH and $—NR^1R^2$ (wherein $M^2$, $R^1$ and $R^2$ are defined as in formula (A)) and those which are recited hereinafter as examples of substituents of the alkyl and aryl groups in formula (B).

Those compounds which can be represented by general formula (B) or (C) are especially desirable from among the mercapto heterocyclic compounds represented by formula (A):

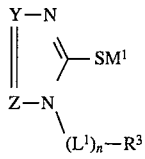
(B)

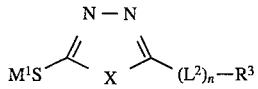
(C)

In formula (B), Y and Z each independently represents a nitrogen atom or $CR^4$ (where $R^4$ represents a hydrogen atom, a substituted or unsubstituted alkyl group, or a substituted or unsubstituted aryl group), $R^3$ represents an organic residual group which is substituted with at least one group selected from among $—SO_3M^2$, $—COOM^2$, —OH and $—NR^1R^2$. $M^1$, $M^2$, $R^1$ and $R^2$ have the same meanings as those defined in formula (A). Examples of the organic residual group include alkyl groups which have from 1 to 20 carbon atoms (for example, methyl, ethyl, propyl, hexyl, dodecyl, octadecyl) and aryl groups which have from 6 to 20 carbon atoms (for example, phenyl, naphthyl). $L^1$ represents a linking group selected from among —S—, —O—, —N—, —CO—, —SO— or $—SO_2—$, and n is 0 or 1.

In formula (B) the alkyl group preferably has 1 to 20 carbon atoms and the aryl group preferably has 6 to 20 carbon atoms, and they may be substituted with at least one substituent, such as halogen atoms (for example, F, Cl, Br), alkoxy groups (for example, methoxy, methoxyethoxy), aryloxy groups (for example, phenoxy), alkyl groups (when $R^3$ is an aryl group), aryl groups (when $R^3$ is an alkyl group), amido groups such as aliphatic and aromatic amido groups (for example, acetamido, benzoylamino), carbamoyl groups (for example, unsubstituted carbamoyl, phenylcarbamoyl, methylcarbamoyl), sulfonamido groups such as aliphatic and aromatic sulfonamido groups (for example, methanesulfonamido, phenylsulfonamido), sulfamoyl groups (for example, unsubstituted sulfamoyl, methylsulfamoyl, phenylsulfamoyl), sulfonyl groups such as alkyl- and aryl-sulfonyl groups (for example, methylsulfonyl, phenylsulfonyl), sulfinyl groups such as alkyl- and aryl-sulfinyl groups (for example, methylsulfinyl, phenylsulfinyl), the cyano group, alkoxycarbonyl groups (for example, methoxycarbonyl), aryloxycarbonyl groups (for example, phenoxycarbonyl), aliphatic- and aromatic-acyl groups (for example, acetyl, benzoyl), and a nitro group.

In those cases where there are two or more substituent groups $—SO_3M$, $—COOM^2$, —OH and $—NR^1R^2$ on $R^3$, these groups may be the same or different.

In formula (C), X represents a sulfur atom, an oxygen atom or $—N(R^5)—$, and $R^5$ represents a hydrogen atom, a substituted or unsubstituted alkyl group or a substituted or unsubstituted aryl group.

$L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, —$NR^6CONR^7$—, —$NR^6COO$—, —$OCONR^6$— or —$NR^6SO_2NR^7$—, and $R^6$ and $R^7$ each represents a hydrogen atom, a substituted or unsubstituted alkyl group, or a substituted or unsubstituted aryl group.

$R^3$ and $M^1$ has the same meaning as described in connection with formulae (B) and (A), respectively, and n represents 0 or 1.

The alkyl group and the aryl group represented by $R^4$, $R^5$, $R^6$ and $R^7$ preferably has 1 to 20 and 6 to 20 carbon atoms, respectively.

Moreover, the same substituent groups described above in connection with $R^3$ can be cited for the substituent groups of the alkyl groups and aryl groups represented by $R^4$, $R^5$, $R^6$ and $R^7$.

In formula (A), most desirably Q is a group substituted with —$SO_3M^2$ or —$COOM^2$.

Examples of preferred compounds which can be represented by formula (A) which can be used in this invention are indicated below:

(1)

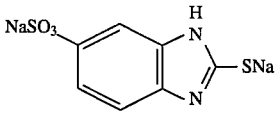

(2)

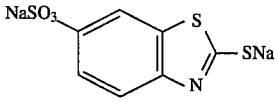

(3)

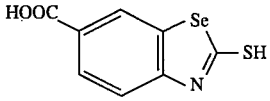

(4)

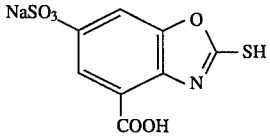

(5)

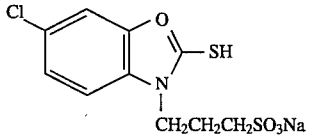

(6)

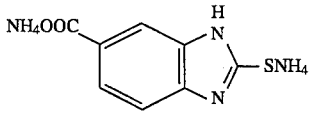

(7)

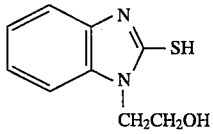

(8)

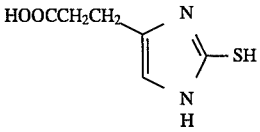

-continued (9)

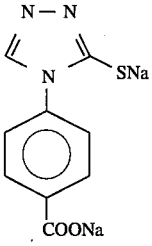

(10)

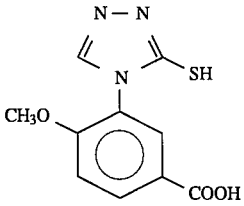

(11)

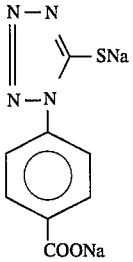

(12)

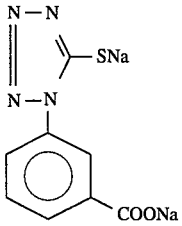

(13)

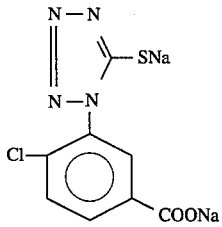

(14)

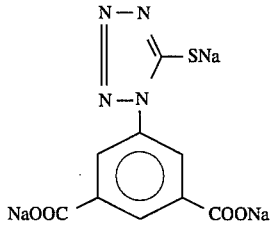

-continued
(15)
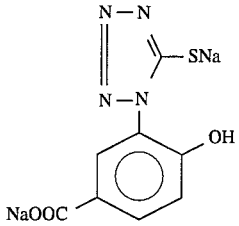
(16)
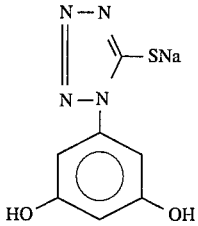
(17)
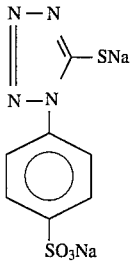
(18)
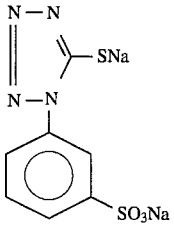
(19)
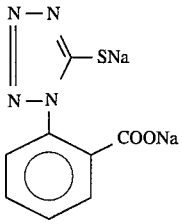
(20)
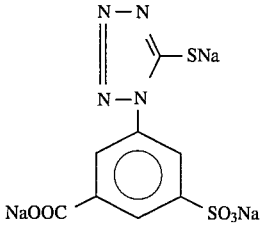
(21)
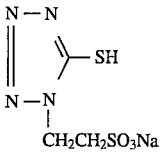
-continued
(22)
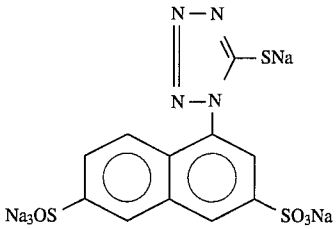
(23)
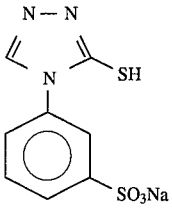
(24)
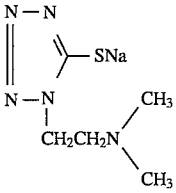
(25)
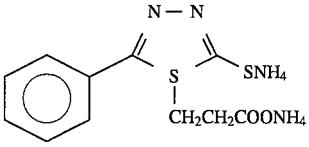
(26)
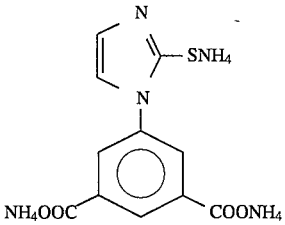
(27)
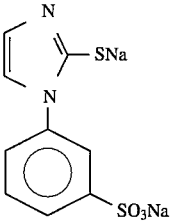
(28)
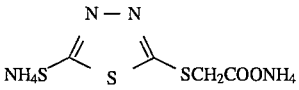
(29)
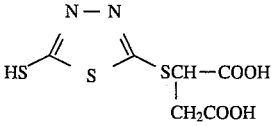
(30)
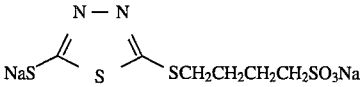
(31)
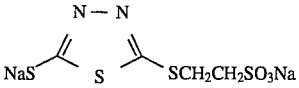

-continued (32)

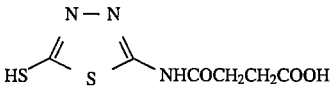

(33)

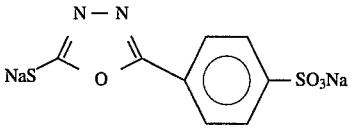

(34)

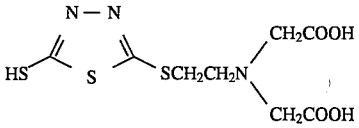

(35)

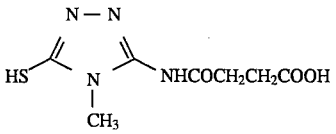

(36)

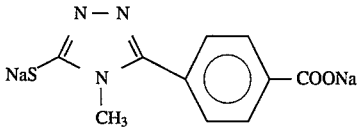

(37)

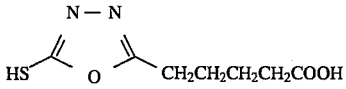

(38)

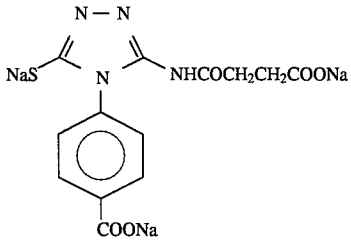

(39)

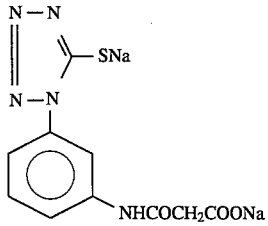

The compounds represented by formula (A) are known, and they can be prepared using the methods disclosed in the following literature referuces: U.S. Pat. Nos. 2,585,388 and 2,541,924, JP-B-42-21842, JP-A-53 -50169, British Patent 1,275,701, D. A. Berges et al., *Journal of the Heterocyclic Chemistry,* volume 15, page 981 et seq., (1978), *The Chemistry of Heterocyclic Compounds, Imidazole and Derivatives, Part I,* pages 336 to 339, *Chemical Abstract* 58, No. 7921 (1963), page 394, E. Hoggarth, *Journal of Chemical Society,* pages 1160 to 1167 (1949), S. R. Saudler and W. Karo, *Organic Functional Group Preparation,* Academic Press, pages 312 to 315 (1968), M. Chamdon et al., *Bulletin de la Societe Chemique de France,* 723 (1954), D. A. Shirley and D. W. Alley, *J. Am. Chem. Soc.,* 79, 4922 (1954), A. Wohl and W. Marchwald, *Berichte* (German Chemical Society Journal), volume 22, page 568 (1889), *J. Am. Chem. Soc.,* volume 44, 1502–1510, U.S. Pat. No. 3,017,270, British Patent 940,169, JP-B-49-8334, JP-A-55-59463, *Advances in Heterocyclic Compounds,* 9, 165–209 (1968), West German Patent 2,716,707, *The Chemistry of Heterocyclic Compound, Imidazole and Derivatives,* volume 1, page 384, *Organic Syntheses* IV, 569 (1963), *Berichte* 9, 465 (1976), *J. Am. Chem. Soc.,* 45, 2390 (1923), JP-A-50 -89034, JP-A-53-28426, JP-A-55-21007 and JP-A-40-28496.

The compounds represented by formula (A) are included in a silver halide emulsion layer or a non-photographic hydrophilic colloidal layer (for example, intermediate layer, surface protecting layer, yellow filter layer, anti-halation layer), but they are preferably included in a silver halide emulsion layer or in a layer adjacent thereto. The compounds are especially preferably included in at least one of the same layer wherein the cyan coupler represented by formula (Ia) is included and the layer adjacent thereto.

Furthermore, the amount added is preferably from $1\times10^{-7}$ to $1\times10^{-3}$ mol/m$^2$, more preferably from $5\times10^{-7}$ to $1\times10^{-4}$ mol/m$^2$, and most desirably from $1\times10^{-6}$ to $3\times10^{-5}$ mol/m$^2$.

The compound of formula (A) may be added into a silver halide emulsion or a hydrophilic colloid by dissolving it into an organic solvent compatible with an aqueous solution or water, such as methylalcohol, ethylalcohol, methyl ethyl ketone, and dimethylformamide, which does not adversely affect silver halide and additives contained in the layer to which the compound is introduced.

In the present invention, it is further preferable to use a bleach accelerator-releaging type compound.

As the compound releasing a bleach accelerator in the present invention, the compounds described in *Research Disclosure,* No. 11449, ibid., No. 24241, ibid., No 307105, JP-A-61-201247, etc., can be used but preferably the compounds described in European Patent No. 456,181A, page 92, line 31 et seq. can be used. Specific examples thereof are the compounds (1) to (74) described in European Patent No. 456,181A, pages 119 to 148. In particular, the use of the compounds (34), (60), (61), and (68) to (73) in the aforesaid patent publication is preferred.

The use of the compound releasing the bleach accelerator is particularly effective for shortening the time of the processing step having a bleaching faculty by using a silver halide emulsion containing the tabular silver halide grains having the foregoing aspect ratio of at least 2 in an amount of 50% by number of the total silver halide grains and further gives a stabilized processing showing less deviation of the photographic performace such as the sensitivity, the gradation, etc., in continuous processing (running processing) of a silver halide photographic material.

The using amount of the foreging compound releasing a bleach accelerator for a light-sensitive material can be in the range of from $1\times10^{-7}$ mol to $1\times10^{-1}$ mol, and preferably from $1\times10^{-6}$ mol to $5\times10^{-2}$ mol.

The compound releasing the bleach accelerator can be used in any layers of the light-sensitive material but is preferably used in the light-sensitive silver halide emulsion layers and insensitive layers (e.g., an antihalation layer, interlayers, a yellow filter layers, protective layers, etc.) adjacent to the silver halide emulsion layers.

The compound may be used dividing into two or more layers or a mixture of two or more these compounds may be used. In the latter case, two or more compounds may be used for each different layer.

The compound releasing the bleach accelerator can be introduced into the light-sensitive material by the same manner as that for an ordinary coupler described hereinafter.

A photosensitive material of the present invention should include, on a support, at least one of a blue sensitive silver halide emulsion layer, a green sensitive silver halide emulsion layer and a red sensitive silver halide emulsion layer. But no particular limitation is imposed upon the number or order of the silver halide emulsion layers and non-photosensitive layers. Typically, a silver halide photographic photosensitive material has, on a support, at least one photosensitive layer comprised of a plurality of silver halide emulsion layers which have essentially the same color sensitivity but different degrees of photosensitivity, the photosensitive layer being a unit photosensitive layer which is color sensitive to blue light, green light or red light. In a multi-layer silver halide color photographic material, the arrangement of the unit photosensitive layers generally involves their establishment in the order, from the support side, of a red sensitive layer, a green sensitive layer, and a blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers, may be established between the abovementioned silver halide photosensitive layers, and as uppermost and lowermost layers.

The intermediate layers may contain couplers and DIR compounds such as those disclosed in the specifications of JP-A-61-43748, JP-A-59-113438, JP-A-59-113440, JP-A-61-20037 and JP-A-61-20038, and they may also contain anticolor mixing agents such as those which are generally used.

The plurality of silver halide emulsion layers constituting each unit photosensitive layer is preferably a double layer structure comprised of a high speed emulsion layer and a low speed emulsion layer as disclosed in West German Patent 1,121,470 or British Patent 923,045. Generally, arrangements in which the degree of photosensitivity is lower in the layer closer to the support are preferred, and non-photosensitive layers may be established between each of the silver halide emulsion layers. Furthermore, the low speed layers may be arranged on the side furthest from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in JP-A-56-25738 and JP-A-62-63936.

Furthermore, there are arrangements in which there are three layers which have different speeds with the degree of photosensitivity falling towards the support with the silver halide emulsion layer of the highest photosensitivity at the top, a silver halide emulsion layer which has a lower photosensitivity than the aforementioned layer as an intermediate layer, and a silver halide emulsion layer which has an even lower photosensitivity than the intermediate layer as a bottom layer, as disclosed in JP-B-49-15495. In the case of structures of this type which have three layers with different degrees of photosensitivity, the layers in a layer of the same color sensitivity may be arranged in the order, from the side furthest from the support, of intermediate speed emulsion layer/high speed emulsion layer/low speed emulsion layer, as disclosed in JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer for example. Furthermore, the arrangements may also be varied in the ways indicated above when there are four or more layers.

Arrangements in which a donor layer (CL) for a interlayer effect in which the spectral sensitivity distribution is different from that of the principal photosensitive layers such as the BL, GL, RL for example is established adjacent to, or in the proximity of, the principal photosensitive layers, as disclosed in U.S. Pat. Nos. 4,663,271, 4,705,744 and 4,707,436, JP-A-62-160448 and JP-A-63-89850, are desirable.

The various layer structures and arrangements, as described above, can be selected respectively according to the intended purpose of the photosensitive material.

The preferred silver halide emulsion for inclusion in the photographic emulsion layers other than the aforementioned photosensitive silver halide emulsion layers of a photographic photosensitive material of the present invention are described below.

The preferred silver halide are silver iodobromides, silver iodochlorides or silver iodochlorobromides, which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine at less than about 0.2 microns, or large with a projected area diameter of up to about 10 μm, and the emulsions may be poly-disperse emulsions or monodisperse emulsions.

Silver halide photographic emulsions which can be used in the present invention can be prepared, for example, using the methods disclosed in *Research Disclosure* (RD) No. 17643 (December, 1978), pages 22 to 23, "I. Emulsion Preparation and Types", and in *Research Disclosure* No. 18716 (November 1979), page 648 and *Research Disclosure,* No. 307105 (November 1989), pages 863 to 865, and the methods described by P. Glafkides in *Chimie et Physique Photographique,* published by Paul Montel, 1967, by G. F. Duffin in *Photographic Emulsion Chemistry,* published by Focal Press, 1966, and by V. L. Zelikman et al. in *Making and Coating Photographic Emulsions,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains of a type such that the aspect ratio is at least about 3 can also be used in the present invention. Tabular grains can be prepared easily using the methods described, for example, by Gutoff in *Photographic Science and Engineering,* Volume 14, pages 248 to 257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure. Moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The abovementioned emulsions may be of the surface latent image type in which the latent image is formed principally on the surface, the internal latent image type in which the latent image is formed within the grains, or of a type in which the latent image is formed both at the surface and within the grains, but a negative type emulsion is essential. From among the internal latent image types the emulsion may be a core/shell internal latent image type emulsion as disclosed in JP-A-63-264740. A method for the preparation of a core/shell internal latent image type emulsion has been disclosed in JP-A-59-133542. The thickness of the shell of the emulsion differs according to the development processing for example, but it is preferably from 3 to 40 nm, and most desirably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution, halogen composition, grain form or photographic speed of the photosensitive silver halide emulsion can be used in the form of a mixture in the same layer in a photosensitive material of the present invention.

The use of silver halide grains of which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver, is desirable in the photosensitive silver halide emulsion layers and/or essentially non-photosensitive hydrophilic colloid layers. Silver halide grains of which the grain interior or surface has been fogged are silver halide grains which can be developed uniformly (not in the form of the image) irrespective of whether they are in an unexposed part or an exposed part of the photosensitive material. Methods for the preparation of silver halide grains of which the interior or surface has been fogged have been disclosed in U.S. Pat. No. 4,626,498 and JP-A-59-214852.

The silver halide which forms the internal nuclei of core/shell type silver halide grains of which the grain interior has been fogged may have the same halogen composition or a different halogen composition. The silver halide of which the grain interior or surface has been fogged may be silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains. They may be regular grains, and they may be poly-disperse emulsions, but mono-disperse emulsions (in which at least 95% in terms of the weight or number of silver halide grains have a grain size within ±40% of the average grain size) are preferred.

The use of non-photosensitive fine grained silver halides is desirable in the present invention. Non-photosensitive fine grained silver halides are fine grained silver halides which are not photosensitive at the time of the imagewise exposure for obtaining a dye image and which undergo essentially no development during development processing, and those which have not been pre-fogged are preferred.

The fine grained silver halide has a silver bromide content from 0 to 100 mol % and may contain silver chloride and/or silver iodide as required. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as commonly used for the preparation of photosensitive silver halides. In this case, the surface of the silver halide grains does not need to be chemically sensitized, and neither is there any need for spectral sensitization. However, the pre-addition of known stabilizers such as triazole, azaindene, benzothiazolium or mercapto compounds or zinc compounds, for example, before addition of grains to the coating liquid is desirable. Colloidal silver can also be included desirably in the layer which contains these fine grained silver halide grains.

The coated weight of silver in a photosensitive material of the present invention is preferably not more than 6.0 g/m$^2$, and most desirably not more than 4.5 g/m$^2$.

Known photographically useful additives which can be used in the present invention have also been disclosed in the three *Research Disclosures* referred to above, and the locations of these disclosures are also indicated in the table below.

| Type of Additive | RD17643 | RD18716 | RD307105 |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column–page 649 right hand column | Pages 866–868 |
| 4. Whitening Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet | Pages 25–26 | Page 649, right hand column–page 650, left hand column | Page 873 |

-continued

| Type of Additive | RD17643 | RD18716 | RD307105 |
|---|---|---|---|
| absorbers | | | |
| 7. Anti-staining Agents | Page 25, right hand column | Page 650, left hand column–right hand column | Page 872 |
| 8. Dye Image Stabilizers | Page 25 | Page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors Surfactants | Pages 26–27 | Page 650, right hand column | Pages 875–876 |
| 13. Anti-static agents | Page 27 | Page 650, right hand column | Pages 876–877 |
| 14. Matting Agents | | | Pages 878–879 |

Furthermore, the addition to the photosensitive material of the compounds which can react with and fix formaldehyde disclosed in U.S. Pat. Nos. 4,411,987 and 4,435,503 is desirable for preventing deterioration of photographic performance due to formaldehyde gas.

The inclusion of the mercapto compounds disclosed in U.S. Pat. Nos. 4,740,454 and 4,788,132, JP-A-62 -18539 and JP-A-1-283551 is desirable in a photosensitive material of the present invention.

The inclusion of compounds which release fogging agents, development accelerators, silver halide solvents or precursors of these materials irrespective of the amount of developed silver produced by development processing disclosed in JP-A-1-106052 is desirable in a photosensitive material of the present invention.

The inclusion of the dyes dispersed using the methods disclosed in International Patent Laid Open WO88/04794 and Published PCT Application 1-502912 (in Japan), or the dyes disclosed in EP 317,308A, U.S. Pat. No. 4,420,555 and JP-A-1-259358, is desirable in a photosensitive material of the present invention.

Various color couplers can be used in the present invention, and examples are disclosed in the patents cited in the aforementioned *Research Disclosure* No. 17643, sections VII-C to G, and *Research Disclosure* No. 307105, sections VII-C to G.

Those disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred as yellow couplers.

5-Pyrazolone compounds and pyrazoloazole compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO88/04795 are especially desirable.

Phenol and naphthol couplers can be cited as cyan couplers which can be used conjointly with the couplers represented by formula (Ia) of the present invention, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole couplers disclosed in JP-A-64-553, JP-A-64-554, JP-A-64-555 and JP-A-64-556, and the imidazole couplers disclosed in U.S. Pat. No. 4,818,672, can also be used.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers from which the colored dyes have a suitable degree of diffusibility are formed.

The colored couplers for correcting the unwanted absorptions of color forming dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of color forming dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120, is also desirable.

The use of compounds which release photographically useful residual groups on coupling is also desirable in the present invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are desirable.

The couplers disclosed in British Patents 2,097,140 and 2,131,188, JP-A-59-157638 and JP-A-59-170840 are preferred as couplers which release a nucleating agent or development accelerator in the form of the image during development. Furthermore, the compounds which release fogging agents, development accelerators, silver halide solvents and the like via a redox reaction with the oxidized product of a developing agent as disclosed in JP-A-60-107029, JP-A-60-252340, JP-A-1-44940 and JP-A-1-45687 are also desirable.

Other compounds which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patents 173,302A and 313,308A, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using a variety of known methods.

Examples of high boiling point solvents which can be used in the oil in water dispersion method have been disclosed, for example, in U.S. Pat. No. 2,322,027. Examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)sebacate, dioctyl azelate, glycerol tributyrate, isostearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point above about 30° C., and preferably of at least 50° C., but below about 160° C., can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and examples of latexes for loading purposes have been disclosed, for example, in U.S. Pat. No. 4,199,363, and in West German Patent Applications (OLS) 2,541,274 and 2,541,230.

The addition to the color photosensitive materials of the present invention of various fungicides and biocides such as phenethyl alcohol and 1,2-benzisothiazolin- 3-one, n-butyl p-hydroxybenzoate, phenol, 4-chloro-3,5-dimethylphenol, 2-phenoxyethanol and 2-(4-thiazolyl)benzimidazole for example as disclosed in JP-A- 63-257747, JP-A-62-272248 and JP-A-1-80941 is desirable.

The present invention can be applied to a variety of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105.

The photosensitive materials of the present invention are such that the total film thickness of all the hydrophilic colloid layers on the side where the emulsion layers are located is preferably not more than 28 μm, more desirably not more than 23 μm, even more desirably not more than 18 μm, and most desirably not more than 16 μm. Furthermore, the film swelling rate $T_{1/2}$ is preferably not more than 30 seconds, and most desirably not more than 20 seconds. Here, the film thickness is measured under conditions of 25° C. 55% relative humidity (2 days), and the film swelling rate $T_{1/2}$ is measured using the methods well known to those in this field. For example, measurements can be made using a swellometer of the type described by A. Green in *Photogr. Sci. Eng.*, Volume 19, Number 2, pages 124 to 129, and $T_{1/2}$ is defined as the time taken to reach half the saturated film thickness, taking 90% of the maximum swelled film thickness reached on processing the material for 3 minutes 15 seconds in a color developer at 30° C. as the saturated film thickness.

The film swelling rate $T_{1/2}$ can be adjusted by adding film hardening agents for the gelatin which is used as a binder, or by changing the ageing conditions after coating. Furthermore, a swelling factor of from 150% to 400% is preferred. The swelling factor can be calculated from the maximum swelled film thickness obtained under the conditions described above using the formula: (maximum swelled film thickness minus film thickness)/film thickness.

The establishment of a hydrophilic colloid layer (known as a backing layer) of a total dry film thickness from 2 μm to 20 μm on the opposite side from the emulsion layers is desirable in a photosensitive material of the present invention. The inclusion of light absorbing agents, filter dyes, ultraviolet absorbers, anti-static agents, film hardening agents, binders, plasticizers, lubricants, coating promotors and surfactants, for example, as described before, in this backing layer is desirable. The swelling factor of the backing layer is preferably from 150% to 500%.

Color photographic photosensitive materials which are in accordance with the present invention can be developed and processed using the general methods disclosed on pages 28 to 29 of the aforementioned *Research Disclosure* No. 17643, from the left hand column to the right hand column of page 651 of the aforementioned *Research Disclosure* No. 18716, and on pages 880 to 881 of the aforementioned *Research Disclosure* No. 307105.

The color developers used for the development processing of photosensitive materials of the present invention are preferably aqueous alkaline solutions which contain a primary aromatic amine color developing agent as the principal component. Aminophenol compounds are also useful, but the use of p-phenylenediamine compounds as color developing agents is preferred. Typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N, N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxy-pentyl)aniline, 4-amino-3-propyl-N-(4-hydroxybutyl)aniline, and the sulfate, hydrochloride and p-toluenesulfonate salts of these compounds. From among these, 3-methyl-4-amino-N-ethyl-N-β-hydroxyethylaniline, 4-amino-3-methyl-N-ethyl-N-(3-hydroxy-propyl)aniline, 4-amino-3-methyl-N-ethyl-N-(4-hydroxy-butyl)aniline and their hydrochloride, p-toluenesulfonate or sulfate salts are preferred. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. It may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone and aminophenols such as N-methyl-p-aminophenol, for example, can be used individually, or in combination, in the black and white developer. The pH of these color developers and black and white developers is generally from 9 to 12. Furthermore, the replenishment rate for these developers depends on the color photographic photosensitive material which is being processed. But in general, it is not more than 3 liters per square meter of photosensitive material, and it can be set to not more than 500 ml by reducing the bromide ion concentration in the replenisher. In those cases where the replenishment rate is reduced, it is desirable that evaporation and aerial oxidation of the liquid be prevented by minimizing the area of contact with the air in the processing tank.

The contact area between the air and the photographic processing liquid in a processing tank can be represented by the open factor which is defined below:

$$\text{Open Factor}=[\text{Processing Solution and Air Contact Area (cm}^2)]\div[\text{Processing Solution Volume (cm}^3)]$$

The above-mentioned open factor is preferably not more than 0.1, and most desirably from 0.001 to 0.05. In addition to the establishment of a shielding material such as a floating lid for example on the surface of the photographic processing liquid in the processing tank, the method involving the use of a movable lid as disclosed in JP-A-1-82033 and the method involving slit development processing as disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes for example. Furthermore, the replenishment rate can also be reduced by using some means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, according to the intended purpose. Compounds of multi-valent metals, such as iron(III) for example, peracids, quinones and nitro compounds can be used as bleaching agents. Typical bleaching agents include organic complex salts of iron(III), for example complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid, malic acid and the like. From among these materials, the use of aminopolycarboxylic acid iron(III) complex salts, and principally of ethylenediamine tetra-acetic acid iron(III) complex salts and 1,3-diaminopropane tetra-acetic acid iron(III) salts, is preferred for both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix pre-baths. Examples of useful bleach accelerators have been disclosed in the following specifications: compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and Research Disclosure No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the compounds disclosed in JP-A-49-40943, JP-A-

49-59644, JP-A-53-94927, JP-A-54-35727, JP-A-55-26506 and JP-A-58-163940; and a bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53 -95630 are especially desirable. Moreover, the compounds disclosed in U.S. Pat. No. 4,552,834 are also desirable. These bleaching accelerators may be added to the sensitive material. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acid. In practice, acetic acid, propionic acid, hydroxyacetic acid, and the like are preferred.

Thiosulfate, thiocyanate, thioether based compounds, thioureas and large amounts of iodide can be used, for example, as the fixing agent which is used in a fixing bath or bleach-fixing bath. But thiosulfate is generally used, and ammonium thiosulfate in particular can be used in the widest range of applications. Furthermore, the conjoint use of thiosulfate and thiocyanate, thioether compounds, thiourea, etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts of from 0.1 to 10 mol/liter, to the fixing bath or bleach-fixing bath is desirable in the present invention in order to control pH.

A short total de-silvering processing time within the range where de-silvering failure does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is improved, and the occurrence of staining after processing is effectively prevented within the preferred temperature range.

Agitation as strong as possible during the de-silvering process is desirable. Examples of methods of strong agitation include the methods in which a jet of processing liquid is made to impinge on the emulsion surface of the photosensitive material as disclosed in JP-A-62-183460, the method in which the agitation effect is increased using a rotary device as disclosed in JP-A-62-183451, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of the present invention preferably have photosensitive material transporting devices as disclosed in JP-A-60-191257, JP-A-60-191258 or JP-A-60-191259. With such a transporting device, such as that disclosed in the aforementioned JP-A-60 -191257, the carry-over of processing liquid from one bath to the next is greatly reduced. This is very effective for preventing deterioration in processing bath performance. These effects are especially effective for shortening the processing time in each process and for reducing the replenishment rate of each process.

The silver halide color photographic photosensitive materials of the invention are generally subjected to a water washing process and/or stabilizing process after the de-silvering process. The amount of wash water used in the washing process can be fixed within a wide range, depending on the application and the nature (depending on the materials such as couplers which have been used for example) and application of the photosensitive material, the wash water temperature, the number of water washing tanks (the number of water washing stages), and the replenishment system, i.e. whether a counter flow or a sequential flow system is used, and various other conditions. The relationship between the amount of water used and the number of washing tanks in a multi-stage counter-flow system can be obtained using the method outlined on pages 248 to 253 of the *Journal of the Society of Motion Picture and Television Engineers,* Volume 64 (May 1955). The amount of wash water used can be greatly reduced by using the multi-stage counter-flow system noted in the aforementioned literature, but bacteria proliferate due to the increased residence time of the water in the tanks and problems arise with the suspended matter which is produced becoming attached to the photosensitive material. The method in which the calcium ion and magnesium ion concentrations are reduced, disclosed in JP-A-62-288838, is very effective as a means of overcoming this problem when processing color photosensitive materials of this present invention. Furthermore, the isothiazolone compounds and thiabendazoles disclosed in JP-A-57-8542, the chlorine-containing disinfectants such as chlorinated sodium isocyanurate, and benzotriazole, for example, and the disinfectants disclosed in *The Chemistry of Biocides and Fungicides* by H. Horiguchi, (1986, Sankyo Shuppan), in *Killing Micro-organisms, Biocidal and Fungicidal Techniques* (1982) edited by the Health and Hygiene Technology Society and published by the Industrial Technology Society, and in *A Dictionary of Biocides and Fungicides* (1986) edited by the Japanese Biocide and Fungicide Society, can also be used in this connection.

The pH value of the washing water when processing photosensitive materials of the present invention is from 4 to 9, and preferably from 5 to 8. The washing water temperature and the washing time can be set variously in accordance with the nature and application of the photosensitive material. But in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of the invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process. The stabilizing baths which contain dye stabilizing agents and surfactants which are used as final baths with camera color photosensitive materials are examples of such a process. Aldehydes such as formaldehyde and glutaraldehyde, N-methylol compounds, hexamethylenetetramine and aldehyde/bisulfite addition compounds can be used, for example, as dye stabilizing agents. Various chelating agents and fungicides can also be added to these stabilizing baths.

The overflow which accompanies replenishment of the abovementioned water washing or stabilizing baths can be reused in other processes, such as the de-silvering process for example.

Concentration correction with the addition of water is desirable in cases where the abovementioned processing baths become concentrated due to evaporation when processing in an automatic processor for example.

Color developing agents can be incorporated into a silver halide color photosensitive material of the present invention with a view to simplifying and speeding up processing. The incorporation of various color developing agent precursors is preferred. For example, the indoaniline compounds disclosed in U.S. Pat. No. 3,342,597, the Shiff's type compounds disclosed in U.S. Pat. No. 3,342,599, *Research Disclosure* No. 14850 and *Research Disclosure* No. 15159, the aldol compounds disclosed in *Research Disclosure* No. 13924, the metal salt complexes disclosed in U.S. Pat. No. 3,719,492 and the urethane compounds disclosed in JP-A-53-135628 can be used for this purpose.

Various 1-phenyl-3-pyrazolidones may be incorporated, as required, into a silver halide color photosensitive material of this present invention with a view accelerating color development. Typical compounds are disclosed, for example, in JP-A-56-64339, JP-A-57-144547 and JP-A-58-115438.

The various processing baths in the present invention are used at a temperature of from 10° C. to 50° C. The standard temperature is generally from 33° C. to 38° C., but accelerated processing and shorter processing times can be realized at higher temperatures while, on the other hand, increased image quality and better processing bath stability can be achieved at lower temperatures.

The effects are more readily realized in cases where a silver halide color photographic photosensitive material of the present invention is used in a lens-fitted film unit as disclosed in, for example, JP-B-2-32615 and JP-B-U-3-39784. (The term "JP-B-U" as used herein signifies an "examined Japanese utility model publication".)

The invention is described in more detail below by means of illustrative examples, but the invention is not limited by these examples.

EXAMPLE 1

An aqueous solution obtained by dissolving 30 grams of inert gelatin and 6 grams of potassium bromide in 1 liter of distilled water was stirred at 75° C. After adding 35 ml of an aqueous solution in which 5.0 grams of silver nitrate had been dissolved and 35 ml of an aqueous solution in which 3.2 grams of potassium bromide and 0.98 gram of potassium iodide had been dissolved, over a period of 30 seconds at flow rates of 70 ml/min, a seed emulsion was obtained by raising the pAg value to 10 and ripening for 30 minutes.

Next, the prescribed amount out of 1 liter of an aqueous solution in which 145 grams of silver nitrate had been dissolved and an equimolar amount of an aqueous solution in which potassium bromide and potassium iodide had been dissolved were added at a rate close to the critical growth rate at the prescribed temperature and the prescribed pAg value, and tabular core emulsions were obtained. Moreover, the remainder of the aqueous silver nitrate solution and an equimolar amount of an aqueous solution of potassium bromide and potassium iodide which had a different composition to that used when preparing the core emulsion were added at a rate close to the critical growth rate, the cores were covered and core/shell type silver iodobromide tabular Emulsions 1 to 5 were obtained.

Control of the aspect ratio was achieved by selecting the pAg value during the preparation of the core and the shell. The results obtained are shown in Table 1.

TABLE 1

| Emulsion | Average Aspect Ratio(1) | Average Aspect Ratio(2) | Average Grain Diameter (μm) | Average Grain Thickness (μm) | Average Iodine Content (μm) | Grains of Invention(3) (%) |
|---|---|---|---|---|---|---|
| 1 | 1.5 | 1.2 | 0.93 | 0.72 | 7.6 | 21.3 |
| 2 | 2.8 | 2.2 | 1.01 | 0.55 | 7.6 | 55.2 |
| 3 | 4.6 | 3.6 | 1.63 | 0.36 | 7.6 | 83.9 |
| 4 | 6.7 | 5.2 | 1.74 | 0.30 | 7.6 | 99.6 |
| 5 | 11.7 | 9.8 | 2.10 | 0.21 | 7.6 | 99.6 |

(1)The aspect ratio of each of 1000 individual emulsion grains was measured, 50% of grains based on the total number of grains were selected from the grains having larger aspect ratio and the average value for the aspect value for the aspect ratio of these grains was taken.
(2)The aspect ratio of each of 1000 individual emulsion grains was measured, 85% of grains based on the total number of grains were selected from the grains having larger aspect ratio and the average value for the aspect value for the aspect ratio of these grains was taken.
(3)The ratio of the number of silver halide grains having an aspect ratio of at least 2 in 1,000 individual silver halide grains.

The samples indicated below were prepared using the abovementioned Emulsions 1 to 5.

Sample No. 101, a multi-layer color photosensitive material, was prepared by lamination coating of each of the layers the compositions of which are indicated below on a cellulose triacetate film support on which an under-layer had been established.

Composition of the Photosensitive Layer

The principal materials used in each layer can be classified as follows:

ExC: Cyan coupler UV: Ultraviolet absorber

ExM: Magenta coupler ExY: Yellow coupler

HBS: High boiling point organic solvent

H: Gelatin hardening agent ExS: Sensitizing dye

The numerical value corresponding to each component indicates the coated weight in units of g/m$^2$, the coated weight being shown as the calculated weight of silver in the case of the silver halides. However, with the sensitizing dyes the coated weight is indicated in units of mol per mole of silver halide in the same layer.

Sample No. 101

| | | |
|---|---|---|
| **First Layer (Anti-halation Layer)** | | |
| Black colloidal silver | as silver | 0.18 |
| Gelatin | | 1.40 |
| ExM-1 | | 0.18 |
| ExF-1 | | $2.0 \times 10^{-3}$ |
| HBS-1 | | 0.20 |
| **Second Layer (Intermediate Layer)** | | |
| Emulsion G | as silver | 0.065 |
| 2,5-Di-tert-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| **Third Layer (Low Speed Red Sensitive Emulsion Layer)** | | |
| Emulsion A | as silver | 0.25 |
| Emulsion B | as silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| Comparative Coupler (A) | | 0.25 |
| ExC-4 | | 0.020 |
| ExC-6 | | 0.0050 |
| ExC-7 | | 0.010 |
| Cpd-2 | | 0.025 |
| HBS-1 | | 0.10 |
| HBS-5 | | 0.15 |
| Gelatin | | 0.87 |
| **Fourth Layer (Intermediate Speed Red Sensitive Emulsion Layer** | | |
| Emulsion D | as silver | 0.35 |
| Emulsion E | | 0.35 |
| ExS-1 | | $3.5 \times 10^{-4}$ |
| ExS-2 | | $1.6 \times 10^{-5}$ |
| ExS-3 | | $5.1 \times 10^{-4}$ |
| Comparative Coupler (A) | | 0.19 |
| ExC-2 | | 0.060 |
| ExC-4 | | 0.025 |
| ExC-6 | | 0.0010 |
| ExC-7 | | 0.0070 |
| Cpd-2 | | 0.023 |
| Cpd-5 | | 0.10 |
| HBS-1 | | 0.10 |
| HBS-4 | | 0.050 |
| Gelatin | | 0.75 |
| **Fifth Layer (High Speed Red Sensitive Emulsion Layer)** | | |
| Emulsion 1 | as silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| Comparative Coupler (A) | | 0.13 |
| ExC-3 | | 0.010 |
| ExC-5 | | 0.020 |
| ExC-7 | | 0.025 |
| Cpd-2 | | 0.050 |
| Illustrative Compound (18) of formula (A) | | $1.3 \times 10^{-5}$ mol |
| HBS-1 | | 0.12 |
| HBS-2 | | 0.050 |
| Cpd-4 | | 0.15 |
| Gelatin | | 1.20 |
| **Sixth Layer (Intermediate Layer)** | | |
| Cpd-1 | | 0.10 |

-continued

Sample No. 101

| | | |
|---|---|---|
| HBS-1 | | 0.50 |
| Gelatin | | 1.10 |
| **Seventh Layer (Low Speed Green Sensitive Emulsion Layer** | | |
| Emulsion C | as silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| **Eighth Layer (Intermediate Speed Green Sensitive Emulsion Layer)** | | |
| Emulsion D | as silver | 0.40 |
| Emulsion E | | 0.40 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| Cpd-6 | | 0.090 |
| HBS-1 | | 0.080 |
| HBS-4 | | 0.080 |
| HBS-3 | | $8.0 \times 10^{-3}$ |
| Gelatin | | 0.90 |
| **Ninth Layer (High Speed Green Sensitive Emulsion Layer** | | |
| Emulsion 1 | as silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| Illustrative Compound (32) of formula (A) | | $1.2 \times 10^{-5}$ mol |
| HBS-1 | | 0.25 |
| HBS-4 | | 0.10 |
| Cpd-5 | | 0.05 |
| Gelatin | | 1.44 |
| **Tenth Layer (Yellow Filter Layer)** | | |
| Yellow colloidal silver | as silver | 0.030 |
| Cpd-1 | | 0.16 |
| HBS-1 | | 0.60 |
| Gelatin | | 0.60 |
| **Eleventh Layer (Low Speed Blue Sensitive Emulsion Layer)** | | |
| Emulsion C | as silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| Cpd-5 | | 0.30 |
| HBS-1 | | 0.28 |
| Gelatin | | 1.50 |
| **Twelfth Layer (Intermediate Speed Blue Sensitive Emulsion Layer)** | | |
| Emulsion D | as silver | 0.40 |
| ExS-7 | | $7.4 \times 10^{-4}$ |
| ExC-6 | | $7.0 \times 10^{-3}$ |
| ExY-2 | | 0.050 |
| ExY-3 | | 0.10 |
| HBS-1 | | 0.050 |
| Gelatin | | 0.78 |

-continued

| Sample No. 101 | |
|---|---|
| Thirteenth Layer (High Speed Blue Sensitive Emulsion Layer) | |
| Emulsion F | as silver 1.00 |
| ExS-7 | $4.0 \times 10^{-4}$ |
| ExY-2 | 0.10 |
| ExY-3 | 0.10 |
| Illustrative Compound (37) of formula (A) | $1.4 \times 10^{-5}$ mol |
| HBS-1 | 0.050 |
| Cpd-6 | 0.15 |
| Gelatin | 0.86 |
| Fourteenth Layer (First Protective Layer) | |
| Emulsion G | as silver 0.20 |
| UV-4 | 0.11 |
| UV-5 | 0.17 |
| HBS-1 | $5.0 \times 10^{-2}$ |
| Gelatin | 1.00 |
| Fifteenth Layer (Second Protective Layer) | |
| H-1 | 0.44 |
| B-1 (Diameter about 1.7 μm) | $5.0 \times 10^{-2}$ |
| B-2 (Diameter about 1.7 μm) | 0.10 |
| B-3 | 0.10 |
| S-1 | 0.20 |
| Gelatin | 1.20 |

Furthermore, W-1 to W-3, B-4 to B-6, F-1 to F-17, and iron salts, lead salts, gold salts, platinum salts, iridium salts and rhodium salts were included in each layer with a view to improving storage properties, processing properties, pressure resisting properties, fungicidal and biocidal properties, anti-static properties and coating properties.

TABLE 2

| Emulsion | Average AgI Content (%) | Average Grain Diameter (μm) | Variation Coefficient of the Grain Diameter (%) | Diameter/ Thickness Ratio | Silver Content Ratio [Core/Intermediate Layer/ Shell] (AgI Content) | Grain Structure |
|---|---|---|---|---|---|---|
| A | 4.0 | 0.45 | 25 | 1 | [1/3] (13/1) | Double Structure Grains |
| B | 8.9 | 0.70 | 14 | 1 | [3/7] (25/2) | Double Structure Grains |
| C | 2.0 | 0.55 | 20 | 1.5 | — | Uniform Structure Grains |
| D | 9.0 | 0.70 | 23 | 1.5 | [12/59/29] (0/11/8) | Triple Structure Grains |
| E | 9.0 | 0.85 | 23 | 1 | [8/59/33] (0/11/8) | Triple Structure Grains |
| F | 14.5 | 1.00 | 25 | 1 | [37/63] (34/3) | Double Structure Grains |
| G | 1.0 | 0.07 | 15 | 1 | — | Uniform Structure Fine Grains |

In Table 2:

(1) Emulsions A to F were subjected to reduction sensitization during grain formation using urea dioxide and thiosulfonic acid as in the Examples in JP-A- 2-191938 (corresponding to U.S. Pat. No. 5,061,614).

(2) Emulsions A to F were subjected to gold sensitization, sulfur sensitization and selenium sensitization in the presence of sodium thiocyanate and the spectrally sensitizing dyes disclosed for each photosensitive layer as in the Examples in JP-A-3-237450 (corresponding to EP 443,453A).

ExC-1
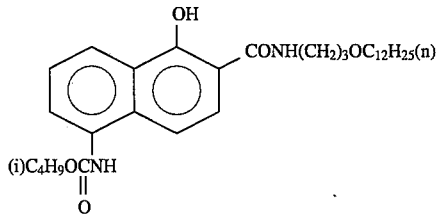
ExC-2
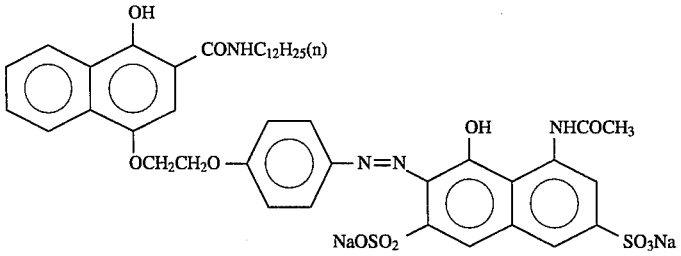
ExC-3
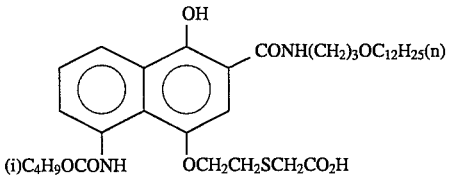
ExC-4
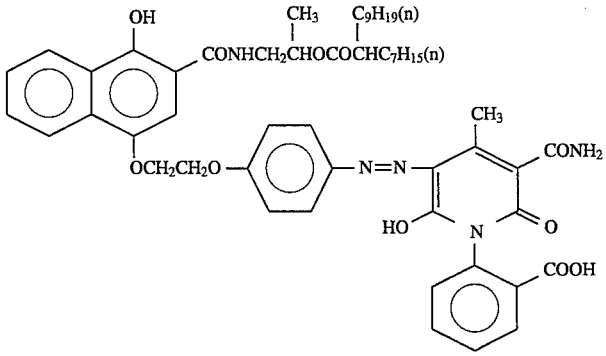
ExC-5
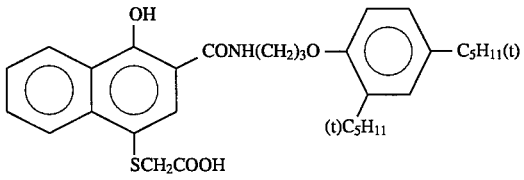
ExC-6
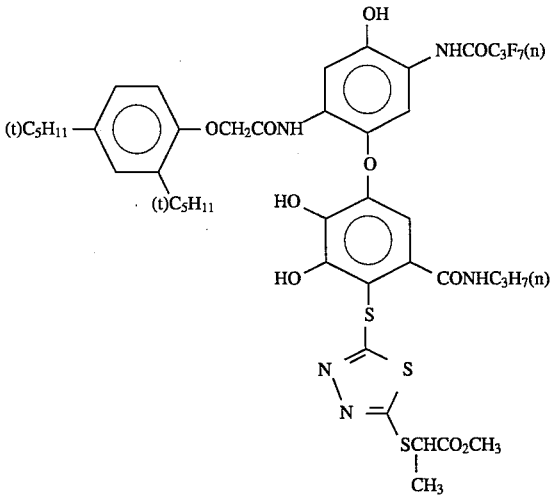

-continued
ExC-7
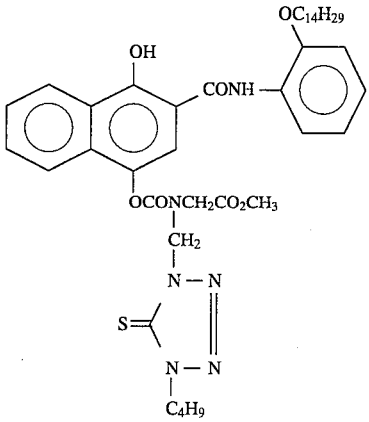
Comparative Coupler (A)
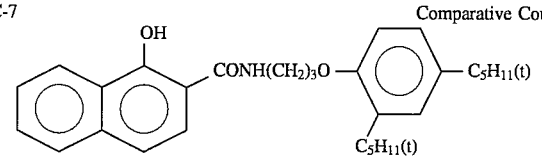
ExM-1
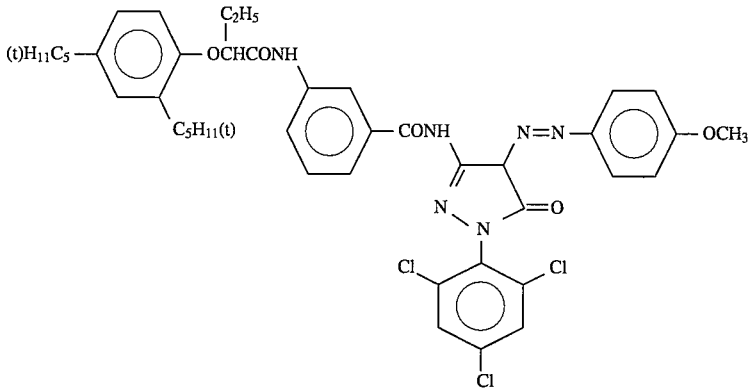
ExM-2
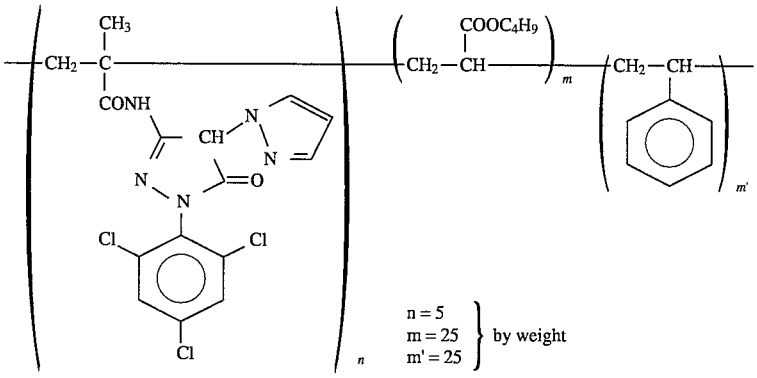
n = 5
m = 25 } by weight
m' = 25
Mol. Wt. about 20,000
ExM-3
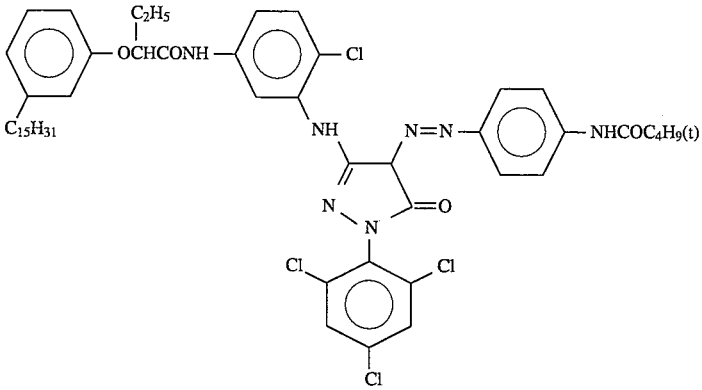

-continued
ExM-4
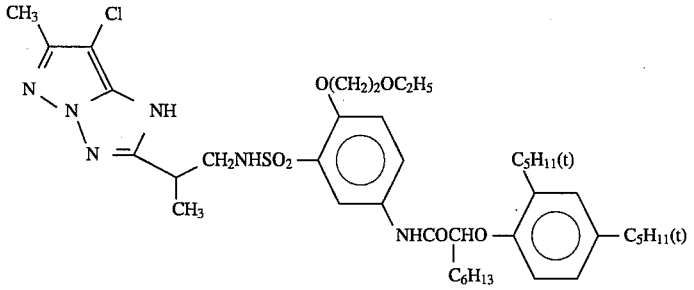
ExM-5
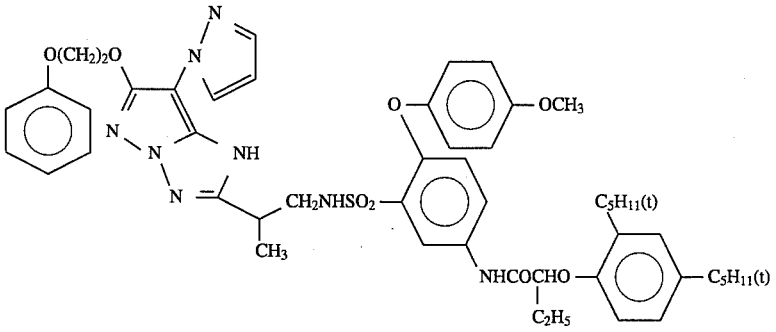
ExY-1
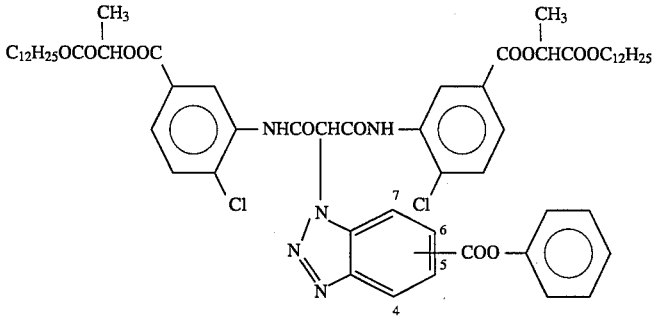
(a mixture of 5- or 6-substituted compound)
ExY-2
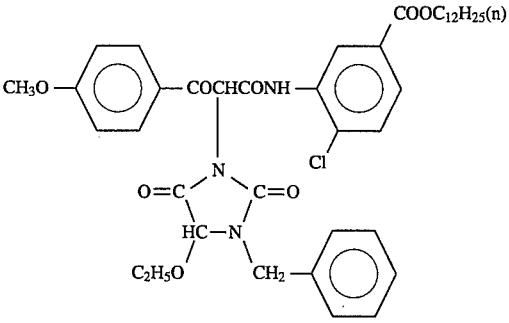
ExY-3
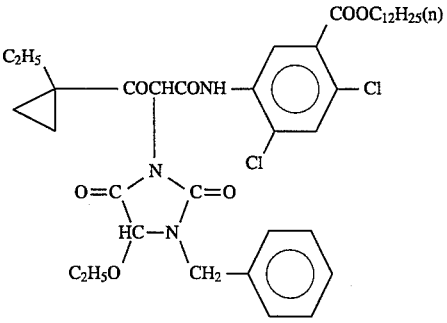
ExY-4
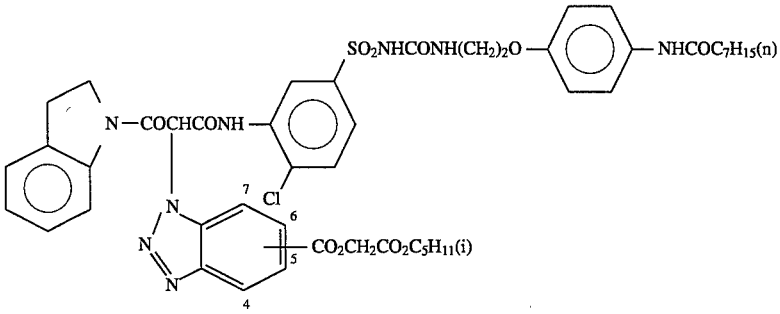
(a mixture of 5- or 6- substituted compound)

-continued
ExF-1
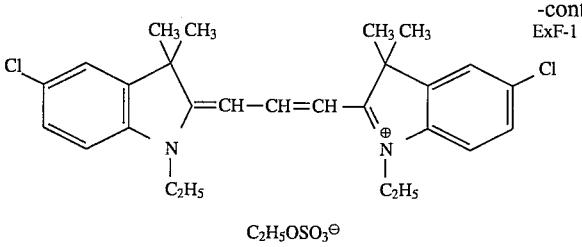
Cpd-1
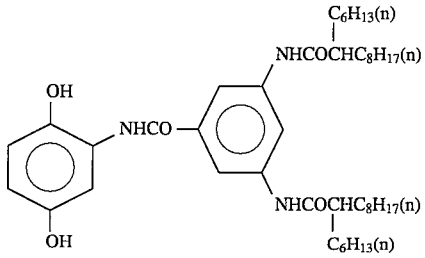
Cpd-2
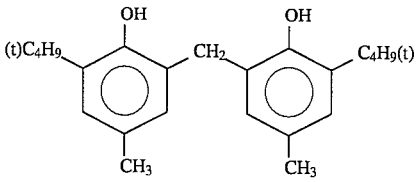
Cpd-3
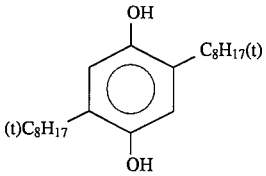
Cetyl alcohol Cpd-4
Oleyl alcohol Cpd-5
10-Phenyldecane-1-ol Cpd-6
UV-1
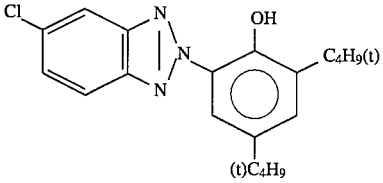
UV-2
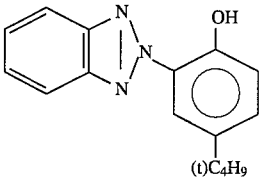
UV-3
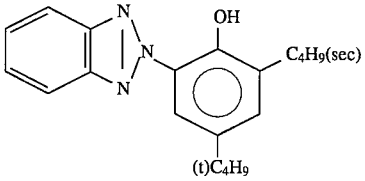
UV-4
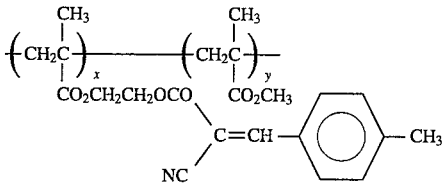
x:y = 70:30 (wt %)
Mean Molecular Weight: Ca 40,000
UV-5
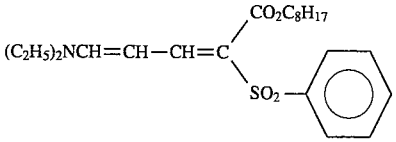
Tricresyl phosphate HBS-1
Di-n-butyl phthalate HBS-2
HBS-3
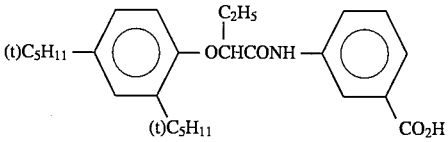
Triisononyl phosphate HBS-4
Di-2-ethylhexyl phosphate HBS-5
ExS-1
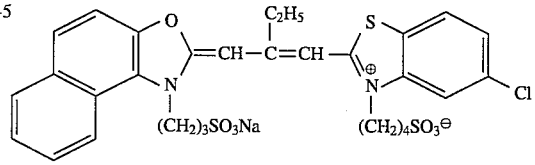
ExS-2
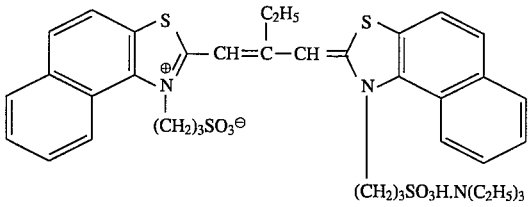
ExS-3
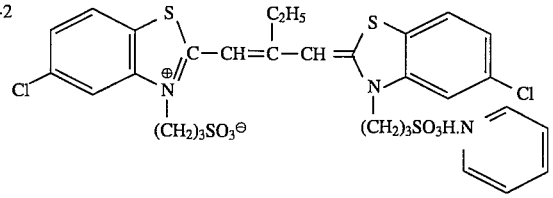

-continued
ExS-4
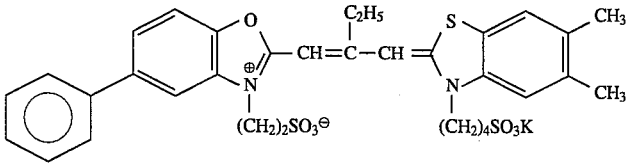
ExS-5
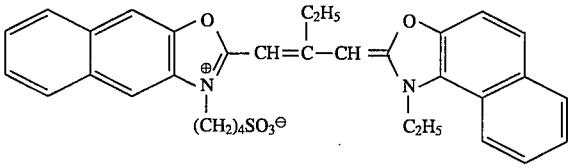
ExS-6
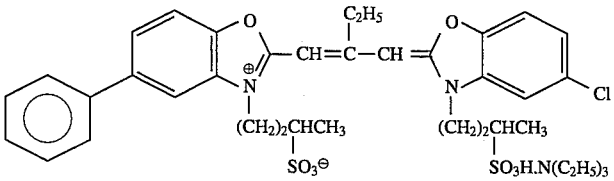
ExS-7
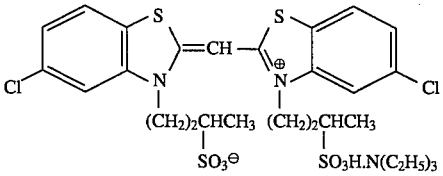
S-1
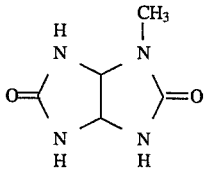
H-1
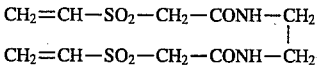
B-1
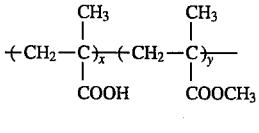
x/y = 10/90 (molar ratio) Mean Molecular Weight: Ca 42,000
B-2
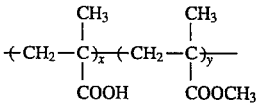
x/y = 40/60 (molar ratio) Mean Molecular Weight: Ca 55,000
B-3
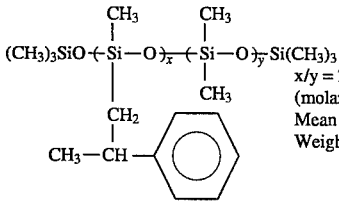
x/y = 29/46 (molar ratio) Mean Molecular Weight: Ca 1,000,000
B-4
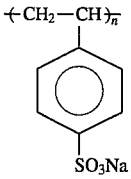
Mean Molecular Weight: Ca 750,000
B-5
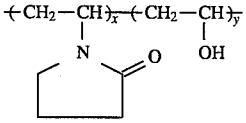
x/y = 70/30 (molar ratio) Mean Molecular Weight: Ca 14,000
B-6
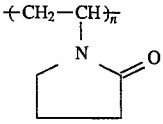
Mean Molecular Weight: Ca 10,000
W-1
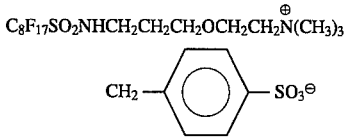
W-2
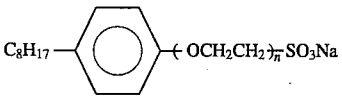
(a mixture of n = 2 to 4)
W-3
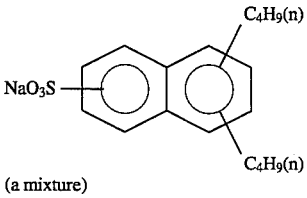
(a mixture)

-continued
F-1
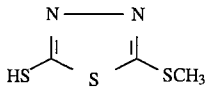
F-2
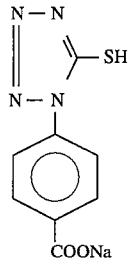
F-3
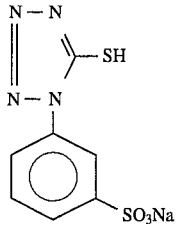
F-4
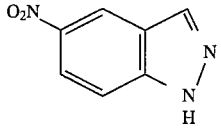
F-5
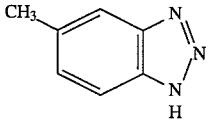
F-6
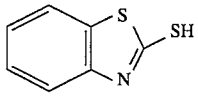
F-7
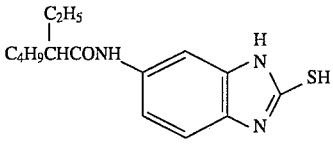
F-8
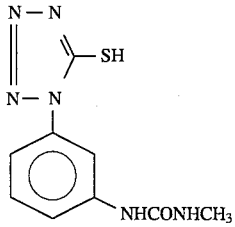
F-9
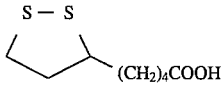
F-10
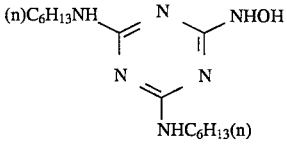
F-11
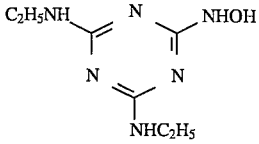
F-12
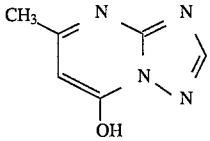
F-13
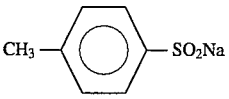
F-14
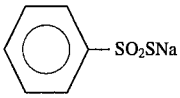
F-15
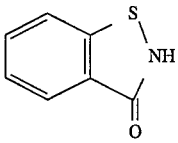
F-16
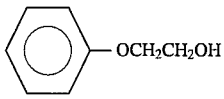
F-17
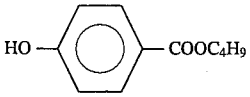

Next, the samples indicated below were prepared.

Preparation of Sample No. 102

Sample No. 102 was prepared by replacing Comparative Coupler (A) used in the red sensitive emulsion layers, the third to fifth layers, in Sample No. 101 with an equimolar amount of Comparative Coupler (B).

Preparation of Sample Nos. 103 and 104

These were prepared similarly by replacing Comparative Coupler (A) used in the red sensitive emulsion layers, the third to fifth layers, in Sample No. 1 with equimolar amounts of Cyan Coupler Nos. 9 and 36 of the present invention respectively.

Preparation of Sample Nos. 105 to 108

These samples were prepared by replacing with Emulsion 4 the Emulsion 1 which had been used in the fifth layer (red sensitive emulsion layer) and the ninth layer (green sensitive emulsion layer) of Sample Nos. 101 to 104 which had been prepared already, in such a way that the coated weight of silver remained the same.

Preparation of Sample Nos. 109 to 117

Sample Nos. 109 to 111 were prepared by replacing with Emulsion 2 the Emulsion 1 which had been used in the fifth layer (red sensitive emulsion layer) and the ninth layer (green sensitive emulsion layer) of Sample Nos. 101, 103 and 104, while in Sample Nos. 112 to 114 Emulsion 1 was replaced by Emulsion 3 and in Sample Nos. 115 to 117 Emulsion 1 was replaced by Emulsion 5.

Preparation of Sample No. 118

Sample No. 118 was prepared by eliminating completely Compounds 18, 32 and 37 represent by formula (A) of the present invention from the fifth layer (red sensitive emulsion layer), the ninth layer (green sensitive emulsion layer) and the thirteenth layer (blue sensitive emulsion layer).

Sample Nos. 101 to 118 which had been prepared were subjected to color development processing as described below and then the performance in respect of the following items was investigated. The comparative coupler (B) is indicated below.

Comparative Coupler (B) (Coupler Example (7) disclosed in European Patent 456,226A):

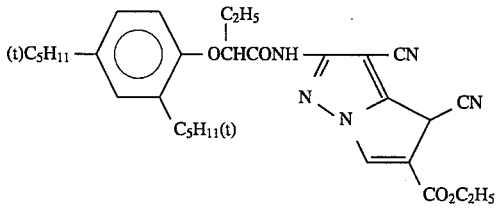

(1) Photographic Properties

The cyan density of each sample was obtained by giving a graded White light exposure (color temperature of the light source: 4800° K.) and development processing was measured, the logarithm of the reciprocal of the exposure which provided a density of minimum density+0.2 was obtained from the characteristic curve and, taking Sample No. 101 as a standard, the difference from the standard was obtained. This is shown as $\Delta S_1$.

Furthermore, the density at the point which had been given an exposure of logE=1.5 on the high exposure side from the point which had been given the exposure which provided a density of minimum density+0.2 was read off, the value obtained by subtracting the minimum density from this density was taken, and using Sample No. 101 as a standard, the density ratio ($D_1$ %) was calculated.

(2) Colored Image Fastness

The cyan density of a sample which had been subjected to graded exposure using white light and developed was measured and then the sample was stored for 30 days under conditions of 60° C. 70% relative humidity. After this had been completed the density was measured once again. The density after the completion of the test at a cyan density of minimum density+1.5 before the test was read-off from the characteristic curve and the result was obtained as the colored image survival rate ($D_2$ %).

(3) Color Impurity

The red and green densities of the cyan image of a sample which had been subjected to a graded exposure through a red filter and developed, was measured and characteristic curves were obtained. The G density at the point of minimum density+1.5 on measuring the R density was read-off, and a value was obtained by subtracting the G density of the minimum density part. The difference was calculated, taking Sample No. 101 as a standard, and this was taken as $\Delta D_G$. This value is the color impurity and it provides a measure for the evaluation of color reproduction. The numerical value is such that as the negative value increases, the absorption in the green light region of the cyan colored image becomes smaller and the color impurity becomes smaller. This shows that the color reproduction is good.

(4) Sharpness

Samples were prepared by adjusting the amounts of sensitizing dye which were added and the amounts of each component in the coating liquid in such a way that the gradation of each of Sample Nos. 101 to 118 which had been prepared already was almost the same.

These samples were exposed with an MTF pattern using white light and then they were developed, after which the MTF values (25 cycles/mm) of the cyan images were measured.

(5) Processing Stability

The bleaching solution used in color development processing was brought into contact with steel wool so that the divalent iron ion concentration in the bleaching solution became 5% of the total iron ion concentration, Samples which had been subjected to a graded exposure to white light were processed with no modification other than the fact that this bleaching solution was used. The cyan density was measured immediately after processing. After the density had been measured, the samples were immersed for 5 minutes (38° C.) in a 5% aqueous red prussiate of potash solution, and then they were washed with water for 3 minutes (24° C.) and the cyan densities of the samples so obtained were measured again. The density of the sample before treatment with red prussiate at the exposure which gave a density of minimum density+ 1.0 on the characteristic curve so obtained was read off, the density difference was obtained, and this is given as $\Delta D_3$.

The results obtained are shown in Table 3. Furthermore, the color development processing operations used for investigating performance as described above and the compositions of the processing baths are indicated below.

TABLE 3

| Sample No. | Coupler Used in the Third to Fifth Layers | Emulsion Used in the Fifth and Ninth Layers | Photographic Properties $\Delta S_1$ | Photographic Properties $D_1$ % | Colored Image Fastness ($D_2$ %) | Color Impurity ($\Delta D_G$) | Sharpness [25 Cycles/mm] | Processing Stability ($\Delta D_3$) |
|---|---|---|---|---|---|---|---|---|
| 101 (Comparative Example) | Comparative Coupler (A) | 1 | 0.00 Standard | 100 Standard | 85 | 0.00 Standard | 0.65 | −0.29 |
| 102 (Comparative Example) | Comparative Coupler (B) | " | −0.05 | 114 | 90 | −0.02 | 0.67 | −0.08 |
| 103 (Comparative Example) | 9 | " | +0.04 | 120 | 92 | −0.04 | 0.68 | −0.04 |
| 104 (Comparative Example) | 36 | " | +0.03 | 118 | 92 | −0.04 | 0.68 | −0.05 |
| 105 (Comparative Example) | Comparative Coupler (A) | 4 | +0.03 | 101 | 85 | −0.02 | 0.68 | −0.29 |
| 106 (Comparative Example) | Comparative Coupler (B) | " | −0.01 | 115 | 90 | −0.04 | 0.70 | −0.08 |
| 107 (This Invention) | 9 | " | +0.11 | 122 | 93 | −0.07 | 0.74 | −0.02 |
| 108 (This Invention) | 36 | " | +0.09 | 120 | 93 | −0.07 | 0.74 | −0.03 |
| 109 (Comparative Example) | Comparative Coupler (A) | 2 | 0.00 | 100 | 85 | −0.01 | 0.67 | −0.29 |
| 110 (This Invention) | 9 | " | +0.06 | 121 | 92 | −0.06 | 0.71 | −0.03 |
| 111 (This Invention) | 36 | 2 | +0.05 | 119 | 92 | −0.06 | 0.71 | −0.04 |
| 112 (Comparative Example) | Comparative Coupler (A) | 3 | +0.02 | 100 | 85 | −0.01 | 0.67 | −0.29 |
| 113 (This Invention) | 9 | " | +0.09 | 122 | 93 | −0.07 | 0.72 | −0.03 |
| 114 (This Invention) | 36 | " | +0.07 | 120 | 93 | −0.07 | 0.72 | −0.04 |
| 115 (Comparative Example) | Comparative Coupler (A) | 5 | +0.04 | 101 | 85 | −0.02 | 0.68 | −0.29 |
| 116 (This Invention) | 9 | " | +0.12 | 122 | 93 | −0.07 | 0.74 | −0.02 |
| 117 (This Invention) | 36 | " | +0.10 | 120 | 93 | −0.07 | 0.74 | −0.03 |
| 118 (This Invention) | 9 | 4 | +0.12 | 122 | 93 | −0.07 | 0.71 | −0.04 |

*Sample No. 118 was a sample in which Compounds 18, 32 and 37 represented by formula (A) had been excluded from the fifth, ninth and thirteenth layers of Sample No. 107. In the table, the "ditto" marks signify "same as above", this is the same in all succeeding tables.

| Processing Procedure | | |
|---|---|---|
| Process | Processing Time | Processing Temperature |
| Color Development | 3 min. 15 sec. | 38° C. |
| Bleach | 3 min. 00 sec. | 38° C. |
| Water Wash | 30 sec. | 24° C. |
| Fix | 3 min. 00 sec. | 38° C. |
| Water Wash (1) | 30 sec. | 24° C. |
| Water Wash (2) | 30 sec. | 24° C. |
| Stabilization | 30 sec. | 38° C. |
| Drying | 4 min. 20 sec. | 55° C. |

The compositions of the processing baths are indicated below.

| | (Units: Grams) |
|---|---|
| Color Developer | |
| Diethylenetriamine penta-acetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-β-hydroxyethylamino]-2-methylaniline sulfate | 4.5 |
| Water to make | 1.0 liter |
| pH | 10.05 |
| Bleaching Solution | |
| Ethylenediamine tetra-acetic acid | 100.0 |

-continued

| | (Units: Grams) |
|---|---|
| ferric sodium salt tri-hydrate | |
| Ethylenediamine tetra-acetic acid di-sodium salt | 10.0 |
| 3-Mercapto-1,2,4-triazole | 0.08 |
| Ammonium bromide | 140.0 |
| Ammonium nitrate | 30.0 |
| Aqueous ammonia (27%) | 6.5 ml |
| Water to make | 1.0 liter |
| pH | 6.0 |
| Fixer | |
| Ethylenediamine tetra-acetic acid di-sodium salt | 0.5 |
| Ammonium sulfite | 20.0 |
| Aqueous ammonium thiosulfate solution, (700 g/liter) | 290.0 ml |
| Water to make | 1.0 liter |
| pH | 6.7 |
| Stabilizer | |
| Sodium p-toluenesulfinate | 0.03 |
| Polyoxyethylene-p-mono-nonylphenyl ether (average degree of polymerization 10) | 0.2 |
| Ethylenediamine tetra-acetic acid disodium salt | 0.05 |
| 1,2,4-triazole | 1.3 |
| 1,4-Bis(1,2,4-triazol-1-ylmethyl)-pyperazine | 0.75 |
| Water to make | 1.0 liter |
| pH | 8.5 |

It is clear from Table 3 that, in comparison with the comparative samples, it is possible to further increase the high speed and high color forming density of the cyan couplers of the present invention, and to obtain excellent colored image fastness, to obtain better color reproduction and sharpness, and to obtain stable color forming density on processing using a bleaching solution having reduced oxidizing capacity, by using a cyan coupler represented by formula (Ia) of the present invention and by using a silver halide emulsion which contains tabular grains of which the aspect ratio is at least 2.

Moreover, cyan couplers represented by formula (Ia) and silver halide emulsions having tabular grains of an aspect ratio at least 2 are used in the present invention, but it is clear on comparing Sample No. 107 and Sample No. 118 that the conjoint use of a mercapto compound represented by formula (A) is desirable.

EXAMPLE 2

Sample Nos. 201 to 226 were prepared on the basis of Sample No. 103 and Sample No. 107 which were prepared in Example 1 by replacing the cyan coupler of the present invention used in the third to fifth layers with an equimolar amount of cyan coupler 9 of the present invention as shown in Table 4.

The samples which had been prepared were subjected to color development processing as indicated below, together with Sample Nos. 101 and 105 prepared in Example 1. The photographic properties, the colored image fastness, color impurity and sharpness were investigated in the same way as described in Example 1.

Moreover, in order to investigate performance, samples which had been subjected to an imagewise exposure were processed in a running test, and the processing was continued until replenishment of the color developer reached twice the tank capacity.

Processing was carried out in the way indicated below using an FP-560B automatic processor made by the Fuji Photo Film Co., Ltd.

The processing operations and compositions of the processing baths are indicated below.

| Processing Operations | | | | |
|---|---|---|---|---|
| Process | Processing Time | Processing Temperature | Replenishment Rate* | Tank Capacity |
| Color Development | 3 min. 5 sec. | 38.0° C. | 600 ml | 17 liters |
| Bleach | 50 sec. | 38.0° C. | 140 ml | 5 liters |
| Bleach-fix | 50 sec. | 38.0° C. | — | 5 liters |
| Fix | 50 sec. | 38.0° C. | 420 ml | 5 liters |
| Water Wash | 30 sec. | 38.0° C. | 980 ml | 3.5 liters |
| Stabilize (1) | 20 sec. | 38.0° C. | — | 3 liters |
| Stabilize (2) | 20 sec. | 38.0° C. | 560 ml | 3 liters |
| Drying | 1 min. 30 sec. | 60.0° C. | | |

*The replenishment rate is the amount per square meter of photosensitive material.

The stabilizer was used in a counter-flow system from (2) to (1) and all of the overflow from the water wash was introduced into the fixer tank. Replenishment of the bleach-fix bath was accomplished by establishing cut-outs in the top part of the bleach tank and in the top part of the fixer tank of the automatic processor and introducing all of the liquid overflow produced as a result of supplying replenisher to the bleach tank and the fixer tank into the bleach-fix bath. Moreover, the carry-over of the developer into the bleach process was 65 ml per square meter of the photosensitive material, the carry-over of the bleaching solution into the bleach-fix process was 50 ml per square meter of the photosensitive material, the carry-over of the bleach-fixer into the fixing process was 50 ml per square meter of the photosensitive material, and the carry-over of fixer into the water washing process was 50 ml per square meter of the photosensitive material. The crossover time was 6 seconds in each case and this time is included in the processing time of the previous operation.

The compositions of the processing liquids are indicated below.

| | Tank Liquid (grams) | Replenisher (grams) |
|---|---|---|
| Color Developer | | |
| Diethylenetriamine penta-acetic acid | 2.0 | 2.0 |
| 1-Hydroxyethylidene-1,1-diphosphonic acid | 3.3 | 3.3 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Ethyl-4-[N-ethyl-N-(β-hydroxyethyl)amino]aniline sulfate | 4.5 | 6.0 |
| Water to make | 1.0 liter | 1.0 liter |
| pH | 10.05 | 10.15 |
| Bleaching solution | | |
| 1,3-Diaminopropane tetra-acetic acid ferrous ammonium salt mono-hydrate | 130 | 195 |

-continued

| | Tank Liquid (grams) | Replenisher (grams) |
|---|---|---|
| Ammonium bromide | 70 | 105 |
| Ammonium nitrate | 14 | 21 |
| Hydroxyacetic acid | 50 | 75 |
| Acetic acid | 40 | 60 |
| Water to make | 1.0 liter | 1.0 liter |
| pH (Adjusted with aqueous ammonia) | 4.4 | 4.4 |

Bleach-fixer Tank Liquid

A mixture in the proportions (by volume) of 15:85 of the bleach tank solution described above and the fixer tank solution described below. (pH 7.0)

| Fixer | Tank Liquid (grams) | Replenisher (grams) |
|---|---|---|
| Ammonium sulfite | 19 | 57 |
| Aqueous ammonium thiosulfate solution (700 g/l) | 280 ml | 840 ml |
| Imidazole | 15 | 45 |
| Ethylenediamine tetra-acetic acid | 15 | 45 |
| Water to make | 1.0 liter | 1.0 liter |
| pH (Adjusted with aqueous ammonia, acetic acid) | 7.4 | 7.45 |

Washing Water

Tap water was treated by being passed through a mixed bed column which had been packed with an H-type strongly acidic cation exchange resin (Amberlite IR-120B, made by the Rohm and Haas Co.) and an OH-type strongly basic anion exchange resin (Amberlite IR-400, made by the same company) and the calcium and magnesium ion concentrations were set to not more than 3 mg/liter. Then 20 mg/liter of sodium isocyanurate dichloride and 150 mg/liter of sodium sulfate were added. The pH of this liquid was in the range from 6.5 to 7.5.

| Stabilizer (Tank liquid = Replenisher) | (Units: Grams) |
|---|---|
| Sodium p-toluenesulfinate | 0.03 |
| Polyoxyethylene-p-monononylphenyl ether (average degree of polymerization 10) | 0.2 |
| Ethylenediamine tetra-acetic acid disodium salt | 0.05 |
| 1,2,4-Triazole | 1.3 |
| 1,4-Bis(1,2,4-triazol-1-ylmethyl)-piperazine | 0.75 |
| Water to make | 1.0 liter |
| pH | 8.5 |

The results obtained are shown in Table 4.

TABLE 4

| Sample No. | Emulsion | Cyan Coupler Third Layer | Cyan Coupler Fourth Layer | Cyan Coupler Fifth Layer | Photographic Properties $\Delta S_1$ | Photographic Properties $\Delta D_1$ % | Colored Image Fastness ($D_2$ %) | Color Impurity ($\Delta D_G$) | Sharpness [25 Cycles/mm] |
|---|---|---|---|---|---|---|---|---|---|
| 101 (Comparative Example) | 1 | Comparative Coupler (A) | | | 0.00 Standard | 100 Standard | 85 | 0.00 Standard | 0.66 |
| 201 (Comparative Example) | 1 | 1 | 1 | 1 | +0.03 | 118 | 92 | −0.04 | 0.69 |
| 202 (Comparative Example) | 1 | 3 | 3 | 3 | +0.03 | 118 | 92 | −0.04 | 0.69 |
| 203 (Comparative Example) | 1 | 6 | 5 | 3/2 = 1/1 (mol ratio) | +0.04 | 119 | 92 | −0.04 | 0.68 |
| 204 (Comparative Example) | 1 | 8 | 8 | 8 | +0.04 | 120 | 92 | −0.04 | 0.69 |
| 205 (Comparative Example) | 1 | 12 | 12 | 12 | +0.04 | 120 | 92 | −0.04 | 0.69 |
| 206 (Comparative Example) | 1 | 14 | 13 | 28 | +0.04 | 120 | 92 | −0.04 | 0.69 |
| 207 (Comparative Example) | 1 | 25 | 10/27 = 1/1 (mol ratio) | 21/29 = 1/2 (mol ratio) | +0.05 | 121 | 92 | −0.04 | 0.68 |
| 208 (Comparative Example) | 1 | 43 | 43 | 43 | +0.03 | 118 | 92 | −0.04 | 0.69 |
| 209 (Comparative Example) | 1 | 39 | 44 | 33 | +0.03 | 118 | 92 | −0.04 | 0.68 |
| 210 (Comparative Example) | 1 | 38 | 40 | 36/42 = 2/1 (mol ratio) | +0.04 | 119 | 92 | −0.04 | 0.69 |

TABLE 4-continued

| Sample No. | Emulsion | Cyan Coupler Third Layer | Cyan Coupler Fourth Layer | Cyan Coupler Fifth Layer | Photographic Properties $\Delta S_1$ | Photographic Properties $\Delta D_1$ % | Colored Image Fastness ($D_2$ %) | Color Impurity ($\Delta D_G$) | Sharpness [25 Cycles/mm] |
|---|---|---|---|---|---|---|---|---|---|
| 211 (Comparative Example) | 1 | 49 | 49 | 49 | +0.04 | 117 | 91 | −0.04 | 0.69 |
| 212 (Comparative Example) | 1 | 50 | 50 | 50 | +0.03 | 117 | 91 | −0.04 | 0.69 |
| 213 (Comparative Example) | 1 | 51 | 44 | 19 | +0.05 | 117 | 91 | −0.04 | 0.69 |
| 105 (Comparative Example) | 4 | Comparative Coupler (A) | | | +0.03 | 101 | 85 | −0.02 | 0.69 |
| 214 (This Invention) | 4 | 1 | 1 | 1 | +0.09 | 121 | 93 | −0.07 | 0.75 |
| 215 (This Invention) | 4 | 3 | 3 | 3 | +0.09 | 121 | 93 | −0.07 | 0.75 |
| 216 (This Invention) | 4 | 6 | 5 | 3/2 = 1/1 (mol ratio) | +0.10 | 122 | 93 | −0.07 | 0.74 |
| 217 (This Invention) | 4 | 8 | 8 | 8 | +0.11 | 122 | 94 | −0.07 | 0.75 |
| 218 (This Invention) | 4 | 12 | 12 | 12 | +0.11 | 122 | 94 | −0.07 | 0.75 |
| 219 (This Invention) | 4 | 14 | 13 | 28 | +0.12 | 123 | 94 | −0.07 | 0.75 |
| 220 (This Invention) | 4 | 25 | 10/27 = 1/1 (mol ratio) | 21/29 = 1/2 (mol ratio) | +0.13 | 124 | 93 | −0.07 | 0.74 |
| 221 (This Invention) | 4 | 43 | 43 | 43 | +0.09 | 121 | 93 | −0.07 | 0.75 |
| 222 (This Invention) | 4 | 39 | 44 | 33 | +0.09 | 121 | 93 | −0.07 | 0.75 |
| 223 (This Invention) | 4 | 38 | 40 | 36/42 = 2/1 mol ratio) | +0.11 | 122 | 93 | −0.07 | 0.74 |
| 224 (This Invention) | 4 | 49 | 49 | 49 | +0.09 | 120 | 92 | −0.06 | 0.75 |
| 225 (This Invention) | 4 | 50 | 50 | 50 | +0.08 | 120 | 92 | −0.06 | 0.75 |
| 226 (This Invention) | 4 | 51 | 44 | 19 | +0.13 | 120 | 92 | −0.06 | 0.74 |

It is clear from Table 4 that when compared with comparative Sample Nos. 201 to 213 (wherein an emulsion containing tabular silver halide grains having an aspect ratio of at least 2 in an amount of 21.3 number % was used), Sample Nos. 214 to 226 (wherein an emulsion containing tabular silver halide grains having an aspect ratio of at least 2 in an amount of 99.6 number % was used) in which the cyan coupler represented by formula (Ia) of the present invention had been modified variously and in which a silver halide emulsion containing tabular grains of which the aspect ratio was at least 2 had been used had better photographic properties, color reproduction and sharpness. Colored image fastness was also improved.

Furthermore, it is clear that the cyan couplers of the present invention provided a greater improvement in all aspects of performance when compared with Sample Nos. 101 and 105 in which the Comparative Coupler (A) had been used for the cyan coupler.

EXAMPLE 3

Emulsion 6 (This Invention)

A 2M aqueous solution of silver nitrate which contained gelatin and a 2M aqueous solution of potassium bromide which contained gelatin (25 ml of each solution) were mixed simultaneously over a period of 1 minute at 30° C. with vigorous agitation in 1 liter of 0.7 wt % gelatin solution which contained 0.04M potassium bromide. Subsequently, the temperature was raised to 75° C. and 300 ml of 10 wt % gelatin solution were added. Next, 30 ml of 1M aqueous solution of silver nitrate was added over a period of 5 minutes. Then 10 ml of 25 wt % aqueous ammonia was added and the mixture was ripened at 75° C. After ripening had been completed and the ammonia had been neutralized, 1M aqueous silver nitrate solution and 1M aqueous potassium bromide solution were admixed simultaneously with an accelerating flow rate (the final flow rate was five times the initial flow rate) while maintaining a pBr value of 2.3. The amount of aqueous silver nitrate solution used was 600 ml. This emulsion was washed with water using the normal flocculation method, dispersed gelatin was added and 800 grams of a hexagonal tabular silver halide emulsion were obtained (Seed Emulsion A). This Seed Emulsion A consisted of mono-disperse hexagonal tabular grains of average projected area corresponding circle diameter (grain size) 1.0 μm, average thickness 0.18 μm and variation coefficient 11%. Next, 250 grams of Seed Emulsion A were taken, 800 ml of distilled water, 30 grams of gelatin and 6.5 grams of potassium bromide were added and the mixture was heated to 75° C. and stirred. A 1M aqueous silver nitrate solution and a 1M aqueous potassium halide solution (a mixture of 90 mol % potassium bromide and 10 mol % potassium bromide) were admixed simultaneously in this mixture, with stirring, at an accelerating flow rate (the final flow rate was three times the initial flow rate) while maintaining a pBr value of 1.6. The amount of aqueous silver nitrate solution used was 600 ml. Moreover, 1M aqueous silver nitrate solution and 1M aqueous potassium bromide solution were then admixed simultaneously at an accelerating flow rate (the final flow rate was 1.5 times the initial flow rate) while maintaining a pBr value of 1.6. The amount of aqueous silver nitrate solution used here was 200 ml. This emulsion was washed with water in the way described above, dispersed gelatin was added, and a mono-disperse hexagonal tabular silver halide emulsion (Emulsion 6) was obtained. Emulsion 6 so obtained was such that 92% of the total projected area was accounted for by hexagonal tabular grains, and the average grain size of the hexagonal tabular grains was 1.75 μm, the average thickness was 0.29 μm, the average aspect ratio was 6:1, and the variation coefficient was 16%. The ratio of grains having an aspect ratio of at least 2 was 99 number %.

Emulsion 7 (This Invention)

Seed Emulsion B was obtained in the same way as for Emulsion 6 (except that the amount of 1M aqueous silver nitrate solution on the second occasion was 20 ml and the amount of aqueous ammonia added was 8 ml). Then, this Seed Emulsion B was grown in the same way as Emulsion 6. However, the pBr value during growth was maintained at 1.5. The emulsion obtained was such that 90% of the total projected area was accounted for by hexagonal tabular grains and the average size of the hexagonal tabular grains was 2.1 μm, the average thickness was 0.21 μm, the average aspect ratio was 10, and the variation coefficient was 19%. The ratio of grains having an aspect ratio of at least 2 was 99 number %.

Emulsion 8 (This Invention)

The amount of 1M aqueous silver nitrate solution added on the second occasion in the preparation used for Emulsion 6 was changed from 30 ml to 10 ml and no aqueous ammonia was added. Moreover, the pBr value on the third occasion was changed from 2.3 to 1.7 to prepare Seed Emulsion C. Next, Seed Emulsion C was grown using the same method as Emulsion 6 to obtain Emulsion 8.

Emulsion 8 so obtained was such that 62% of the total projected area was accounted for by hexagonal tabular grains. The average grain size of these hexagonal tabular grains was 2.0 μm, the average thickness was 0.17 μm, the average aspect ratio was 12, and the variation coefficient was 37%. The ratio of grains having an aspect ratio of at least 2 was 99 number %.

A mixture of Sensitizing Dyes I, II and III (which were used in Sample No. 101 in Example 1) in the molar ratio 5:2:7 was added to each of Emulsions 6, 7, 8 and 1 in an amount equal to 70% of the amount for saturation adsorption in each emulsion. After maintaining at 60° C. for 20 minutes, the emulsions were chemically sensitized optimally at 60° C., pH 6.5 using sodium thiosulfate, chloroauric acid and potassium thiocyanate. Emulsion 6-1, Emulsion 7-1, Emulsion 8-1 and Emulsion 1-1 were obtained in this way.

TABLE 5

| Emulsion[6] | Aspect Ratio[1] | Aspect Ratio[2] | Aspect Ratio[3] | Average Grain Diameter (μm) | Average Grain Thickness (μm) | Variation Coefficient of Grain Diameter | Hexagonal Tabular Fraction[4] (%) | Relative Standard Deviation of Silver Iodide Content from Grain to Grain[5] (%) |
|---|---|---|---|---|---|---|---|---|
| 6-1 | 7.9 | 7.2 | 6.0 | 1.75 | 0.29 | 0.15 | 92 | 13 |
| 7-1 | 13 | 11 | 10 | 2.10 | 0.21 | 0.19 | 90 | 16 |
| 8-1 | 21 | 17 | 12 | 2.00 | 0.17 | 0.37 | 62 | 24 |
| 1-1 | 1.5 | 1.2 | 1.1 | 0.86 | 0.67 | 0.25 | 10 | 22 |

[1], [2]Values measured in the same was as in Table 1.
[3]Average value for all grains.
[4]Proportion of projected area of hexagonal grains with respect to total projected area for all emulsion grains.
[5]Measured values in accordance with specifications of JP-A-60-254032 (corresponding to EP 147,868B).
[6]The ratio of silver halide grains of Emulsions 6-1, 7-1 and 8-1 having an aspect ratio of at least 2 was at least 99 number %, and that of Emulsion 1-1 was 21.3 number %.

Sample Nos. 301 to 304

Sample Nos. 301 to 304 were prepared by replacing Emulsion 1 in the fifth layer of Sample No. 103 with Emulsion 1-1, 6-1, 7-1 or 8-1, eliminating the Sensitizing Dyes I, II and III which were added to the fifth layer and replacing Cyan Coupler 9 of the present invention which had been used in the third to fifth layers with an equimolar amount of Cyan Coupler 3.

Sample Nos. 305 to 312

Sample 305 to 312 were obtained by replacing Cyan Coupler 3 which had been used in the third to fifth layers of Sample Nos. 301 to 304 with an equimolar amount of Cyan Coupler 10 or Cyan Coupler 39.

Sample Nos. 313 to 314

Sample Nos. 313 and 314 were prepared by mixing Emulsion 6-1 in the fifth layer of Sample No. 305 in the proportions 1 to 1 with another emulsion.

The relative speed on the basis of Sample No. 301, the cyan image MTF value and the color impurity were obtained in the same way as in Example 1 on processing the samples in the way indicated below.

Sample Nos. 301 to 314 were subjected to imagewise exposure and processed using the procedure indicated below in an automatic processor until the cumulative replenishment of the developer reached three times the tank capacity, and then performance was evaluated.

| Processing Operations | | | | |
|---|---|---|---|---|
| Process | Processing Time | Processing Temperature | Replenishment Rate* | Tank Capacity |
| Color Development | 2 min. 00 sec. | 40° C. | 3.5 ml | 10 liters |
| Bleach | 3 min. 00 sec. | 40° C. | 25 ml | 20 liters |
| Water Wash | 30 sec. | 24° C. | 1200 ml | 10 liters |
| Fix | 3 min. 00 sec. | 40° C. | 25 ml | 20 liters |
| Water Wash (1) | 30 sec. | 24° C. | Counter-flow from (2) to (1) | 10 liters |
| Water Wash (2) | 30 sec. | 24° C. | 1200 ml | 10 liters |
| Stabilizer | 30 sec. | 40° C. | 25 ml | 10 liters |
| Drying | 4 min. 20 sec. | 55° C. | | |

Replenishment rate per 1 m length of width 35 mm.

-continued

| | | |
|---|---|---|
| Potassium iodide | 1.5 mg | — |
| Hydroxylamine sulfate | 2.4 | 2.8 |
| 4-[N-Ethyl-N-(4-hydroxybutylamino)]-2-methylaniline sulfate | 6.0 | 15.0 |
| Water to make | 1.0 liter | 1.0 liter |
| pH | 10.05 | 10.15 |
| Bleaching Bath | | |
| Ethylenediamine tetra-acetic acid ferric sodium salt tri-hydrate | 100.0 | 120.0 |
| Ethylenediamine tetra-acetic acid di-sodium salt | 10.0 | 11.0 |
| 3-Mercapto-1,2,4-triazole | 0.08 | 0.09 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| pH | 6.0 | 5.7 |
| Fixer | | |
| Ethylenediamine tetra-acetic acid di-sodium salt | 0.5 | 0.7 |
| Ammonium sulfite | 20.0 | 22.0 |
| Aqueous ammonium thiosulfate solution (700 g/l) | 290.0 ml | 320.0 ml |
| Water to make | 1.0 liter | 1.0 liter |
| pH | 6.7 | 7.0 |

| Stabilizer (Tank Solution = Replenisher) | (Grams) |
|---|---|
| Sodium p-toluenesulfinate | 0.03 |
| Polyoxyethylene p-mono-nonylphenyl ether (average degree of polymerization 10) | 0.2 |
| Ethylenediamine tetra-acetic acid di-sodium salt | 0.05 |
| 1,2,4-Triazole | 1.3 |
| 1,4-Bis(1,2,4-triazol-1-ylmethyl)piperazine | 0.75 |
| Water to make | 1.0 liter |
| pH | 8.5 |

TABLE 6

| Sample No. | Emulsion in the Fifth Layer | Cyan Coupler in the Third to Fifth Layers | Photographic Speed $\Delta S_1$ | Color Impurity $\Delta D_G$ | Sharpness [25 Cycles/mm] |
|---|---|---|---|---|---|
| 301 (Comparative Example) | 1-1 | 9 | 0.00 Standard | 0.00 Standard | 0.68 |
| 302 (This Invention) | 6-1 | " | +0.08 | −0.04 | 0.74 |
| 303 (This Invention) | 7-1 | " | +0.10 | −0.05 | 0.75 |
| 304 (This Invention) | 8-1 | " | +0.07 | −0.04 | 0.74 |
| 305 (Comparative Example) | 1-1 | 10 | 0.00 | 0.00 | 0.68 |
| 306 (This Invention) | 6-1 | " | +0.08 | −0.04 | 0.74 |
| 307 (This Invention) | 7-1 | " | +0.10 | −0.05 | 0.75 |
| 308 (This Invention) | 8-1 | " | +0.07 | −0.04 | 0.74 |
| 309 (Comparative Example) | 1-1 | 39 | −0.01 | 0.00 | 0.68 |
| 310 (This Invention) | 6-1 | " | +0.07 | −0.04 | 0.74 |
| 311 (This Invention) | 7-1 | " | +0.09 | −0.05 | 0.75 |
| 312 (This Invention) | 8-1 | " | +0.06 | −0.04 | 0.74 |
| 313 (This Invention) | 6-1/7-1 | 10 | +0.10 | −0.05 | 0.75 |
| 314 (This Invention) | 6-1/8-1 | " | +0.08 | −0.05 | 0.74 |

The compositions of the processing baths are indicated below.

| | Tank Solution (grams) | Replenisher (grams) |
|---|---|---|
| Color Development Bath | | |
| Diethylenetriamine pentaacetic acid | 1.0 | 1.1 |
| 1-Hydroxyethylidine-1,1-di-phosphonic acid | 3.0 | 3.2 |
| Sodium sulfite | 4.0 | 4.4 |
| Potassium carbonate | 30.0 | 37.0 |
| Potassium bromide | 6.0 | — |

It is clear from Table 6 that Sample Nos. 302 to 304, 306 to 308 and 310 to 314 which had the structure of the present invention had a higher photographic speed than Sample Nos. 301, 305 and 309 in which Emulsion 1-1, an emulsion outside the scope of the invention, had been used. The samples according to the present invention also had superior image quality in terms of color reproduction and sharpness.

Furthermore, it is clear on comparing Sample Nos. 302, 303 and 304, and Sample Nos. 306, 307, 313 and 308, and Sample Nos. 310, 311 and 312 respectively that the use of Emulsions 6-1 and 7-1 which have a high hexagonal tabular fraction is desirable for the abovementioned performance.

EXAMPLE 4

Emulsion Preparation

A 14% aqueous potassium bromide solution and a 20% aqueous silver nitrate solution were added, with thorough agitation, at a constant flow rate over a period of 1 minute, under conditions of 45° C. and pAg 9.6, to an aqueous solution in which 6 grams of potassium bromide and 23 grams of inactive gelatin had been dissolved in 3.7 liters of distilled water (2.40% of the total amount of silver was consumed by this addition (I)). Next, aqueous gelatin solution was added (17%, 3300 ml) and, after stirring at 45° C., 20% aqueous silver nitrate solution was added at a fixed flow rate until the pAg value reached 8.40 (5.0% of the total amount of silver was consumed by this addition (II)). The temperature was then raised to 75° C., 35 μl of 25% aqueous ammonia solution was added and, after holding for 15 minutes, 510 μl 1N $H_2SO_4$ were added and the mixture was neutralized. Moreover, a 20% potassium bromide solution which contained potassium iodide such that 8.3 grams of potassium iodide were added and a 33% aqueous silver nitrate solution were added over a period of 80 minutes using a double jet method (92.6% of the total amount of silver was consumed by this addition (III)). At this time, the temperature was maintained at 75° C. and the pAg value was maintained at 8.10. Furthermore, the amount of silver nitrate used in this emulsion was 425 grams. The emulsion was then de-salted using the usual flocculation method, after which gold and sulfur sensitization were carried out optimally in the presence of the Sensitizing Dyes S-5 and S-6 (added in the amounts indicated hereinafter), and the tabular AgBrI (AgI= 2.0 mol %) Emulsion 1-2 was obtained. Emulsion 2-2 was prepared in the same way, except that the potassium iodide was excluded from the halogen solution used for addition (III) in the preparation of Emulsion 1-2 as described above, that 830 ml of 1% aqueous potassium iodide solution was added over a period of about 90 seconds after interrupting the addition of the silver nitrate and potassium bromide solutions during addition (III) at the point in time at which 40% of the total amount of silver had been consumed, and that the flow rate for the remainder of addition (III) was trebled.

Emulsion 3-2 was prepared in the same way as Emulsion 2-2 except that the aqueous potassium bromide solution was added immediately before the addition of the aqueous potassium iodide solution and the pAg value was adjusted to 9.0.

Emulsion 4-2 was prepared in the same way as Emulsion 2-2 except that the temperature was set to 30° C. immediately before the addition of the aqueous potassium iodide solution. Moreover, the addition using a double jet method of the potassium bromide and silver nitrate aqueous solutions after the addition of the aqueous potassium iodide solution was carried out under conditions of 30° C. and pAg 8.1.

The corresponding sphere diameters of the Emulsions 1-2 to 4-2 which had been prepared in the ways indicated above were all the same at 0.7 μm, and the average grain diameter/grain thickness ratios were in the range from 6.5 to 7.0. The ratio of grains having an aspect ratio of at least 2 was at least 95 number %.

With Emulsions 1-2 to 4-2, direct observation of dislocations was carried out using a transmission type electron microscope in accordance with the method disclosed in Example 1-(2) of JP-A-63-220238. No dislocations were observed with Emulsion 1-2. Ten or more dislocations were observed in at least 50% of the grains in Emulsions 2-2 to 4-2. Furthermore, with respect to Emulsion 2-2, the dislocations were observed to be more uniform from grain to grain in Emulsions 3-2 and 4-2.

Moreover, the inter-grain iodine distributions for Emulsions 1-2 to 4-2 were obtained in accordance with the method disclosed in European Patent 147868A. The results are shown in Table 7.

TABLE 7

| Emulsion | 1-2 | 2-2 | 3-2 | 4-2 |
|---|---|---|---|---|
| Inter-grain Iodine Distribution (%) | 20 | 65 | 30 | 15 |

The samples indicated below were prepared using the Emulsions 1-2 to 4-2 which had been prepared.

Preparation of Sample No. 401

A multi-layer color photosensitive material comprised of layers the compositions of which are indicated below was prepared on a cellulose triacetate film support of thickness 205μ on both sides of which an under-layer had been established. This was taken as Sample No. 401.

The coated weight of each component is indicated as the value per square meter of sample. Moreover, the amounts of silver halides and colloidal silver are shown as the weights calculated as the silver equivalents.

| | |
|---|---|
| First Layer (Anti-halation Layer) | |
| Black colloidal silver | 0.25 grams |
| Gelatin | 1.9 grams |
| Ultraviolet absorber U-1 | 0.2 grams |
| Ultraviolet absorber U-3 | 0.1 grams |
| Ultraviolet absorber U-4 | 0.2 grams |
| High boiling point organic solvent Oil-1 | 0.1 grams |
| Fine crystalline solid dispersion of Dye E-1 | 0.1 gram |
| Second Layer (Intermediate Layer) | |
| Non-photosensitive fine grain silver iodobromide emulsion (average grain size 0.1 μm, AgI content 1 mol %) | as silver 0.15 grams |
| Surface and internally fogged fine grain silver iodobromide emulsion (average grain size 0.06 μm, variation coeff. 18%, AgI content 1 mol %) | as silver 0.05 grams |
| Compound Cpd-A | 0.1 gram |
| Compound Cpd-M | 0.05 grams |
| Gelatin | 0.4 grams |
| Third Layer (Intermediate Layer) | |
| Gelatin | 0.40 grams |
| Compound Cpd-C | 1 mg |
| Compound Cpd-D | 3 mg |
| Dye D-4 | 0.4 mg |
| High boiling point organic solvent Oil-3 | 40 mg |
| Fourth Layer (Low Speed Red Sensitive Emulsion Layer) | |
| Emulsion A | as silver 0.3 grams |
| Emulsion B | as silver 0.4 grams |
| Gelatin | 0.8 grams |
| Coupler C-1 | 0.12 grams |
| Coupler C-3 | 0.02 grams |
| Coupler C-10 | 0.02 grams |
| Compound Cpd-D | 1 mg |
| Compound Cpd-K | 0.05 grams |
| High boiling point organic solvent Oil-2 | 0.10 gram |
| Latex dispersion of ethyl acrylate | 0.5 grams |
| Fifth Layer (Intermediate Speed Red Sensitive Emulsion Layer) | |
| Emulsion B | as silver 0.2 grams |
| Emulsion C | as silver 0.3 grams |
| Gelatin | 0.8 grams |
| Coupler C-1 | 0.2 grams |

| | |
|---|---|
| Coupler C-2 | 0.05 grams |
| Coupler C-3 | 0.2 grams |
| High boiling point organic solvent Oil-2 | 0.1 gram |
| High boiling point organic solvent Oil-3 | 0.05 grams |
| Latex dispersion of ethyl acrylate | 0.05 grams |

Sixth Layer (High Speed Red Sensitive Emulsion Layer)

| | |
|---|---|
| Emulsion D | as silver 0.4 grams |
| Gelatin | 1.1 grams |
| Coupler C-1 | 0.4 grams |
| Coupler C-3 | 0.1 gram |
| Additive P-1 | 0.02 grams |
| High boiling point organic solvent Oil-3 | 0.1 gram |
| Latex dispersion of ethyl acrylate | 0.1 gram |

Seventh Layer (Intermediate Layer)

| | |
|---|---|
| Gelatin | 1.0 gram |
| Compound Cpd-J | 0.2 grams |
| Compound Cpd-L | 0.05 grams |
| Compound Cpd-N | 0.02 grams |
| Additive P-1 | 0.05 grams |
| Dye D-1 | 0.02 grams |

Eighth Layer (Intermediate Layer)

| | |
|---|---|
| A surface and internally fogged fine grained silver iodobromide emulsion (average grain size 0.06 μm, variation coefficient 16%, AgI content 0.3 mol %) | as silver 0.02 grams |
| Gelatin | 0.4 grams |
| Compound Cpd-A | 0.1 gram |
| Compound Cpd-D | 1 mg |
| Compound Cpd-M | 0.05 grams |

Ninth Layer (Low Speed Green Sensitive Emulsion Layer)

| | |
|---|---|
| An internally fogged silver iodobromide emulsion (average grain size 0.1 μm, AgI content 0.1 mol %) | as silver 0.15 grams |
| Emulsion E | as silver 0.3 grams |
| Emulsion F | as silver 0.1 gram |
| Emulsion G | as silver 0.1 gram |
| Gelatin | 2.0 grams |
| Coupler C-4 | 0.03 grams |
| Coupler C-7 | 0.05 grams |
| Coupler C-8 | 0.02 grams |
| Coupler C-9 | 0.05 grams |
| Coupler C-12 | 0.2 grams |
| Compound Cpd-B | 0.03 grams |
| Compound Cpd-D | 1 mg |
| Compound Cpd-E | 0.02 grams |
| Compound Cpd-F | 0.02 grams |
| Compound Cpd-G | 0.02 grams |
| Compound Cpd-H | 0.02 grams |
| High boiling point organic solvent Oil-2 | 0.2 grams |

Tenth Layer (Intermediate Speed Green Sensitive Emulsion Layer)

| | |
|---|---|
| Emulsion G | as silver 0.3 grams |
| Emulsion H | as silver 0.1 gram |
| Gelatin | 0.6 grams |
| Coupler C-4 | 0.1 gram |
| Coupler C-7 | 0.05 grams |
| Coupler C-8 | 0.05 grams |
| Coupler C-9 | 0.02 grams |
| Coupler C-12 | 0.20 grams |
| Compound Cpd-B | 0.03 grams |
| Compound Cpd-E | 0.02 grams |
| Compound Cpd-F | 0.02 grams |
| Compound Cpd-G | 0.05 grams |
| Compound Cpd-H | 0.05 grams |
| Additive F-5 | 0.08 mg |
| High boiling point organic solvent Oil-2 | 0.01 gram |

Eleventh Layer (High Speed Green Sensitive Emulsion Layer)

| | |
|---|---|
| An internally fogged silver iodobromide emulsion (average grain size 0.2 μm, AgI content 0.1 mol %) | as silver 0.05 grams |
| Emulsion I | as silver 0.5 grams |
| Gelatin | 1.1 grams |
| Coupler C-4 | 0.1 gram |
| Coupler C-7 | 0.3 grams |
| Coupler C-8 | 0.07 grams |
| Coupler C-9 | 0.05 grams |
| Coupler C-12 | 0.1 gram |
| Compound Cpd-B | 0.08 grams |
| Compound Cpd-E | 0.02 grams |
| Compound Cpd-F | 0.02 grams |
| Compound Cpd-G | 0.02 grams |
| Compound Cpd-H | 0.02 grams |
| High boiling point organic solvent Oil-2 | 0.04 grams |

Twelfth Layer (Intermediate Layer)

| | |
|---|---|
| Gelatin | 0.4 grams |
| Latex dispersion of ethyl acrylate | 0.15 grams |
| Dye D-1 | 0.1 gram |
| Dye D-2 | 0.05 grams |
| Dye D-3 | 0.07 grams |

Thirteenth Layer (Yellow Filter Layer)

| | |
|---|---|
| Yellow colloidal silver | as silver 0.08 grams |
| Gelatin | 1.0 gram |
| Compound Cpd-A | 0.04 grams |
| High boiling point organic solvent Oil-1 | 0.01 gram |
| Fine crystalline solid dispersion of Dye E-2 | 0.05 grams |

Fourteenth Layer (Intermediate Layer)

| | |
|---|---|
| Gelatin | 0.6 grams |

Fifteenth Layer (Low Speed Blue Sensitive Emulsion Layer)

| | |
|---|---|
| An internally fogged silver iodobromide emulsion (average grain size 0.2 μm, AgI content 0.1 mol %) | as silver 0.1 gram |
| Emulsion J | as silver 0.4 grams |
| Emulsion K | as silver 0.1 gram |
| Emulsion L | as silver 0.1 gram |
| Gelatin | 1.0 gram |
| Coupler C-5 | 0.5 grams |
| Coupler C-6 | 0.1 gram |
| Coupler C-11 | 0.1 gram |
| Compound Cpd-K | 0.1 gram |

Sixteenth layer (Intermediate Speed Blue Sensitive Emulsion Layer)

| | |
|---|---|
| Emulsion L | as silver 0.1 gram |
| Emulsion M | as silver 0.1 gram |
| Gelatin | 0.6 grams |
| Coupler C-5 | 0.02 grams |
| Coupler C-6 | 0.002 grams |
| Coupler C-11 | 0.02 grams |

Seventeenth Layer (High Speed Blue Sensitive Emulsion Layer)

| | |
|---|---|
| Emulsion N | as silver 0.6 grams |
| Gelatin | 1.4 grams |
| Coupler C-5 | 0.05 grams |
| Coupler C-6 | 0.08 grams |
| Coupler C-11 | 0.8 grams |

Eighteenth Layer (First Protective Layer)

| | |
|---|---|
| Gelatin | 0.9 grams |
| Ultraviolet absorber U-1 | 0.4 grams |
| Ultraviolet absorber U-2 | 0.01 gram |
| Ultraviolet absorber U-3 | 0.03 grams |
| Ultraviolet absorber U-4 | 0.03 grams |
| Ultraviolet absorber U-5 | 0.05 grams |
| Ultraviolet absorber U-6 | 0.05 grams |
| High boiling point organic solvent Oil-1 | 0.02 grams |

Formalin scavengers

| | |
|---|---|
| Cpd-C | 0.2 grams |
| Cpd-1 | 0.4 grams |
| Latex dispersion of ethyl acrylate | 0.05 grams |
| Dye D-3 | 0.05 grams |

-continued

| | |
|---|---|
| Compound Cpd-A | 0.02 grams |
| Compound Cpd-J | 0.02 grams |
| Compound Cpd-N | 0.01 gram |
| Nineteenth Layer (Second Protective Layer) | |
| Colloidal silver | as silver 0.05 mg |
| Fine grained silver iodobromide emulsion (average grain size 0.06 μm, AgI content 1 mol %) | as silver 0.05 grams |
| Gelatin | 0.3 grams |
| Twentieth Layer (Third Protective Layer) | |
| Colloidal silver | as silver 0.05 mg |
| Fine grained silver iodobromide emulsion (average grain size 0.07 μm, AgI content 1 mol %) | as silver 0.05 grams |
| Gelatin | 0.4 grams |
| Poly(methyl methacrylate) (average particle size 1.5 μm) | 0.1 gram |

-continued

| | |
|---|---|
| Methyl methacrylate/acrylic acid (4:6) copolymer (average particle size 1.5 μm) | 0.1 gram |
| Silicone oil | 0.03 grams |
| Surfactant W-1 | 3.0 mg |
| Surfactant W-2 | 0.03 grams |

Furthermore, additives F-1 to F-9 were added to each silver halide emulsion layer and each intermediate layer. Moreover, gelatin hardening agent H-1 and surfactants W-3, W-4 and W-5 for coating purposes and surfactant W-6 for emulsification purposes were added to each layer in addition to the components indicated above.

Moreover, phenol, 1,2-benzisothiazolin-3-one, 2 -phenoxyethanol, phenyl isothiocyanate and phenethyl alcohol were added as biocides and fungicides.

C-1

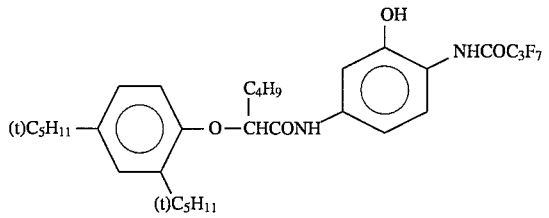

C-2

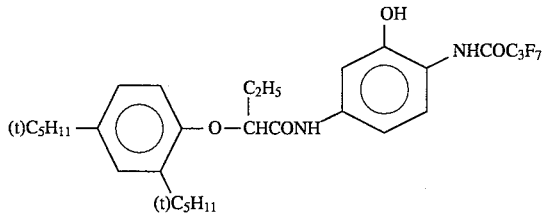

C-3

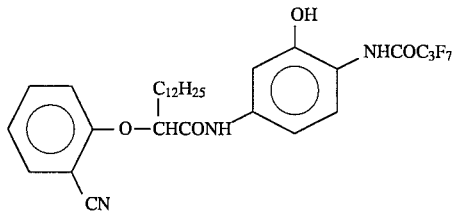

C-4

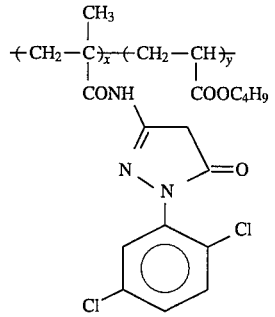

x/y = 50/50 (by weight)
Mean Molecular Weight:
Ca 25,000

-continued
C-5
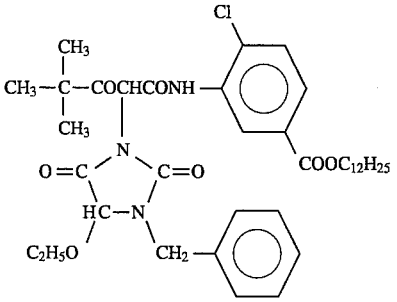
C-6
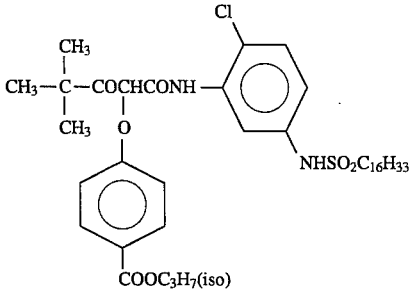
C-7
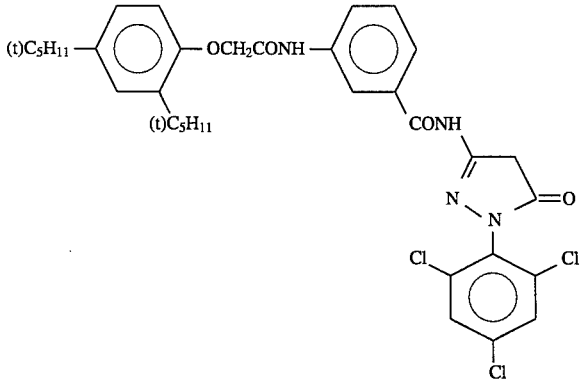
C-8
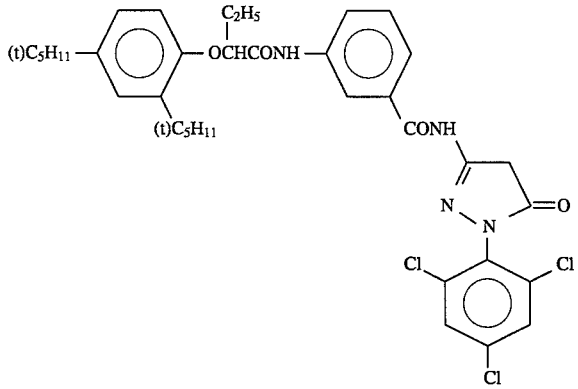
C-9
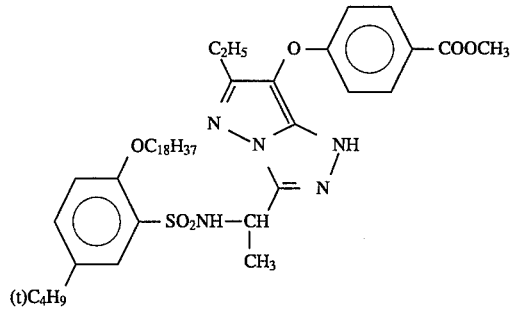

-continued
C-10
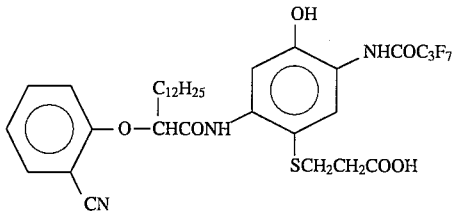
C-11
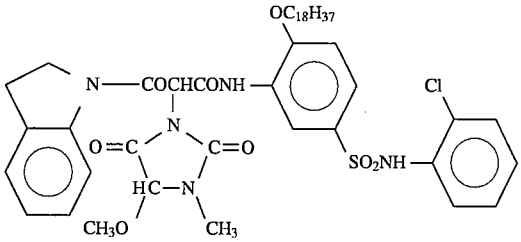
C-12
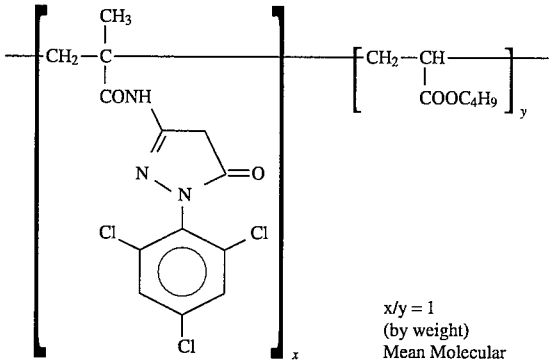
x/y = 1
(by weight)
Mean Molecular
Weight: Ca 70,000
Dibutyl phthalate — Oil-1
Tricresyl phosphate — Oil-2
Oil-3
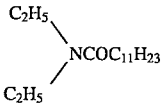
Cpd-A
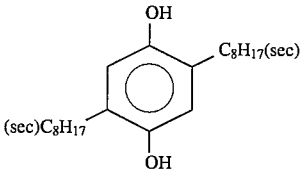
Cpd-B
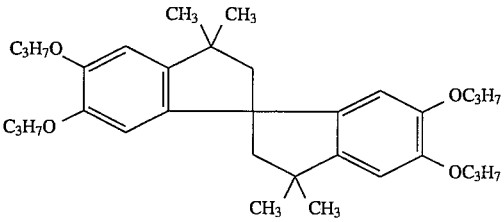
Cpd-C
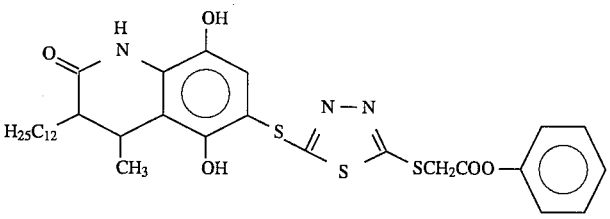

-continued
Cpd-D
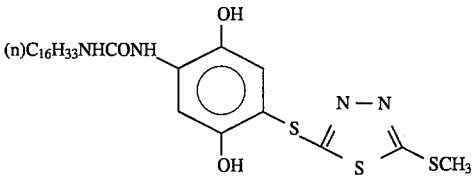
Cpd-E
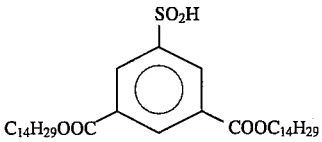
Cpd-F
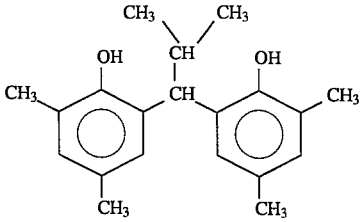
Cpd-G
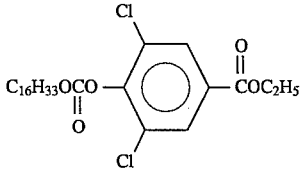
Cpd-H
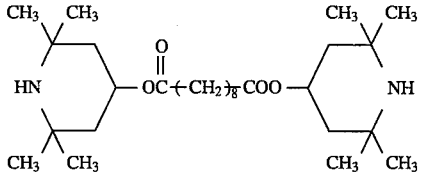
Cpd-I
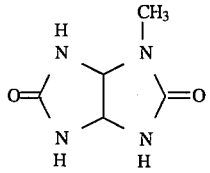
Cpd-J
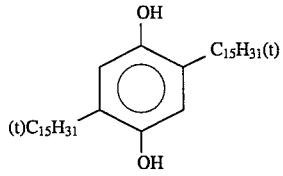
Cpd-K
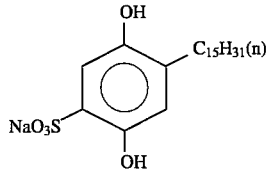
Cpd-L
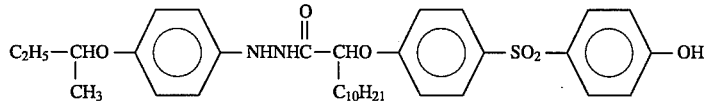

-continued
Cpd-M
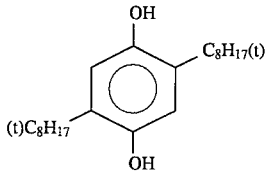
Cpd-N
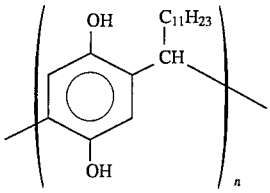
Mean Molecular Weight:
Ca 5,000
U-1
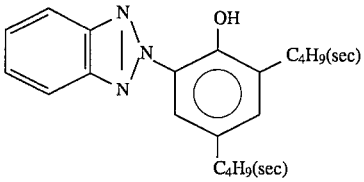
U-2
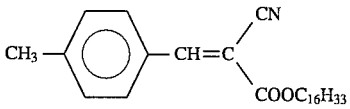
U-3
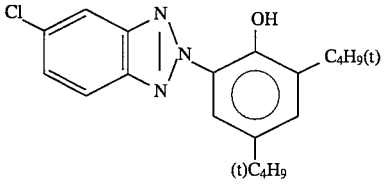
U-4
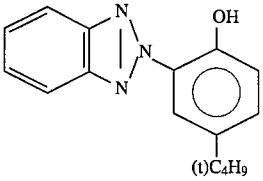
U-5
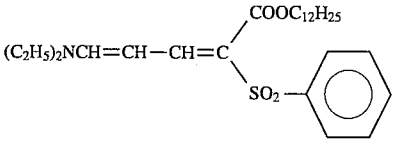
U-6
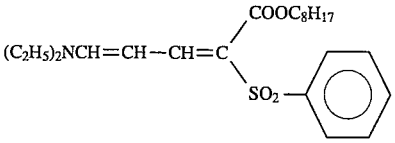
S-1
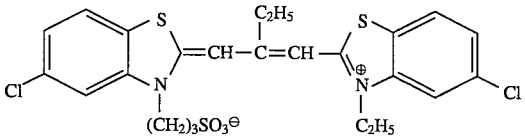

-continued
S-2
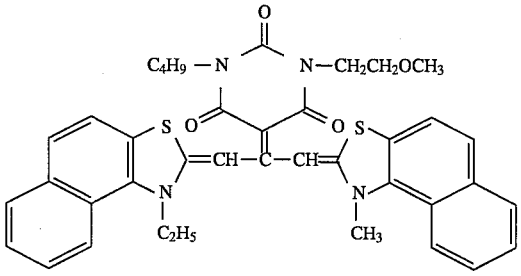
S-3
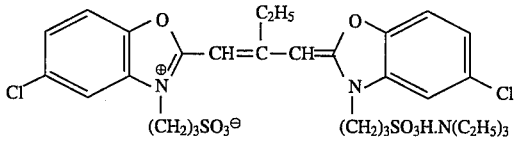
S-4
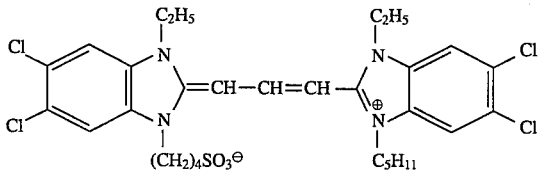
S-5
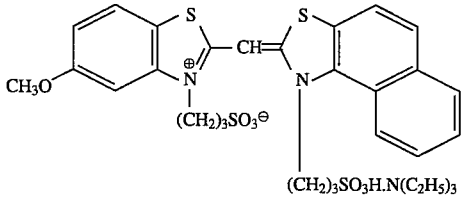
S-6
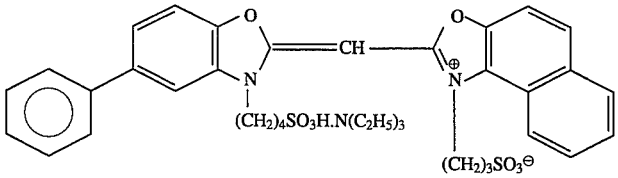
S-7
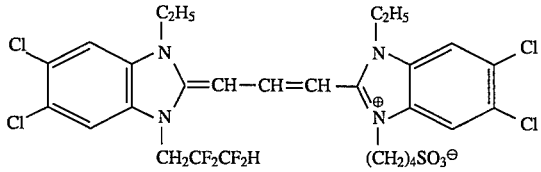
S-8
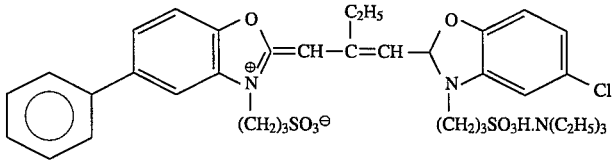
S-9
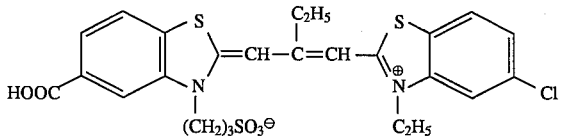
S-10
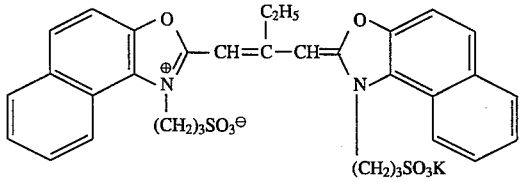

-continued
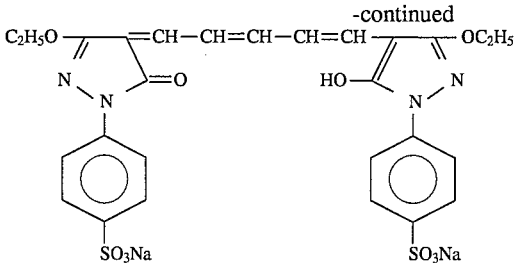
D-1
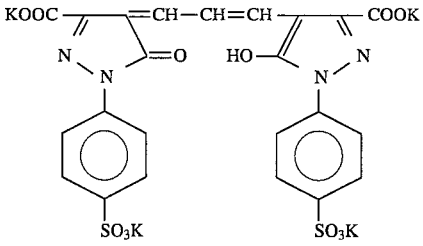
D-2
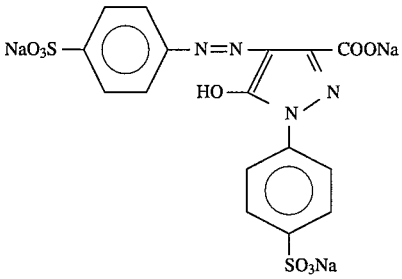
D-3
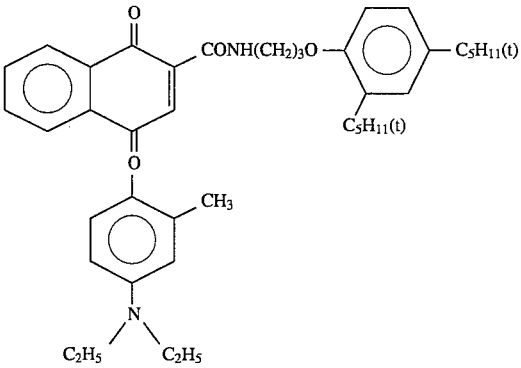
D-4
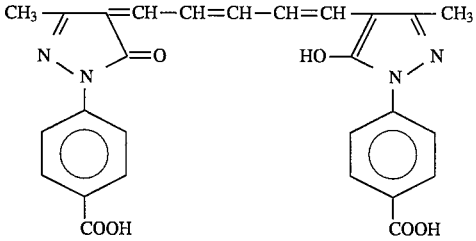
E-1
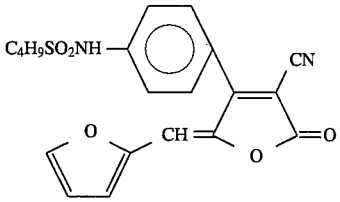
E-2
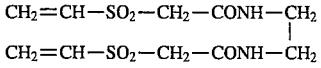
H-1

-continued
$C_8F_{17}SO_2NHCH_2CH_2CH_2OCH_2CH_2\overset{\oplus}{N}(CH_3)_3$ W-1
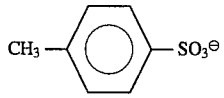
$C_8F_{17}SO_2N(C_3H_7)CH_2COOK$ W-2
$NaO_3S-CH(CH_2COOCH_2CH(C_2H_5)C_4H_9)COOCH_2CH(C_2H_5)C_4H_9$ W-3
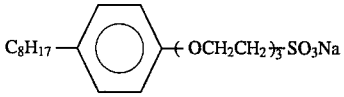
W-4
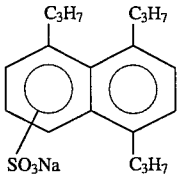
W-5
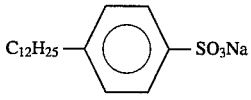
W-6
$(CH_2-CH(CONHC_4H_9(t)))_n$ Mean Molecular Weight: Ca 100,000 P-1
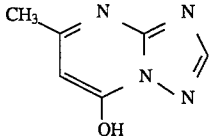
F-1
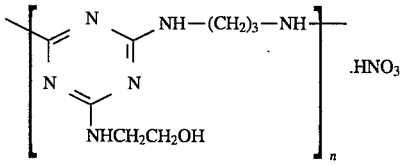
F-2
a mixture of n = 3–4
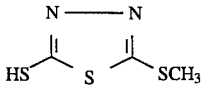
F-3
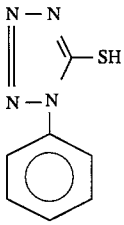
F-4

-continued

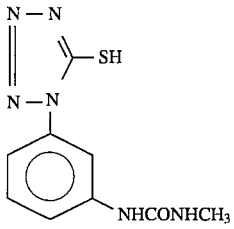

F-5

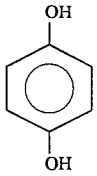

F-6

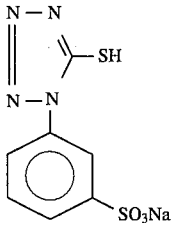

F-7

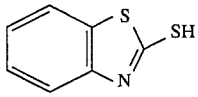

F-8

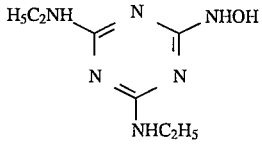

F-9

The silver iodobromide emulsions used in Sample No. 401 are indicated below.

| Emulsion | Grain Characteristics | Average Corresponding Sphere Diameter (μm) | Variation Coefficient (%) | AgI Content (%) |
|---|---|---|---|---|
| A | Mono-disperse tetradecahedral grains | 0.35 | 16 | 4.0 |
| B | Mono-disperse cubic internal latent image type grains | 0.45 | 10 | 2.0 |
| C | Poly-disperse twinned crystal grains (high internal iodine type core/shell grains) | 0.70 | 20 | 6.0 |
| D | Poly-disperse twinned crystal grains | 0.90 | 25 | 6.0 |
| E | Poly-disperse twinned grains | 0.30 | 18 | 6.5 |
| F | Poly-disperse twinned grains | 0.40 | 23 | 5.5 |
| G | Mono-disperse cubic internal latent image type grains | 0.50 | 11 | 4.5 |
| H | Mono-disperse tetradecahedral grains | 0.80 | 15 | 5.0 |
| I* | Poly-disperse twinned crystal grains of average aspect ratio 1.5 | 1.00 | 25 | 6.5 |
| J* | Poly-disperse twinned crystal grains of average aspect ratio 1.5 | 0.60 | 20 | 3.5 |
| K | Mono-disperse tetradecahedral grains | 0.70 | 15 | 5.0 |
| L | Mono-disperse octahedral grains | 0.80 | 14 | 5.0 |
| M | Mono-disperse octahedral grains | 1.00 | 18 | 5.0 |
| N* | Poly-disperse twinned crystal grains of average aspect ratio 1.5 (High internal iodine type core/shell grains) | 1.20 | 25 | 7.5 |

Spectral Sensitization of Emulsions A to G

| Emulsion | Sensitizing Dye Added | Amount Added per Mole Silver Halide (grams) |
|---|---|---|
| A | S-1 | 0.15 |
| | S-2 | 0.02 |
| | S-9 | 0.15 |
| B | S-1 | 0.15 |
| | S-2 | 0.04 |
| | S-9 | 0.20 |
| C | S-1 | 0.15 |
| | S-2 | 0.02 |
| | S-9 | 0.05 |
| D | S-1 | 0.08 |
| | S-2 | 0.01 |
| | S-9 | 0.02 |
| E | S-3 | 0.5 |
| | S-4 | 0.08 |
| | S-7 | 0.02 |
| | S-10 | 0.05 |
| F | S-3 | 0.3 |
| | S-4 | 0.07 |
| | S-7 | 0.03 |
| G | S-3 | 0.25 |
| | S-4 | 0.08 |

Spectral Sensitization of Emulsions H to N

| Emulsion | Sensitizing Dye Added | Amount Added per Mole Silver Halide (grams) |
|---|---|---|
| H | S-3 | 0.2 |
| | S-4 | 0.03 |
| | S-7 | 0.03 |
| | S-10 | 0.1 |
| I | S-3 | 0.3 |
| | S-4 | 0.02 |
| | S-7 | 0.02 |
| | S-8 | 0.1 |
| | S-10 | 0.05 |
| J | S-5 | 0.2 |
| | S-6 | 0.05 |
| K | S-5 | 0.2 |
| | S-6 | 0.05 |
| L | S-5 | 0.22 |
| | S-6 | 0.06 |
| M | S-5 | 0.15 |
| | S-6 | 0.04 |
| N | S-5 | 0.22 |
| | S-6 | 0.06 |

* Emulsions I, J and N contained silver halide grains having an aspect ratio of at least 2 in an amount of 5, 12 and 3 number %, respectively.

The samples indicated below were prepared subsequently.

Sample No. 402 was prepared by replacing Emulsion C in the fifth layer (red sensitive emulsion layer) and the Emulsion D in the sixth layer (red sensitive emulsion layer) with Emulsion 1-2 in such a way that the coated weight of silver remained the same.

Sample No. 403 was prepared by replacing Couplers C-1, C-3 and C-10 in the red sensitive emulsion fourth layer of Sample No. 401 with equimolar amounts of Cyan Couplers 9, 39 and 32 of the present invention respectively, by replacing Couplers C-1, C-2 and C-3 in the fifth layer with equimolar amounts of Couplers 9, 1 and 39 respectively, and by replacing Couplers C-1 and C-3 in the sixth layer with equimolar amounts of Couplers 9 and 39 respectively.

Sample Nos. 404 to 407 were prepared by replacing Emulsion C in the fifth layer (red sensitive emulsion layer) of Sample No. 403 and Emulsion D in the sixth layer respectively with Emulsions 1-2 to 4-2 in such a way that the coated silver weights remained the same.

Sample Nos. 401 407 were then stored as a batch for 7 days under conditions of 45° C., 80% relative humidity. A further batch was stored for the same period under conditions of 5° C., 30% relative humidity and then the two batches were developed and processed at the same time in the way described below. The difference in $D_{min}$ ($\Delta D_{min}$) of the cyan density for the same sample was investigated.

Furthermore, unexposed samples were folded through a fixed angle and then developed and processed. The change in density due to pressure was assessed visually, the evaluation being made in five stages.

Moreover, the MTF value and color impurity were also investigated in the same way as in Example 1.

The development processing operations and the processing bath compositions were indicated below.

The processing of samples for the investigation of performance as mentioned above was carried out using an automatic processor after processing samples which had been subjected to imagewise exposure until the cumulative replenishment of the color developer reached three times the tank capacity.

| Processing Operation | Time | Temp. (°C.) | Tank Capacity (liters) | Replenishment Rate (ml/m$^2$) |
|---|---|---|---|---|
| First Development | 6 min. | 38 | 12 | 2200 |
| First Water Wash | 45 sec. | 38 | 2 | 2200 |
| Reversal | 45 sec. | 38 | 2 | 1100 |
| Color Development | 6 min. | 38 | 12 | 2200 |
| Bleach | 2 min. | 38 | 4 | 860 |
| Bleach-fix | 4 min. | 38 | 8 | 1100 |
| Second Water Wash (1) | 1 min. | 38 | 2 | — |
| Second Water Wash (2) | 1 min. | 38 | 2 | 1100 |
| Stabilization | 1 min. | 25 | 2 | 1100 |
| Drying | 1 min. | 65 | — | — |

The replenishment of the second water wash involved supplying replenisher to the second water wash (2) and introducing the over-flow from the second water wash (2) into the second water wash (1) to provide a so-called counter-current replenishment system.

The composition of each processing bath was as indicated below.

Black and White Developer

| | Tank Solution | Replenisher |
|---|---|---|
| Nitrilo-N,N,N-trimethylene-phosphonic acid penta-sodium salt | 2.0 grams | 2.0 grams |
| Sodium sulfite | 30 grams | 30 grams |
| Hydroquinone mono-sulfonic acid potassium salt | 20 grams | 20 grams |
| Potassium carbonate | 33 grams | 33 grams |
| 1-Phenyl-4-methyl-4-hydroxy-methyl-3-pyrazolidone | 2.0 grams | 2.0 grams |
| Potassium bromide | 2.5 grams | 1.4 grams |
| Potassium thiocyanate | 1.2 grams | 1.2 grams |
| Potassium iodide | 2.0 mg | — |
| Water to make | 1000 ml | 1000 ml |
| pH | 9.60 | 9.60 |

The pH was adjusted with hydrochloric acid or potassium hydroxide.

| First Water Wash Bath | Tank Solution | Replenisher |
|---|---|---|
| Ethylenediamine tetramethylene-phosphonic acid | 2.0 grams | Same as Tank Solution |
| Di-sodium phosphate | 5.0 grams | |
| Water to make | 1000 ml | |
| pH | 7.00 | |

The pH was adjusted with hydrochloric acid or sodium hydroxide.

| Reversal Bath | Tank Solution | Replenisher |
|---|---|---|
| Nitrilo-N,N,N-trimethylenephosphonic acid penta-sodium salt | 3.0 grams | Same as Tank Solution |
| Stannous chloride di-hydrate | 1.0 gram | |
| p-Aminophenol | 0.1 gram | |
| Sodium hydroxide | 8 grams | |
| Glacial acetic acid | 15 ml | |
| Water to make | 1000 ml | |
| pH | 6.00 | |

The pH was adjusted with hydrochloric acid or sodium hydroxide.

| Color Developer | Tank Solution | Replenisher |
|---|---|---|
| Nitrilo-N,N,N-trimethylenephosphonic acid penta-sodium salt | 2.0 grams | 2.0 grams |
| Sodium sulfite | 7.0 grams | 7.0 grams |
| Tri-sodium phosphate, dodecahydrate | 36 grams | 36 grams |
| Potassium bromide | 1.0 gram | — |
| Potassium iodide | 90 mg | — |
| Sodium hydroxide | 3.0 grams | 3.0 grams |
| Citrazinic acid | 1.5 grams | 1.5 grams |
| N-Ethyl-N-(β-methanesulfonamidoethyl)-3-methyl-4-aminoaniline 3/2 sulfate mono-hydrate | 11 grams | 11 grams |
| 3,6-Dithiaoctane-1,8-diol | 1.0 gram | 1.0 gram |
| Water to make | 1000 ml | 1000 ml |
| pH | 11.80 | 12.00 |

The pH was adjusted with hydrochloric acid or potassium hydroxide.

| Bleaching Solution | Tank Solution | Replenisher |
|---|---|---|
| Ethylenediamine tetra-acetic acid disodium salt di-hydrate | 10.0 grams | Same as Tank Solution |

-continued

| Bleaching Solution | Tank Solution | Replenisher |
|---|---|---|
| Ethylenediamine tetra-acetic acid Fe(III) ammonium salt di-hydrate | 120 grams | |
| Potassium bromide | 100 grams | |
| Ammonium nitrate | 10 grams | |
| Bleach accelerator $(CH_3)_2N—CH_2—CH_2—S—S—CH_2—CH_2—N(CH_3)_2.2HCl$ | 0.005 mol | |
| Water to make | 1000 ml | |
| pH | 6.30 | |

The pH was adjusted with hydrochloric acid or aqueous ammonia.

| Bleach-Fixer | Tank Solution | Replenisher |
|---|---|---|
| Ethylenediamine tetra-acetic acid di-sodium salt di-hydrate | 5.0 grams | Same as Tank Solution |
| Ethylenediamine tetra-acetic acid Fe(III) ammonium salt di-hydrate | 50 grams | |
| Ammonium thiosulfate | 80 grams | |
| Sodium sulfite | 12.0 grams | |
| Water to make | 1000 ml | |
| pH | 6.60 | |

The pH was adjusted with hydrochloric acid or aqueous ammonia.

Second Water Wash Bath (Tank Solution= Replenisher)

Tap water was treated by being passed through a mixed bed type column which had been packed with an H-type strongly acidic cation exchange resin (Amberlite IR-120B made by the Rohm and Haas Co.) and an OH-type anion exchange resin (Amberlite IR-400 made by the same company) so that the calcium and magnesium ion concentrations were less than 3 mg/liter and then 20 mg/liter of sodium dichloroisocyanurate and 1.5 g/liter of sodium sulfate were added. The pH of this liquid was in the range 6.5 to 7.5.

| Stabilizer | Tank Solution | Replenisher |
|---|---|---|
| Formaldehyde (37%) | 0.5 ml | Same as Tank Solution |
| Polyoxyethylene p-monononylphenyl ether (average degree of polymerization 10) | 0.3 grams | |
| Triazole | 1.7 grams | |
| Piperazine hexa-hydrate | 0.6 grams | |
| Water to make | 1000 ml | |
| pH | | Not adjusted |

The results obtained are shown in Table 8.

TABLE 8

| Sample No. | Emulsion Fifth Layer | Emulsion Sixth Layer | Coupler Fourth Layer | Coupler Fifth Layer | Coupler Sixth Layer | Storage Properties of the Sensitive Material ($\Delta D_{min}$) | Pressure Resistance* | Color Impurity ($\Delta D_G$) | Sharpness [60 Cycles/mm] |
|---|---|---|---|---|---|---|---|---|---|
| 401 (Comparative Example) | B, C | D | C-1 C-3 C-10 | C-1 C-2 C-3 | C-1 C-3 | 0.06 | 1 | 0.00 Standard | 0.23 |
| 402 (Comparative Example) | B, 1-2 | 1-2 | " | " | " | 0.05 | 2 | −0.02 | 0.26 |
| 403 (Comparative Example) | B, C | D | 9 39 32 | 9 1 39 | 9 39 | 0.05 | 1 | −0.05 | 0.25 |
| 404 (This Invention) | B, 1-2 | 1-2 | " | " | " | 0.03 | 3 | −0.09 | 0.29 |
| 405 (This Invention) | B, 2-2 | 2-2 | " | " | " | 0.02 | 4 | −0.10 | 0.30 |
| 406 (This Invention) | B, 3-2 | 3-2 | " | " | " | 0.02 | 5 | −0.10 | 0.31 |
| 407 (This Invention) | B, 4-2 | 4-2 | " | " | " | 0.02 | 5 | −0.10 | 0.31 |

*:The change in density due to folding was assessed visually and evaluated in five stages ranging from 5 (small change in density, best) → 1 (large change in density, worst)

It is clear from the results in Table 8 that Sample Nos. 404 to 407 in which cyan couplers of the present invention and silver halide emulsions comprised of tabular grains of the present invention exhibited a small increase in $D_{min}$ (fog) on storing the sensitive material, that the pressure resistance was good with Emulsions 2-2 to 4-2 which had large numbers of dislocation lines, that Emulsions 3-2 and 4-2 which were comprised of grains of which the inter-grain iodine concentration distribution was small were better, and that the image quality in terms of sharpness and color reproduction were excellent.

EXAMPLE 5

Five samples, namely Sample Nos. 101, 220, 223, 226 and 313, from among the samples prepared in Examples 1–3 were made into lens-fitted film units in accordance with the methods disclosed in JP-B-2-32615 and JP-B-U-3 -39784.

The five types of lens-fitted film units were used to photograph various subjects under the same conditions and then they were color developed and processed using a FP-560B AL automatic processor (made by the Fuji Photo Film Co., Ltd.), after which prints were made on Super FA Type II Fujicolor Paper using a Fuji Minilab Champion Printer Processor FA-140 (made by the Fuji Photo Film Co., Ltd.), (CP-43FA color development processing was used on this occasion.)

The pictures obtained on printing via the negatives obtained from the five types of lens-fitted film units were examined. It was confirmed that the prints obtained from Sample Nos. 220, 223, 226 and 313 which were in line with the present invention had improved picture quality with excellent fine portrayal of the subjects when compared with the prints obtained from comparative Sample No. 101.

Furthermore, the results obtained on investigating the colored image fastness on storing the color negatives for 4 months under conditions of 40° C., 70% relative humidity confirmed that Sample Nos. 220, 223, 226 and 313 of the present invention exhibited less deterioration of the cyan image when compared with comparative Sample No. 101.

EXAMPLE 6

Each of samples was prepared by further adding ExC-5 [the bleach accelerator-releasing compound (70) described in European Patent 456,181A] used for the fifth layer (red sensitive emulsion layer) of Sample No. 101 to the ninth layer (green sensitive emulsion layer at a coverage of 0.015 g/m$^2$), the thirteenth layer (blue sensitive amulsion layer at a coverage of 0.012 g/m$^2$), and the fourteenth layer (protective layer at a coverage of 0.003 g/m$^2$) of each of Sample Nos. 103, 104, 107, 108, 110, 111, 113, 114, 116, and 117 prepared in Example 1.

Then, each of samples was prepared by replacing ExC-5 used for the fifth layer, the ninth layer, the thirteenth layer, and the fourteenth layer of each of the samples described above with an equimolar amount of the bleach accelerator-releasing compound (34), (60), or (68) described in foregoing European Patent No. 456,181A.

Also, each of samples was prepared by removing ExC-5 used for the fifth layer (red sensitive emulsion layer) of each of the samples 103, 104, 107, 108, 110, 111, 113, 114, 116, and 117 prepared in Example 1.

By applying a uniform white light exposure of 1.0 CMS to each of these 50 kinds of the samples thus prepared and then by processing one groups of these 50 samples by the processing process described in Example 1 and processing other groups of the 50 samples with the processing process wherein the bleaching time is shortened to 2 minutes, it can be seen that in the samples 107, 108, 110, 111, 113, 114, 116, and 117 meeting the construction of the present invention, the amount of silver remaining in the samples after processing is less even by shortening the bleaching time by using the bleach accelerator-releasing compound as compared with the comparative samples 103 and 104, and that there is no difference in the remaining silver amount by shortening the bleaching time.

Furthermore, it becomes clear by comparing the samples of the present invention containing the bleach accelerator-releasing compound with the comparative samples containing no such a compound that the use of the bleach accelerator-releasing compound is effective for bleaching of silver halide photographic materials using the tabular silver halide grains having an aspect ratio of at least 2 of the present invention.

In addition, the residual silver amount can be determined by, for example, a fluorescent X-ray analysis.

Also, when the above-described samples were subjected to a wedge exposure using white light and are processed by the continuous process using the automatic processor described in Example 3 directly after initiation of the continuous process in one case and the thus exposed samples are processed after continuously processing 10 $m^2$ per day for 30 days in another case, and the samples processed directly after the initiation of the continuous processing are compared with the samples processed after 30 days of the continuous processing on the sensitivity and the gradation, it can be seen that in the samples having the construction of the present invention and containing the bleach accelerator-releasing compound, the photographic performances are stable with less deviation.

It can be seen that the same effect of using the bleach accelerator-releasing compound can be obtained by carrying out the same test as above by changing the cyan coupler shown by formula (Ia) by carrying out the test using the bleach accelerator-releasing compound used above in, for example, Sample Nos. 214 to 226 in Example 2.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material comprising a support having thereon (1) at least one photosensitive silver halide emulsion layer comprising silver halide mono-disperse tabular grains in which silver halide grains of an aspect ratio of at least 2 account for at least 50% of the total number of silver halide grains in the layer, in which the variation coefficient of the grain diameters of the silver halide grains in the emulsion layer is not more than 0.25, in which at least 50% of the total number of the silver halide grains in the emulsion layer is comprised of hexagonal tabular grains which have two parallel planes as external surfaces and of which the ratio of the length of the longest side to the length of the shortest side is not more than 2, in which at least 50% of the total number of silver halide grains in the silver halide emulsion contain ten or more dislocation lines per grain, and in which the silver halide emulsion is comprised of silver halide grains for which the relative standard deviation of the silver iodide content between individual silver halide grains is not more than 30%, and (2) a cyan coupler represented by formula (Va), (VIa) or (IXa) incorporated into at least one of said silver halide emulsion layer and a hydrophilic colloidal non-photosensitive layer adjacent thereto:

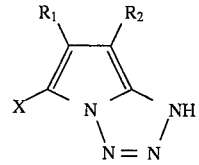
(Va)

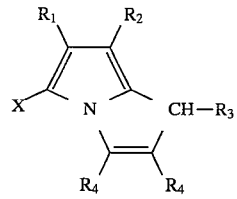
(VIa)

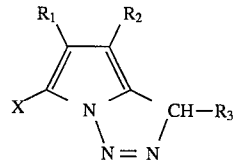
(IXa)

wherein $R_1$, $R_2$ and $R_3$ each represents an electron withdrawing group of which the Hammett substituent group constant $\sigma_p$ value is 0.20 or above; the sum of the $\sigma_p$ values of $R_1$ and $R_2$ is 0.65 or above; $R_4$ represents a hydrogen atom or a substituent group selected from the group consisting of a halogen atom, an aliphatic hydrocarbon group, an alicyclic hydrocarbon group, an aryl group, a heterocyclic group, an alkoxy group, an aryloxy group, a heterocyclic oxy group, an alkylthio group, an arylthio group, a heterocyclic thio group, an acyloxy group, a carbamoyloxy group, a silyloxy group, an alkyl sulfonyloxy group, an aryl sulfonyloxy group, a heterocyclic sulfonyloxy group, an acylamino group, an alkylamino group, an arylamino group, a ureido group, a sulfamoylamino group, an alkenyloxy group, a formyl group, an aliphatic acyl group, an aromatic acyl group, a heterocyclic acyl group, an alkylsulfonyl group, an arylsulfonyl group, a heterocyclic sulfonyl group, an alkylsulfinyl group, an arylsulfinyl group, a heterocyclic sulfinyl group, an alkyloxycarbonyl group, an aryloxycarbonyl group, a heterocyclic oxycarbonyl group, an alkyloxycarbonylamino group, an aryloxycarbonylamino group, a heterocyclic oxycarbonylamino group, an alkyl sulfonamido group, an aryl sulfonamido group, a heterocyclic sulfonamido group, a carbamoyl group, a sulfamoyl group, a phosphonyl group, a sulfamoylamino group, an imido group a hydroxy group, a cyano group, a —COOM group, an —$SO_3M$ group; a nitro group, and an unsubstituted amino group; where M represents a hydrogen atom, an alkali metal atom or $NH_4$; and where the alkyl moieties, the aryl moieties, and the heterocyclic moieties present in the above groups may be further substituted with a substituent group as indicated herein for $R_4$; when there are two $R_4$ groups, they may be the same or different; X represents a hydrogen atom or a group which can be eliminated by a coupling reaction with the oxidized form of a primary aromatic amine color developing agent; $R_1$, $R_2$, $R_3$, $R_4$ or X may be a divalent group and may form a bis compound or may be joined to oligomer or polymer chains to form oligomers, homopolymers or copolymers.

2. The silver halide color photographic photosensitive material as in claim 1, which contains a compound represented by formula (A) in at least one of said silver halide emulsion layer and a hydrophilic colloidal non-photosensitive layer:

$$Q—SM^1 \quad (A)$$

wherein Q represents a heterocyclic moiety which has at least one group selected from the group consisting of $—SO_3M^2$, $—COOM^2$, —OH and $—NR^1R^2$ bonded directly or indirectly to the heterocyclic group, $M^1$ and $M^2$ represent independently a hydrogen atom, an alkali metal atom, a quaternary ammonium group or a quaternary phosphonium group, and $R^1$ and $R^2$ represent independently a hydrogen atom or an alkyl group.

3. The silver halide color photographic photosensitive material as in claim 2, wherein said compound is included in at least one of the same layer wherein the cyan coupler represented by formulae (Va), (VIa) or (IXa) is included and the layer adjacent thereto.

4. The silver halide color photographic photosensitive material as in claim 2, wherein said compound represented by formula (A) is represented by formula (B) or (C):

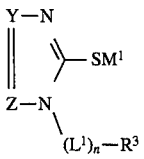

(B)

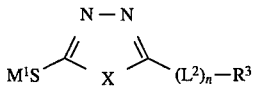

(C)

wherein Y and Z each independently represents a nitrogen atom or $CR^4$, where $R^4$ represents a hydrogen atom, an alkyl group, or an aryl group, $R^3$ represents an organic residual group which is substituted with at least one group selected from the group consisting of $—SO_3M^2$, $—COOM^2$, —OH and $—NR^1R^2$, where $M^1$, $M^2$, $R^1$ and $R^2$ have the same meanings as those defined in formula (A), X represents a sulfur atom, an oxygen atom or $—N(R^5)—$, where $R^5$ represents a hydrogen atom, an alkyl group or an aryl group, $L^1$ represents —S—, —O—, —N—, —CO—, —SO—, or $—SO_2—$, $L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR^6CONR^7—$, $—NR^6COO—$, $—OCONR^6—$ or $—NR^6SO_2NR^7$, where $R^6$ and $R^7$ each represents a hydrogen atom, an alkyl group, or an aryl group, and n represents 0 or 1.

5. The silver halide color photographic photosensitive material as in claim 2, wherein said compound is incorporated in an amount of $1\times10^{-7}$ to $1\times10^{-3}$ mol per $m^2$ of the photosensitive material.

6. The silver halide color photographic photosensitive material as in claim 1, wherein said cyan coupler is incorporated in an amount of 2.0 to $1.0\times10^{-3}$ mol per mol of silver halide.

7. The silver halide color photographic photosensitive material as in claim 1, wherein said silver halide emulsion layer is a red sensitive silver halide emulsion layer.

8. The silver halide color photographic photosensitive material as in claim 1, wherein the grain diameter of each of the silver halide grains in said silver halide emulsion layer is from 0.1 to 20 μm.

9. The silver halide color photographic photosensitive material as in claim 1, wherein said cyan coupler is represented by formula (Va).

10. The silver halide color photographic photosensitive material as in claim 1, wherein said cyan coupler is represented by formula (VIa).

11. The silver halide color photographic photosensitive material as in claim 1, wherein said cyan coupler is represented by formula (IXa).

* * * * *